US005949447A

United States Patent [19]

Arai et al.

[11] Patent Number: 5,949,447

[45] **Date of Patent: *Sep. 7, 1999**

[54] INK JET PRINTER HAVING EXCHANGEABLE RECORDING DEVICES, A RECOVERY CONTROL METHOD AND AN INK JET PRINTER THAT MANAGES AN AMOUNT OF INK REMAINING

[75] Inventors: Atsushi Arai, Kawasaki; Isao Ebisawa, Yokohama; Hisao Yaegashi, Kawasaki; Hidehiko Kanda, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/604,546

[22] Filed: Feb. 21, 1996

[30] Foreign Application Priority Data

Feb. 21, 1995 [JP] Japan ..... 7-032732
Feb. 21, 1995 [JP] Japan ..... 7-032733

[51] Int. Cl.[6] ..... B41J 2/165

[52] U.S. Cl. ..... 347/23; 347/86

[58] Field of Search ..... 347/23, 86, 87

[56] References Cited

U.S. PATENT DOCUMENTS

| | | |
|---|---|---|
| 4,313,124 | 1/1982 | Hara . |
| 4,345,262 | 8/1982 | Shirato et al. . |
| 4,459,600 | 7/1984 | Sato et al. . |
| 4,463,359 | 7/1984 | Ayata et al. . |
| 4,558,333 | 12/1985 | Sugitani et al. . |
| 4,608,577 | 8/1986 | Hori . |
| 4,639,738 | 1/1987 | Young et al. . |
| 4,723,129 | 2/1988 | Endo et al. . |

(List continued on next page.)

FOREIGN PATENT DOCUMENTS

| | | |
|---|---|---|
| 0374762 | 6/1990 | European Pat. Off. . |
| 0 442 438 | 8/1991 | European Pat. Off. . |
| 0 443 245 | 8/1991 | European Pat. Off. . |
| 0 556 011 | 8/1993 | European Pat. Off. . |
| 0 574 182 | 12/1993 | European Pat. Off. . |

(List continued on next page.)

OTHER PUBLICATIONS

Abstract of Japanese Laid–Open Patent Application No. 04–250064, Jan. 1991.

*Primary Examiner*—Matthew Nguyen
*Attorney, Agent, or Firm*—Fitzpatrick, Cella, Harper & Scinto

[57] ABSTRACT

An ink jet printing apparatus capable of exchangeably mounting a plurality of kinds of recording devices provided with discharging devices for discharging ink. The apparatus includes a recovery operation device for effecting a recovery operation for recovering a discharge condition of a recording head to be mounted to the apparatus, a timer for clocking an elapsed time from a predetermined operation, a discriminating device for discriminating a recording device to be mounted, a memory for memorizing data recording an elapsed time from a previous recovery operation for each of the plurality of kinds of recording devices, a calculating device for calculating an elapsed time of the recording device to be mounted from a previous recovery operation, based on an elapsed time clocked by the timer and data stored in the memory, a switch for switching between an operation state and a non-operation state of the apparatus, a back-up device for backing up the timer and the memory, even when the apparatus is not in operation, the back-up device also backing up the timer and the memory for a recording device, of the plurality of kinds of recording devices, not mounted to the apparatus, and a recovery control device for controlling the recovery operation by the recovery operation device by comparing the elapsed time from the previous recovery operation with a predetermined reference time for the recording device to be mounted.

82 Claims, 27 Drawing Sheets

U.S. PATENT DOCUMENTS

| | | | |
|---|---|---|---|
| 4,740,796 | 4/1988 | Endo et al. . | |
| 4,970,533 | 11/1990 | Saito et al. | 347/86 |
| 4,977,413 | 12/1990 | Yamanaka et al. . | |
| 5,049,898 | 9/1991 | Arthur et al. . | |
| 5,051,759 | 9/1991 | Karita et al. . | |
| 5,068,806 | 11/1991 | Gatten . | |
| 5,132,711 | 7/1992 | Shinada et al. . | |
| 5,136,305 | 8/1992 | Ims . | |
| 5,170,186 | 12/1992 | Shimamura et al. . | |
| 5,172,140 | 12/1992 | Hirabayashi et al. . | |
| 5,475,404 | 12/1995 | Takahashi et al. | 347/23 |
| 5,565,898 | 10/1996 | Sakuma | 347/23 |
| 5,610,635 | 3/1997 | Murray et al. | 347/87 |
| 5,627,572 | 5/1997 | Harrignton, III et al. | 347/23 |

FOREIGN PATENT DOCUMENTS

| | | |
|---|---|---|
| 0 587 172 | 3/1994 | European Pat. Off. . |
| 0 589 581 | 3/1994 | European Pat. Off. . |
| 0 608 104 | 7/1994 | European Pat. Off. . |
| 0604942 | 7/1994 | European Pat. Off. . |
| 54-056847 | 5/1979 | Japan . |
| 59-123670 | 7/1984 | Japan . |
| 59-138461 | 8/1984 | Japan . |
| 59-194853 | 11/1984 | Japan . |
| 60-071260 | 4/1985 | Japan . |
| 3-58854 | 3/1991 | Japan . |
| 03159750 | 7/1991 | Japan . |
| 4-90359 | 3/1992 | Japan . |
| 04232068 | 8/1992 | Japan . |
| 4-316856 | 11/1992 | Japan . |
| 5-19467 | 3/1993 | Japan . |
| 5-88552 | 4/1993 | Japan . |
| 06031921 | 2/1994 | Japan . |
| 6-122206 | 5/1994 | Japan . |
| WO92/18335 | 10/1992 | WIPO . |

| FIG. 3A |
| --- |
| FIG. 3B |

| FIG. 6A |
| --- |
| FIG. 6B |

| FIG. 9A |
| --- |
| FIG. 9B |

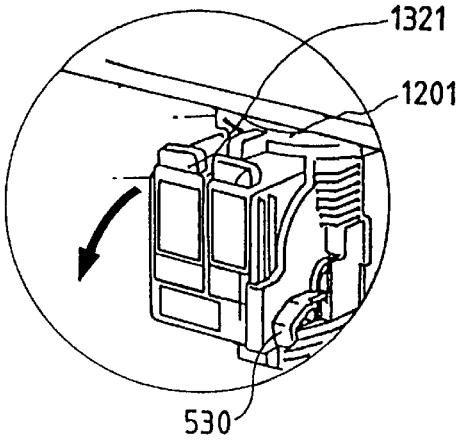
FIG. 19A2
FIG. 19A1
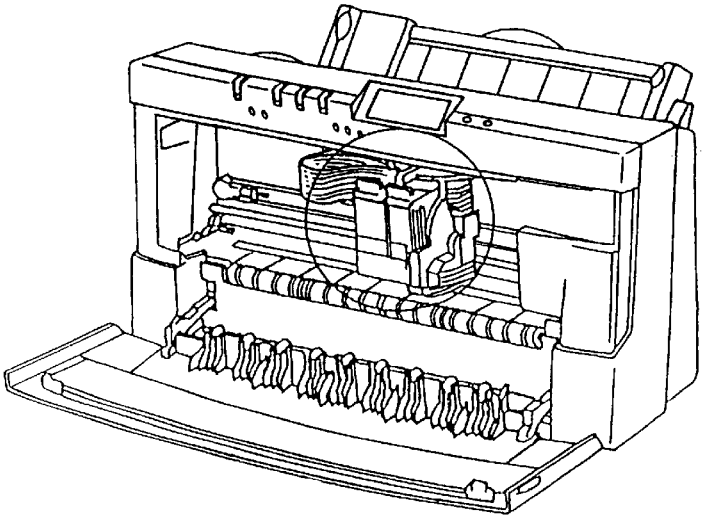
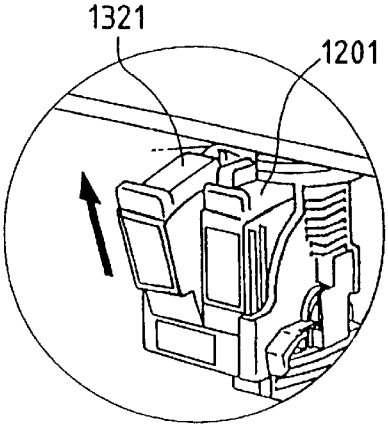
FIG. 19B2
FIG. 19B1
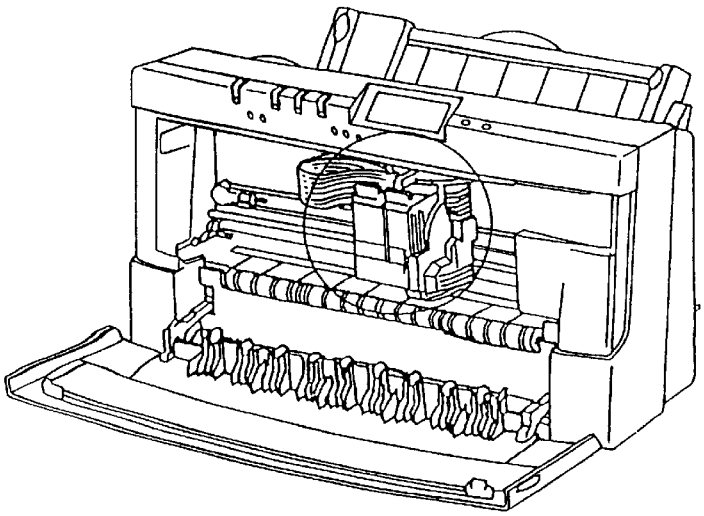

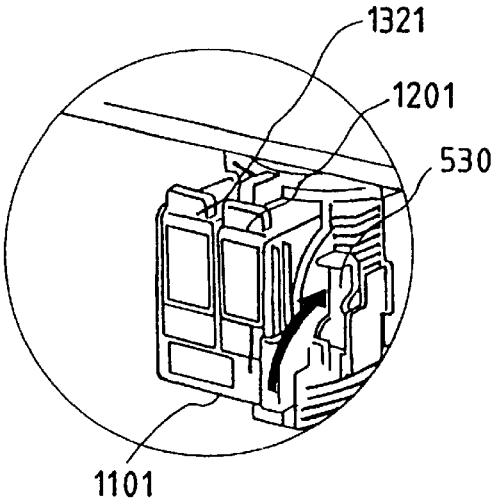
FIG. 20A2
FIG. 20A1
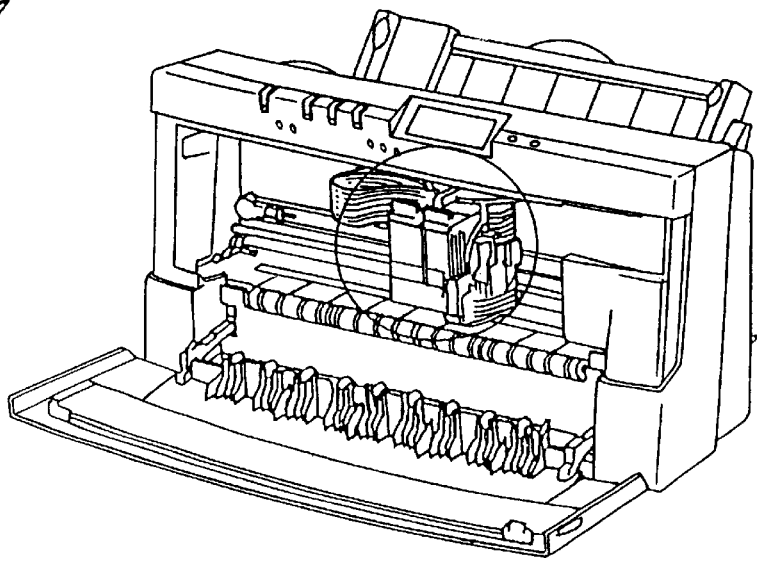
FIG. 20B
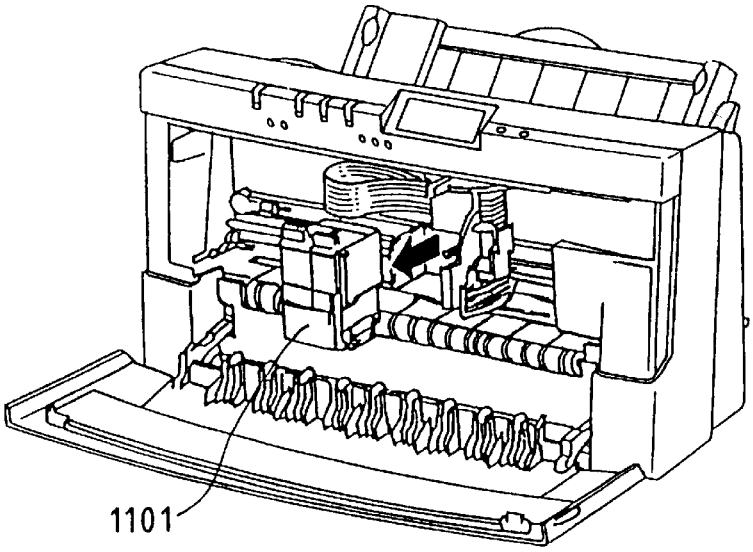

| FIG. 21A | FIG. 21B |
|---|---|

INK JET PRINTER HAVING EXCHANGEABLE RECORDING DEVICES, A RECOVERY CONTROL METHOD AND AN INK JET PRINTER THAT MANAGES AN AMOUNT OF INK REMAINING

BACKGROUND OF THE INVENTION

1. Field of the Invention

The present invention relates to an ink jet printing apparatus, and more particularly to an ink jet printing apparatus provided with recovery operating means for a head which discharges the ink, and a head recovery method.

Also, this invention relates to an ink jet apparatus which can indicate the amount of ink remaining in an ink storing vessel by calculating the amount remaining based on the amount of ink discharged from the ink jet head and the amount of ink consumed by the recovery operation with said recovery operating means.

This invention is applicable to all ink jet printing apparatuses for forming an image on a printing medium, such as paper, cloth, leather, a nonwoven fabric, an OHP sheet, and a metal sheet, by discharging the ink. Specific examples of application devices may include business machines, such as a printer, a copying machine, or a facsimile terminal equipment, and industrial production equipment.

2. Related Backqround Art

Of the apparatuses which apply an ink jet system for discharging the ink, an ink jet recording apparatus (printing apparatus) for forming the image on the printing medium is well known.

Such an ink jet recording apparatus is provided with an ink jet recording head for discharging the ink to form the character or image on the recording medium such as paper by discharging the ink from the discharge ports provided in the ink jet recording head by driving discharge means.

The ink jet recording apparatuses can be classified into various different ink jet recording systems, according to the constitution of discharge means for discharging the ink. Typical examples of the ink jet recording system may include a system of discharging the ink by applying heat energy to the ink, using heat energy generating means such as electrothermal converting elements as discharging means, a system of discharging the ink by mechanically applying pressure to the ink, using electromechanical converting elements such as piezo-electric elements, etc. As the former, a so-called bubble jet system is well known in which using a discharging heater to apply heat energy to the ink to produce a bubble in the ink, particularly on the heater, the ink is discharged by using pressure generated when the bubble is produced (bubbling).

The ink jet recording apparatus has had a problem with the evaporation of the water content because the principal component of ink is its water content, or a problem that air bubbles may remain within the inside of discharge ports because the air enters through discharge ports, or the gas dissolved in the ink arises as air bubbles, degrading the discharge condition.

Also, in the above-mentioned bubble jet system, a discharging process includes repeatedly performing a step of producing the bubble by applying heat energy, and a step of enabling the bubble to shrink by stopping the application of heat energy. The ink jet recording apparatus of the bubble jet system has had a further problem that fine bubbles may remain in some of the ink flow passageways during the repetition of the above process, resulting in unstable ink discharge.

The ink jet recording apparatus is typically provided with various mechanisms for maintaining the quality of ink discharge by preventing the water content of the ink on or around the discharge ports where the ink is in contact with the air from evaporating to thicken the ink, or removing the thickened ink or produced bubbles.

In particular, the ink jet recording heads recently developed have the discharge ports or liquid channels communicating to them constructed extremely finely and at high density, and thereby are greatly influenced by the increased viscosity of the ink or unnecessary production of bubbles.

Therefore, the ink jet recording apparatus is provided with a capping mechanism for preventing the water content of ink evaporating from the discharge ports by enclosing (capping) the face where the discharge ports of the recording head are provided, when in the non-recording operation of discharging no ink droplets.

Also, to effect more stable ink discharging, it is known to perform various recovery operations to recover the discharge performance of the ink when starting the recording or periodically during the recording operation.

As one of the recovery operations, it is known to perform a discharge operation to expel the ink out of the discharge ports particularly not involving the recording by discharging the ink from all or desired discharge ports of the recording head at a predetermined position within the recording apparatus. By such a discharge operation not involving the recording, the ink is expelled out of the liquid channels in communication with the discharge ports that are employed less frequently in recording, and after exhaust, the new ink is supplied to replace (update) the ink within the liquid channels with the new ink having a normal viscosity. Such a discharge operation is referred to as a preliminary discharge operation because it occurs particularly when the recording is started.

Among other recovery operations, a recovery operation such as an ink suction operation or an ink pressure operation is well known in which with a mechanism for expelling the ink from the discharge ports, a suction operation or pressure operation is effected to expel the ink on or inside the discharge ports when starting the recording or at every desired time interval, thereby expelling the thickened ink and air bubbles together with the ink.

FIG. 1 shows the constitution of a main portion of a conventional ink jet recording apparatus.

In FIG. 1, 21 is an ink jet cartridge (hereinafter simply referred to as a "cartridge") to be mounted on a carriage 22, this cartridge integrally having a recording head (hereinafter simply referred to as a "head") having a nozzle section for jetting the ink, an ink tank as a vessel for storing the ink, and an ink supply unit having an ink supply passage. This cartridge 21 includes a Bk ink dedicated cartridge for recording only with the black ink (hereinafter abbreviating the black ink as Bk), and a color recording cartridge for recording with the color inks, these cartridges being replaceably mounted on the carriage 22 and selectively used. The carriage 22 and the cartridge 21 are electrically connected via a contact pad, not shown. 23 is an electrical substrate making up a control section for controlling the ink discharging by the cartridge 21, and 24 is a flexible cable for connecting its electrical substrate 23 to the carriage 22. 25 is a paper feed motor, whereby the recording sheet P is conveyed in a direction of the arrow f in the figure by the rollers 26, driven by this paper feed motor 25. Reference numeral 27 represents is rollers for forming the recording face for the cartridge 21 by regulating the recording sheet P flat in cooperation with the rollers 26. 28 is a carriage driving belt connected to the carriage 22, 29 is a motor for driving its belt in the directions of S in the figure, and 30 represents guide rails for the carriage 22. The carriage 22 can be moved in the directions of S along the guide rails 30, while being driven by the motor 29, to effect the recording on the recording surface.

Also, 31 is a recovery device as recovery means to effect the recovery operation as previously described for the head of the cartridge 21, opposed to the cartridge 21 at a home position H of the cartridge 21.

Also, the cartridge 21 mounted on the carriage 22 is driven in the directions of S in the figure over the recording sheet P by the motor 29, along with the carriage 22. The recording sheet P is conveyed in the direction of the arrow f as shown by the rollers 27, driven by the paper feed motor 25. Thereby, the secondary scanning by the recording head 21 is made. At this time, the recording head performs the recording on the recording sheet P by selectively jetting ink droplets under the control of a control unit.

In the recovery operation as previously described, the ink may be wastefully consumed if the recovery operation is made more than necessary, because the discharged ink is no longer usable for the recording. To avoid wasteful consumption of the ink to the utmost, it is desired to perform the recovery operation at the optimal timing. To this end, various control methods are taken, regarding the operation timing to effect the recovery operation, as well as the operation conditions. Among them, a method is especially effective of determining the operation timing based on the count value of a timer having a lower demand and backed up by a battery provided within a main body of the recording apparatus (hereinafter referred to as a "back-up timer control"). In particular, this back-up timer control is effective to construct a smaller recording apparatus with the ink consumption suppressed, because the power supply is frequently interrupted for the ink jet recording apparatus of the type which is small and portable for use.

Also, in the field of the ink jet printing, an ink jet unit having an ink jet head and an ink tank integrated (similar to the cartridge as previously described) has been recently employed from the aspects of smaller apparatus and easier maintenance by the user. This ink jet unit can be freely detachably mounted on the carriage in the printing apparatus, whereby the user can replace the ink jet unit with a new one when the ink within the ink tank is used up.

Moreover, with the increasingly higher demands of the color print, several constitutions which can meet the requirements of the coloration with the above ink jet unit have appeared, including, for example, those having arranged an ink jet unit for each color on the carriage to effect the color printing. Other constitutions may include those having freely detachably mounted on the carriage a color ink jet unit comprising as one component the ink tanks for storing the yellow, magenta and cyan inks individually for use in the color printing, and the ink heads for discharging these inks, and a unitary ink jet unit for the black ink alone.

Furthermore, a constitution has been proposed in which the ink jet head and the ink tank can be individually mounted freely detachably on the carriage.

The apparatuses which allow the user to mount or dismount the ink jet head and the ink tank on or from the apparatus, especially those which can mount only the black ink jet head and tank at certain times, and mount the other color heads and tanks at other times, in accordance with the image to be printed, had the following problems with controlling the recovery operation or managing the amount of ink remaining.

In the back-up timer control as previously described, control is enabled only for the head of the cartridge being currently mounted thereon, and for example, in an ink jet recording apparatus using a plurality of cartridges exchangeably, e.g., using exchangeably a monochrome cartridge for the Bk ink recording and a color cartridge for the color ink recording, while storing the unused cartridge within a special storage box, the back-up timer control was ineffective for the cartridge which was not mounted thereon. Therefore, in exchanging the cartridge, it is always necessary to stabilize the ink discharging by performing the recovery operation, with the result that there is an inconvenience that the ink will be consumed wastefully by that amount of discharge. That is, the conventional back-up timer control may result in the wasteful consumption of ink because the recovery operation may be conducted even when it is unnecessary. In the ink jet recording apparatus which is portable for use, it is required to reduce the capacity of the ink tank, according to the size of the apparatus, for the purposes of fabricating a smaller and lighter apparatus. However, the apparatus which has the wasteful consumption of ink will frequently result in no ink remaining if the smaller ink tank is used, requiring the ink tank to be frequently exchanged, with higher running costs. Accordingly, if the wasteful consumption of ink cannot be suppressed, the ink tank cannot be miniaturized, and the construction of a smaller recording apparatus is hampered.

Also, an ink jet recording apparatus is well known having the feature of informing the user of the ink remaining or that the ink is used up (hereinafter referred to as the ink remaining condition) by detecting or calculating the ink remaining within the vessel for storing the ink. Various methods for detecting the ink remaining have been proposed, but it is desirable to provide a mechanism capable of detecting more precisely the ink remaining or that the ink remaining has diminished.

To detect the ink remaining or the ink remaining condition correctly, it is desirable to take into consideration the amount of ink discharged by the recovery operation as previously described.

Conventionally, one example of ink remaining detecting means in the ink jet printing apparatus is well known, which is called a "dot count remaining detection". This method detects the ink remaining within the ink tank by measuring the amount of discharged ink or the amount of ink consumed in the recovery operation by counting the number of discharges or the number of recovery operations, and has the advantage that any special means for detecting the ink remaining is unnecessary, with the least cost.

The conventional examples with the above-mentioned dot count remaining detection were described in Japanese Patent Publication No. 5-19467, Japanese Patent Laid-Open Application No. 4-316856, and Japanese Patent Laid-Open Application No. 5-88552, for example. However, any dot count remaining detection described in these documents relies on counting the dots by considering that the quantity of ink droplets discharged from the head is constant. Also, the ink jet head in the printing apparatus is secured in any constitution. That is, the head is secured to the apparatus main body or the carriage movable along a predetermined area. If such a constitution is applied to the recording apparatus of the type using the cartridge having the ink jet head and the ink tank integrally, it only allows the use of one sort of cartridge, but is difficult to apply to the ink jet recording apparatus which employs a plurality of cartridges by exchanging them in accordance with the uses, as previously described.

By the way, the ink jet recording apparatus of the bubble jet system as previously described can discharge the ink by using electrothermal conversion elements or discharge heaters, heating the ink with the above heaters in accord with the discharge signal, and giving rise to film boiling in the ink to effect ink discharge by the bubbling force of a bubble produced thereby, but it has been found that the heat will be accumulated in the head due to the self-heating in discharging the ink or the outside air temperature condition, so that the ink temperature may change to cause varied volumes of ink to be discharged. Also, it has been found that in other ink jet systems, the amount of ink to be discharged may change owing to the effect of outside air temperatures.

The constitution of detecting the ink remaining by counting, supposing that the amount of discharged ink is constant, as in the conventional example as above described, may cause a relatively large detection error.

Also, the ink jet recording apparatus having exchangeably the ink jet unit employed in accordance with the purposes, e.g., printing in colors or black alone, had the problem in managing the ink remaining.

That is, if there are different kinds of inks to be discharged, the set amount of discharge for each head may vary, in which case, if the dot count remaining detection is directly conducted, the incorrect ink remaining detection may result. Also, if there are variations in the amount of discharge due to the effect of heat accumulation as above described, the ink remaining detection error will further increase.

SUMMARY OF THE INVENTION

It is an object of the present invention to resolve the conventional problems as described above and to provide an ink jet printing apparatus capable of effecting the recovery operation for a plurality of heads without waste and efficiently, and a recovery method for the heads.

Also, it is another object of this invention to provide an ink jet printing apparatus capable of performing the ink remaining detection appropriately and correctly, in coordination with the control of the discharge amount associated with the control of the recording, or the change in the discharge amount caused by temperature variations, and further in accordance with the type of a head or an ink storing unit to be mounted, or the type of a cartridge where the head and the ink storing unit are integrally formed.

To accomplish the above objects, the present invention provides an ink jet printing apparatus capable of mounting exchangeably a plurality of kinds of recording means provided with discharging means for discharging the ink, which performs the printing on the printing medium by discharging the ink with said recording means, comprising recovery operating means for effecting the recovery operation for recovering the discharge condition of a recording head to be mounted, timer means for clocking the elapsed time from said predetermined operation, discriminating means for discriminating recording means to be mounted, memory means for memorizing data regarding the elapsed time from the previous recovery operation for each of said plurality of kinds of recording means, calculating means for calculating the elapsed time of recording means to be mounted from the previous recovery operation with said recovery operating means, switch means for switching between the operation and non-operation of said ink jet printing apparatus, back-up means for backing up the clocking operation of said timer means and the memorizing operation of said memory means, even when said ink jet printing apparatus is not operated by said switch means, and recovery control means for controlling the recovery operation with said recovery operating means by comparing the elapsed time from the previous recovery operation with a predetermined reference time.

Also, the present invention provides a recovery control method for an ink jet printing apparatus capable of mounting exchangeably a plurality of kinds of recording means provided with discharging means for discharging the ink, which performs the printing on the printing medium by discharging the ink with said recording means, characterized by including a memorizing step of memorizing data regarding the elapsed time from the previous recovery operation for each of said plurality of kinds of recording means, a clocking step for clocking the elapsed time from a predetermined operation, a back-up step of backing up data memorized at said memorizing step and by the clocking operation at said clocking step, while said ink jet printing apparatus is switched into the non-operation state, a measuring step of measuring the elapsed time from the previous recovery operation of said recording means to be mounted, when said ink jet printing apparatus is switched from the non-operation state to the operation state, and a recovery control step of controlling the recovery operation for recovering the ink discharge condition of said recording means by comparing the elapsed time from the previous recovery operation with a predetermined reference time.

Also, the present invention provides a head recovery method in an ink jet printing apparatus for performing the printing on the printing medium using a plurality of heads for discharging the ink, and having recovery operating means for making the recovery operation of said heads to effect excellent printing, characterized by including measuring the elapsed time from the previous recovery operation time for each of said plurality of heads with measuring means having a power source backed up, and allowing said recovery operating means to effect recovery operation for each of said plurality of heads when said elapsed time is greater than or equal to a predetermined reference time for comparison.

Also, the present invention provides an ink jet printing apparatus capable of mounting recording means having a discharging unit for discharging the ink and an ink storing unit for storing the ink to be supplied to said discharging unit, which performs the printing on the printing medium by discharging the ink, using a plurality of kinds of recording means exchangeably, characterized by comprising kind detecting means for detecting the kind of recording means to be used for printing among said plurality of kinds of recording means, calculating means for calculating the amount of ink consumed by recording means for use in printing, in accordance with the kind of recording means which said kind detecting means detects, and informing means for informing with different indications the ink remaining within said ink storing unit, based on the ink consumption amount calculated by said calculating means, and in accordance with the kind of recording means which said kind detecting means detects.

Also, the present invention provides an ink jet printing apparatus capable of mounting recording means having a discharging unit for discharging the ink and an ink storing unit for storing the ink to be supplied to said discharging unit, which performs the printing on the printing medium by discharging the ink, using a plurality of kinds of recording means exchangeably, comprising calculating means for calculating the amount of ink consumed by said discharging unit, discharge amount detecting means for detecting the ink discharge amount to be discharged from said discharging unit, ink remaining detecting means for detecting the ink remaining of said ink storing unit based on the consumed ink amount which said calculating means calculates and for correcting the consumed ink amount calculated by said calculating means by the ink discharge amount which said discharge amount detecting means detects.

BRIEF DESCRIPTION OF THE DRAWINGS

FIGS. 19A1, 19A2 and 19B1, 19B2 are views for explaining how to mount or dismount an ink tank for the color cartridge.

FIGS. 20A1, 20A2 and 20B are views for explaining how to dismount a color cartridge from the carriage.

DESCRIPTION OF THE PREFERRED EMBODIMENTS

The preferred embodiments of the present invention will be specifically described by way of example with reference to the drawings.

(First example)

As the first example of the present invention, an ink jet recording apparatus capable of mounting a plurality of cartridges exchangeably will be described below.

In this example, an ink jet recording apparatus using two kinds of cartridges, a cartridge for the color recording with multiple color inks and (hereinafter referred to as a color cartridge) and a cartridge for the monochrome recording only with the black ink (hereinafter referred to as a black cartridge) now will be explained as an application. It should be noted that the mechanical constitution of this apparatus is the same as that shown in FIG. 1 and previously described, and is not described in more detail.

Figure 2:
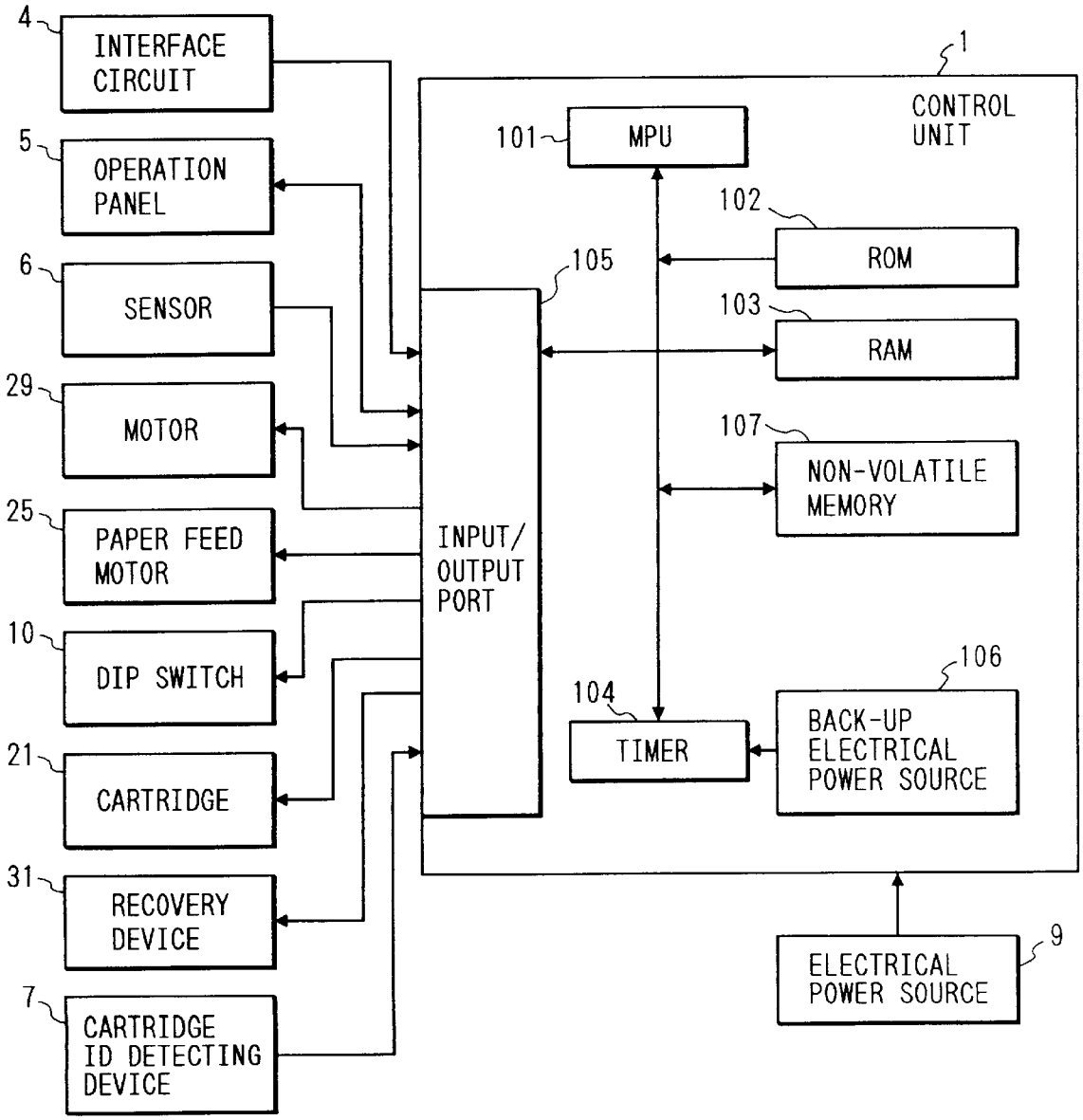
FIG. 2 is a block diagram showing a control unit in an example of the present invention.

In FIG. 2, the block configuration of a control system in the ink jet recording apparatus of this example is shown.

In FIG. 2, the control unit 1 is comprised of a microprocessor unit (MPU) 101, a ROM 102 where a control program including processing procedures and a variety of sorts of parameters are stored, a RAM 103 where data such as recording data is temporarily stored, a timer 104 as a clocking unit for counting the time, an input/output port 105, a power source 106 consisting of a battery for backing up the timer 104, and a non-volatile memory 107 for memorizing the time value of the timer 104 that has been counted. The timer 104 which is backed up by the power source 106 can always clock the time, irrespective of whether the power of the recording apparatus is turned on or off. Also, this timer 104 is reset and started at a predetermined timing as will be described later, at which time it starts to clock the time since it is reset to zero.

Also, the recording data is input from a host apparatus, not shown, via an interface circuit 4. The ink jet recording apparatus of this example can be controlled not only from the host apparatus, but also via an operation panel 5. Moreover, there are provided a variety of sensors for sensing the presence of a recording sheet P, the home position H of a carriage 22, and whether or not any cartridge is mounted. The supply of electric power to each unit contained within the apparatus is made from an electrical power source 9. A recovery device 31 makes a capping operation of capping the head of cartridge 21, and a recovery operation of recovering the discharge condition of the head when the head is clogged. By a recovery operation is meant an operation of, for example, enclosing the surrounding of ink discharge ports of the head with a cap and sucking the ink through the nozzles by generating a negative pressure using a pump, thereby removing any bubble and dust together with the ink, but the content of the recovery operation is not limited thereto, and may be an operation of expelling the ink by driving the discharging means or pressurizing the ink by a pump. Also, a cartridge ID for the identification of a cartridge is read by a cartridge ID detecting device 7, and the kind of head is determined by the MPU 101, based on that ID. Also, the head may be provided with the ID for the identification of the head.

Figures 3, 3A:
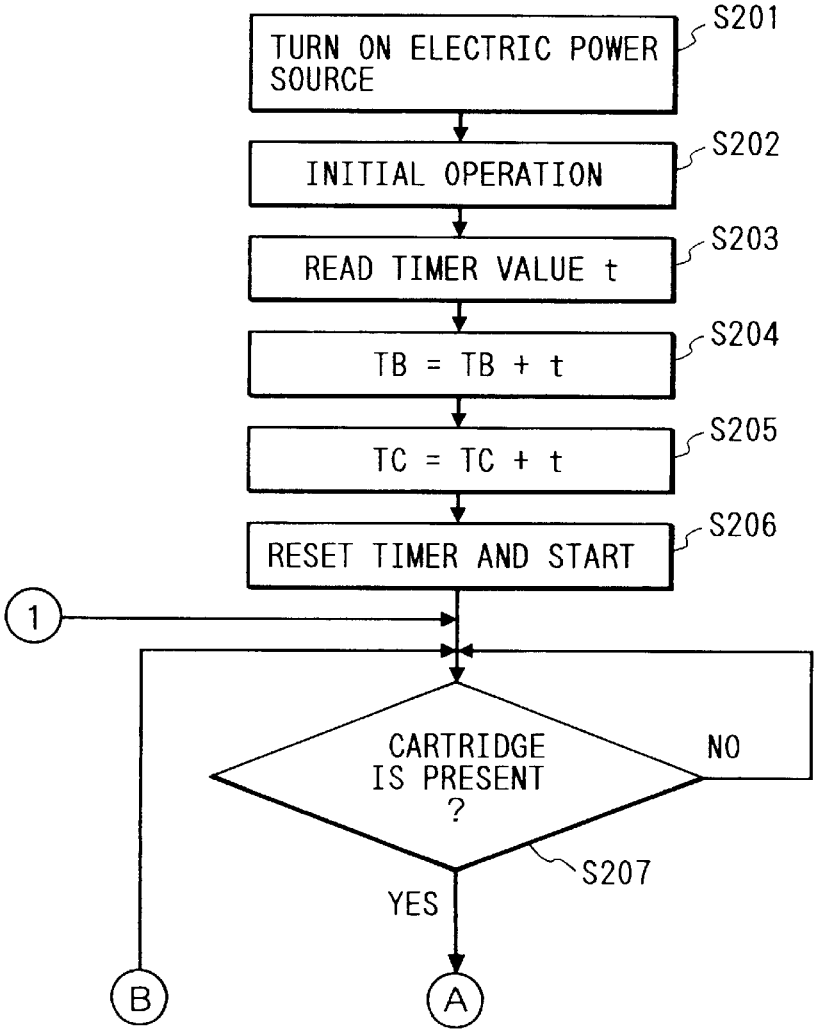
FIG. 3, which is comprised of FIGS. 3A and 3B.
Figure 3B:
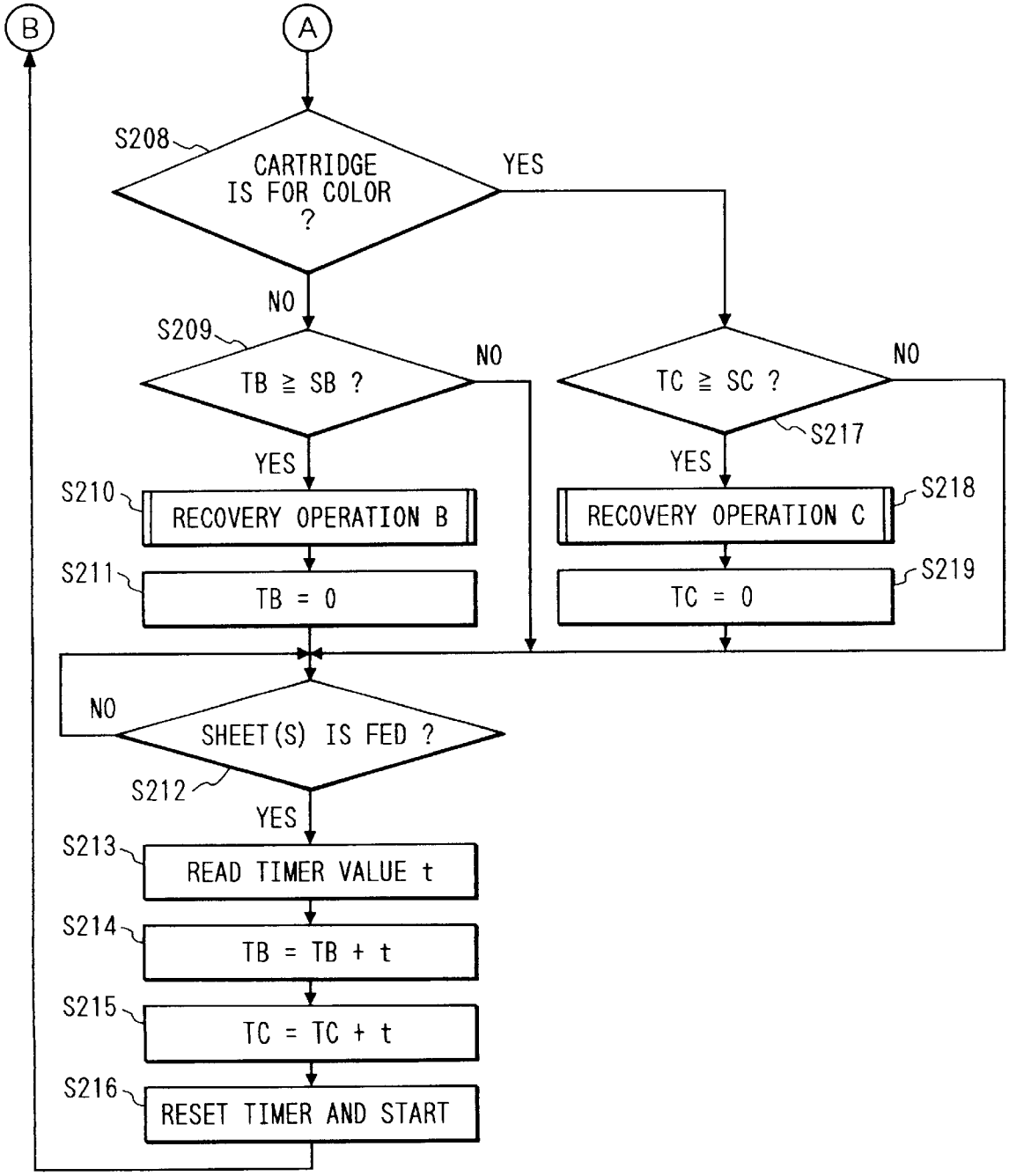
Figure 4:
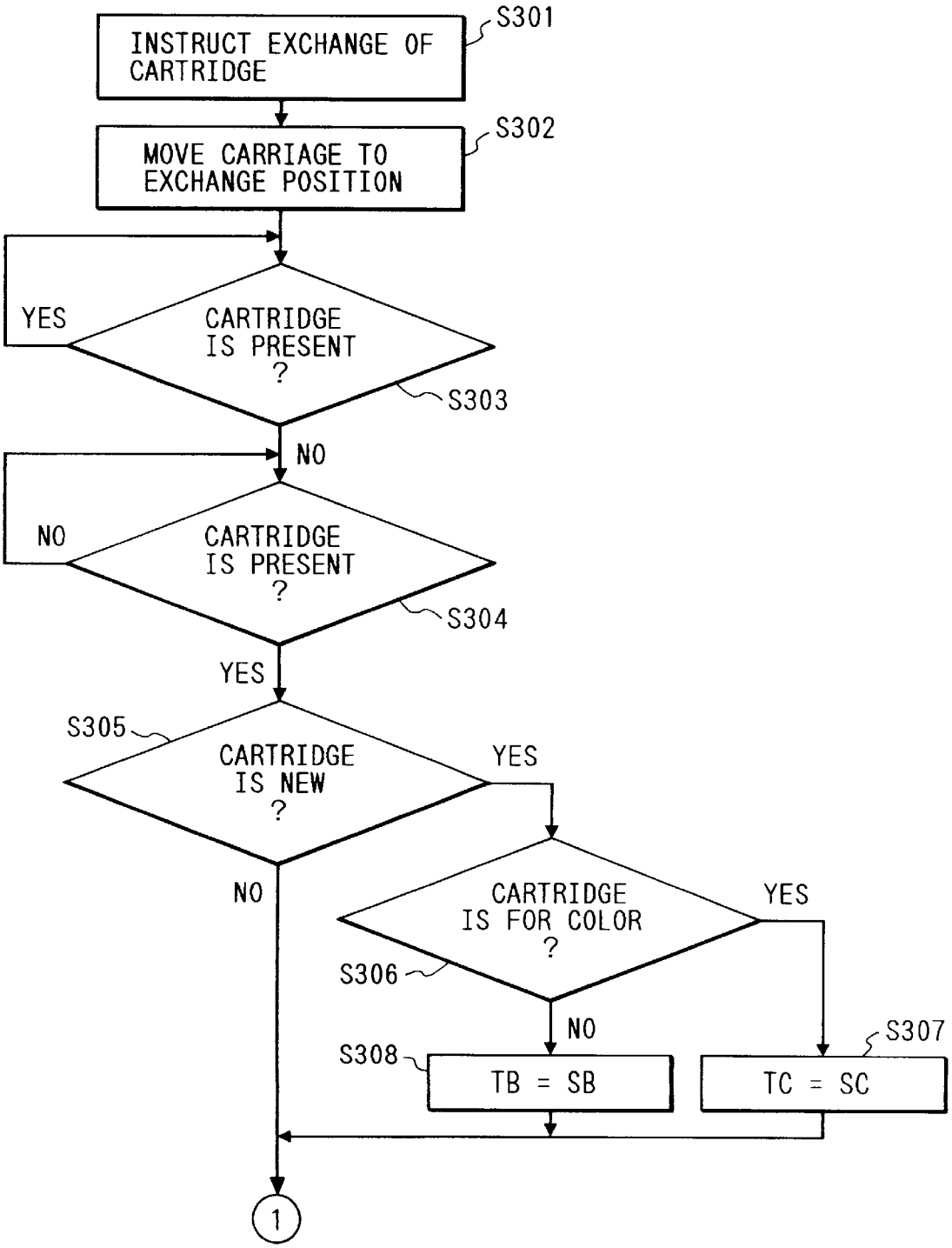
FIG. 4 are flowcharts for explaining a process of a recovery operation in the example of this invention.

FIGS. 3A, 3B and 4 are flowcharts for explaining a procedure of back-up timer control in the ink jet recording apparatus having the control unit 1.

A processing procedure when the power is turned on will be described below, based on FIGS. 3A and 3B.

If the power of the recording apparatus is turned on at step S201, an initialization operation of the apparatus itself is performed at step S202. This initialization operation includes a memory check, a sensor check, and a positional correction of the carriage. Thereafter, at step S203, the time t measured by the timer 104 (hereinafter referred to as "timer value t") is read. The timer 104 is always clocked by the back-up power source 106, irrespective of whether the power of the recording apparatus is turned on or off, this timer value t corresponding to the elapsed time from the previous reset and start time.

And at step S204, the timer count value TB for a black cartridge stored in the memory 107 is updated by adding the timer value t to it (TB=TB+t). Similarly, at step S205, the timer count value TC for a color cartridge stored in the memory 107 is updated by adding the timer value t to it (TC=TC+t). Thereafter, the timer is reset and started at step S206. Accordingly, the timer 104 once resets the timer value t to zero at this time and starts to clock again continuously the timer value t corresponding to the elapsed time.

Then, a determination is made at step S207 whether or not the cartridge is mounted. If the cartridge is not present, step S207 is repeated while a warning is indicated, whereas if the cartridge is present, the kind of cartridge is determined at step S208 . The contents of the processing can be divided as follows, in accordance with the kind of cartridge.

(1) When the cartridge is for the black ink.

First, at step S209, a comparison is made between the black cartridge timer count value TB within the non-volatile memory 107 and the black cartridge timer set value SB which is preset in the ROM 102, wherein if TB≧SB, the recovery operation B for the black cartridge is performed at step S210, then TB is set to 0 at step S211, and the procedure proceeds to step S212. On the other hand, if TB<SB, the recovery operation B and the reset of TB are not made, and the procedure proceeds to step S212.

At step S212, the procedure waits for a sheet to be fed. If the sheet is fed, the timer value t of the timer 104 is first read at step S213, the black cartridge timer count value TB stored in the memory 107 is updated by adding its count value t to it (TB=TB+t) at step S214, and further, the color carriage timer count value TC stored in the memory 107 is updated by adding its count value t to it (TC=TC+t) at step S215. Then, at step S216, the timer 104 is reset and started, and the procedure returns to step S207. Note that the timing of executing steps S213 to S216 is not limited to the timing of feeding the sheet, but may be arbitrary, for example, at every predetermined timing, or in accordance with the timing of exhausting the recording sheet.

With the above processing, the recovery operation B is performed under the control of a back-up timer for the black cartridge.

(2) When the cartridge is for the color cartridge.

An instance where the mounted cartridge is a cartridge for the color ink will be next described.

At step S208, if the mounted cartridge is determined to be a color cartridge, the procedure proceeds to step S217, where a comparison is made between the color cartridge timer count value TC within the non-volatile memory 107 and the color cartridge timer set value SC preset in the ROM 102. If TC≧SC, the recovery operation C for a color cartridge is performed at step S218, then TC is set to 0 at step S219, and the procedure proceeds to step S212. On the other hand, if TC<SC, the recovery operation C and the reset of TC are not made, and the procedure proceeds to step S212.

With the above processing, the recovery operation C is performed under the control of the back-up timer for the color cartridge.

A processing procedure in exchanging the cartridge will be next described based on FIG. 4.

First, if there is an instruction for the exchange of a cartridge from the operation panel at step S301, the procedure passes to step S302 to move the carriage to a cartridge exchange position. Then, a determination is made whether or not the cartridge is present at step S303, and if the cartridge is determined to be present, the detection is continued until the cartridge is absent. If the cartridge is determined to be absent, a determination is made again whether or not the cartridge is present at step S304. Then, if the cartridge is absent, step S304 is repeated until the cartridge is present. And if the cartridge is detected at step S304, the procedure proceeds to step S305, to determine whether or not the mounted cartridge is new, based on the instruction from the operation panel. While in this example the user informs the MPU that the mounted cartridge has a new head by instructing from the operation panel, it should be appreciated that other than this method, the recording apparatus itself may automatically determine whether or not the cartridge is new, based on the information from an information retaining feature (memory, mechanical lug, etc.) provided in the cartridge. If the cartridge is indicated to be not new, the procedure directly proceeds to step S205 as shown in a flowchart of FIG. 3A. If it is indicated that the cartridge is new, the kind of the cartridge is determined at step S306. If the cartridge is a new cartridge, the count value TC is set to the set value SC (TC=SC), and then the procedure proceeds to step S307. On the other hand, if the cartridge is a new black cartridge, the count value TB is set to the set value SB at step S308 (TC=SC), and then the procedure proceeds to step S207. The steps following step S207 are identical to those as shown in FIG. 3B.

When the cartridge is replaced with a new one by performing such processing, the recovery operation is performed to assure the ink discharging stability, or for the cartridge during use which may have been stored within the storage box, the proper automatic recovery operation is performed under the control of the back-up timer.

According to the above processing, even when using the color cartridge and the black cartridge exchangeably, the recovery operation can be carried out under the control of the back-up timer for the respective cartridges, resulting in a recovery operation just enough, while preventing wasteful consumption of the ink.

In particular, when the color cartridge is constructed to be able to discharge the multi-color inks, with a different structure from the black cartridge, the timing of the recovery operation may be greatly different. Therefore, if the timing of a recovery operation for each kind of cartridge is optimally controlled as in this example, it is possible to suppress the consumption of ink while effecting the enhanced reliability.

(Second example)

As a second example of the present invention, an ink jet recording apparatus capable of mounting two kinds of cartridges, a color cartridge for the color recording and a black cartridge for the monochrome black recording, at the same time (hereinafter referred to as a "twin cartridge recording apparatus") will be described below as an application example.

This twin cartridge recording apparatus is effective in recording a color image containing the black character or black image therein. It is known that the color black can be represented by superposing the dots of three color inks of yellow, magenta and cyan which are normally used in the color recording. A technique for representing the black by using other color inks in this way is hereinafter referred to as a process black. In this process black, however, the dot color may become a light blue-like black, or have the cyan or magenta conspicuous on the contour, caused by the fact that superposing three color dots correctly is difficult, so that the real black is difficult to represent. Therefore, by mounting both a cartridge for the black and a cartridge for the color, the quality of the black character or black image can be enhanced, resulting in a an even better image being formed.

Figure 1:
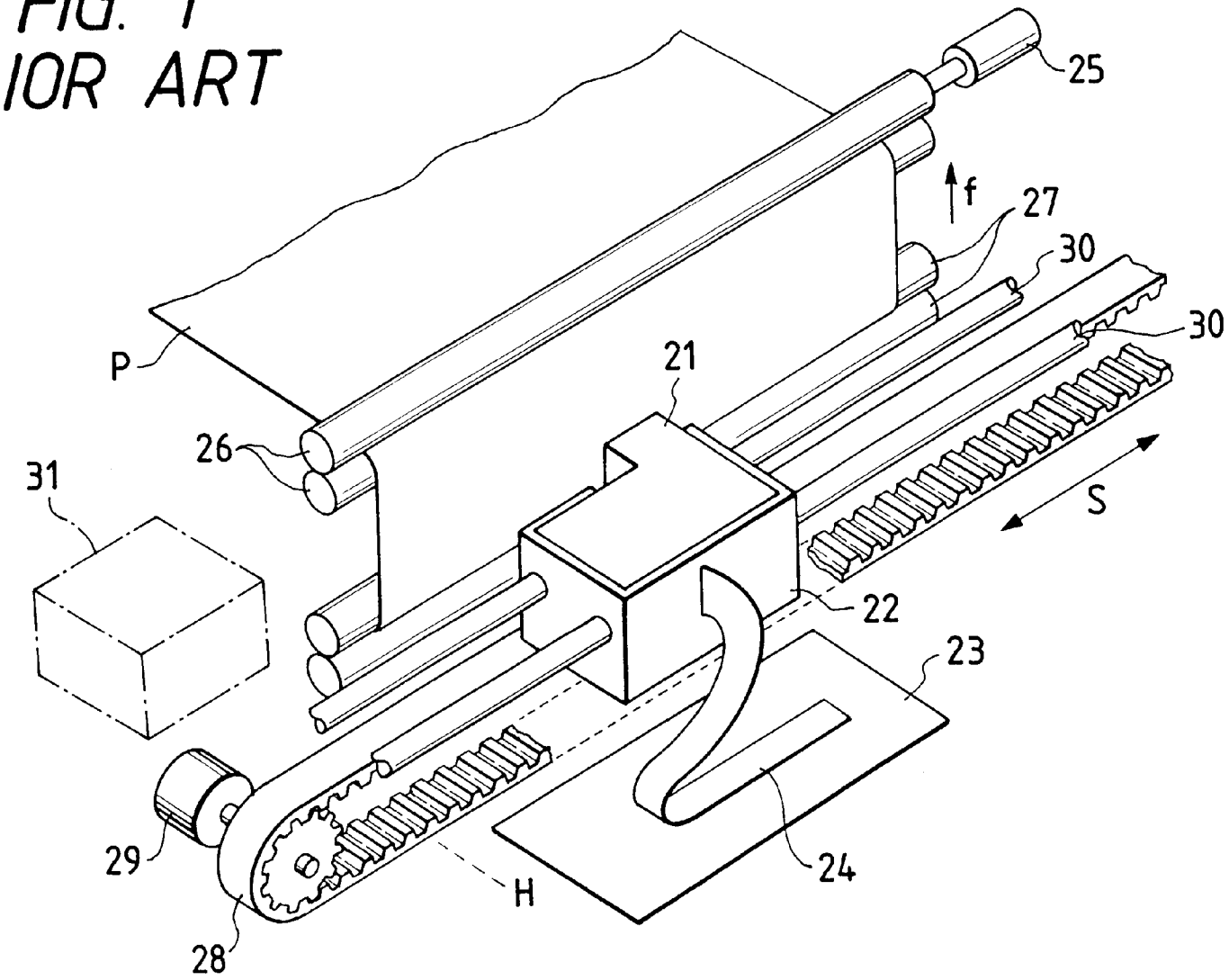
FIG. 1 PRIOR ART
FIG. 1 is a perspective view of a conventional ink jet printing apparatus.
Figure 5:
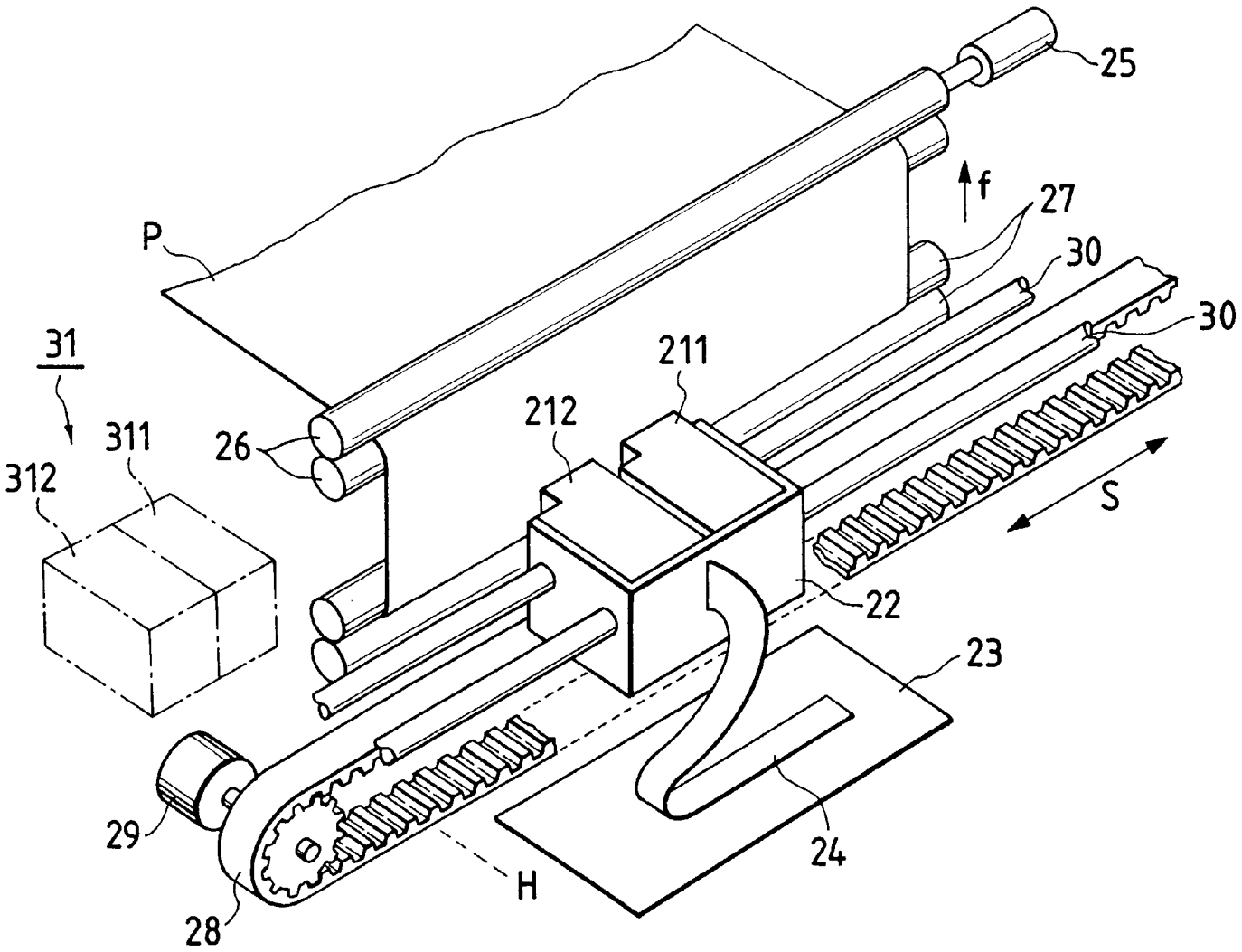
FIGS. 5 and 8 are perspective views for the ink jet printing apparatus in the examples of this invention.

FIG. 5 is a perspective view showing the constitution of a main portion of a twin cartridge type recording apparatus. In FIG. 5, the same parts as those shown in FIG. 1 are indicated by the same numerals, and are not described in more detail.

A color recording cartridge 211 and a black recording cartridge 212 are mounted on a carriage 22, and can be independently exchanged. The recording on the recording sheet P can be achieved using both or either of the cartridges 211, 212. The constitution of elements 23 to 30 is the same as that of the ink jet recording apparatus as shown in FIG. 1 and previously described. 31 is a recovery device for performing the recovery operation, by being placed opposed to the cartridge, at a home position H of the cartridge 211, 212. The recovery device 31 has a recovery unit 311 for the color cartridge 211 and a recovery unit 312 for the black cartridge, which are independently operable.

Figures 6, 6A:
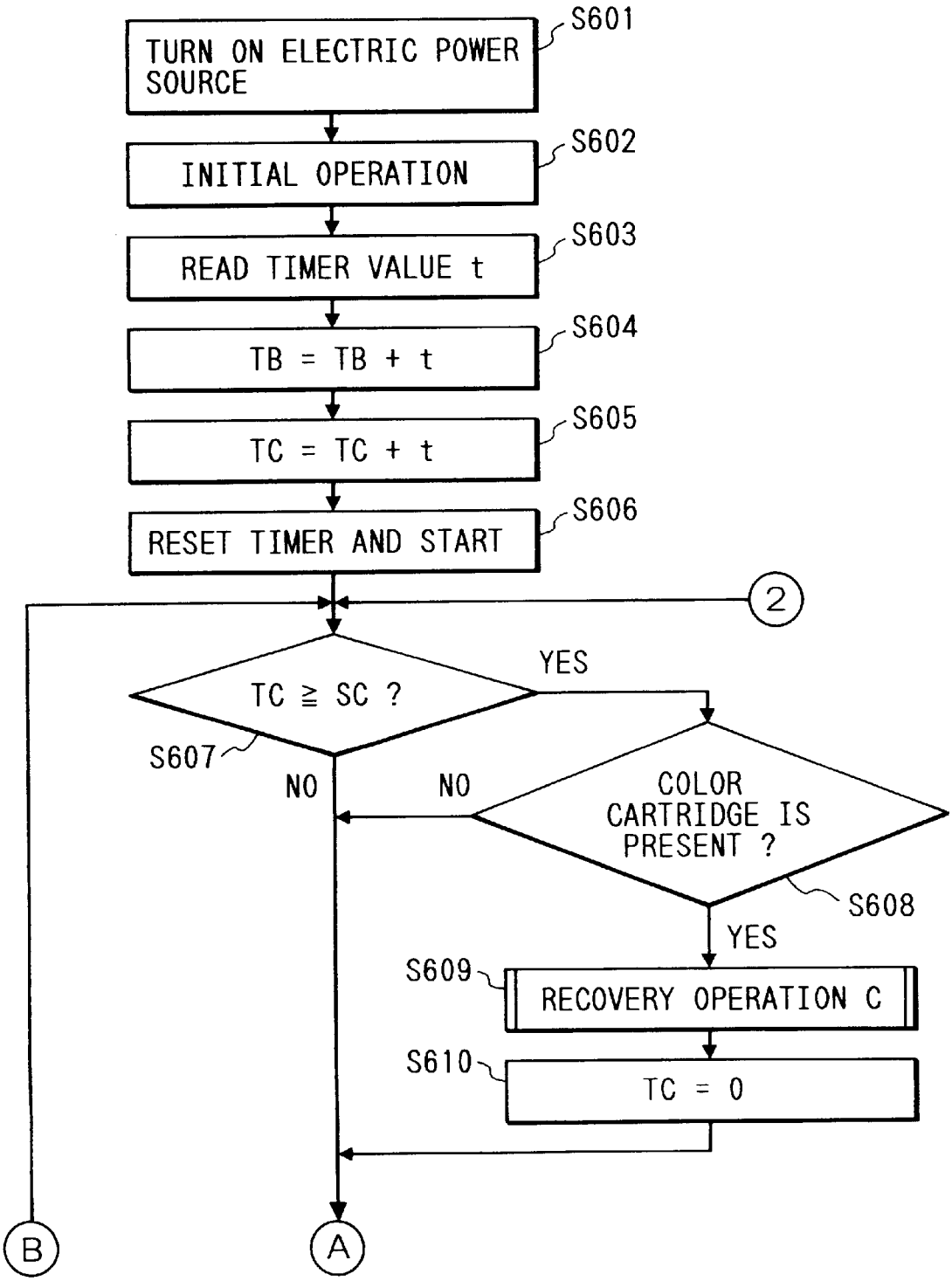
FIG. 6, which is comprised of FIGS. 6A and 6B, and FIG. 7 are flowcharts for explaining a process of a recovery operation in another example of this invention.
Figure 6B:
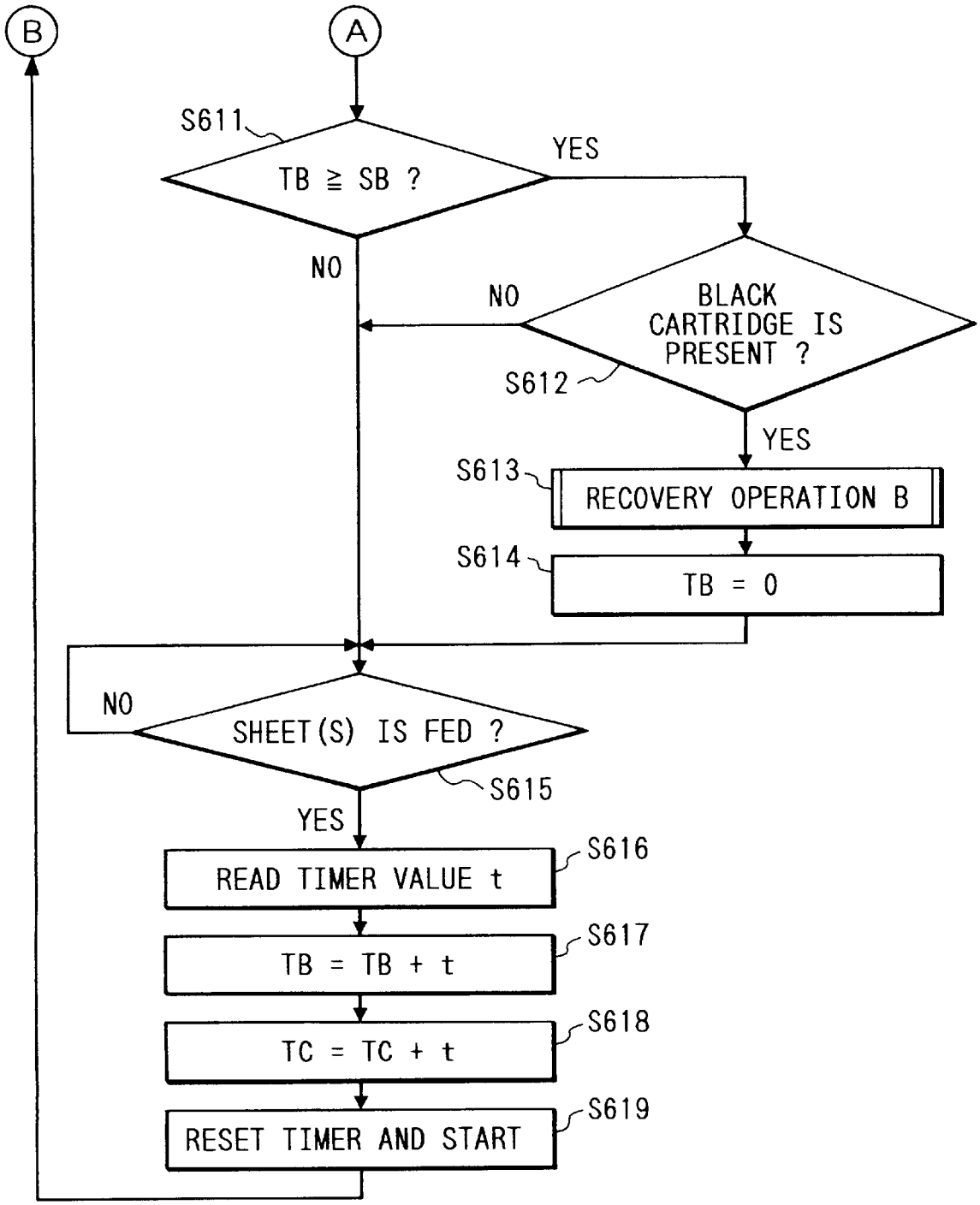
Figure 7:
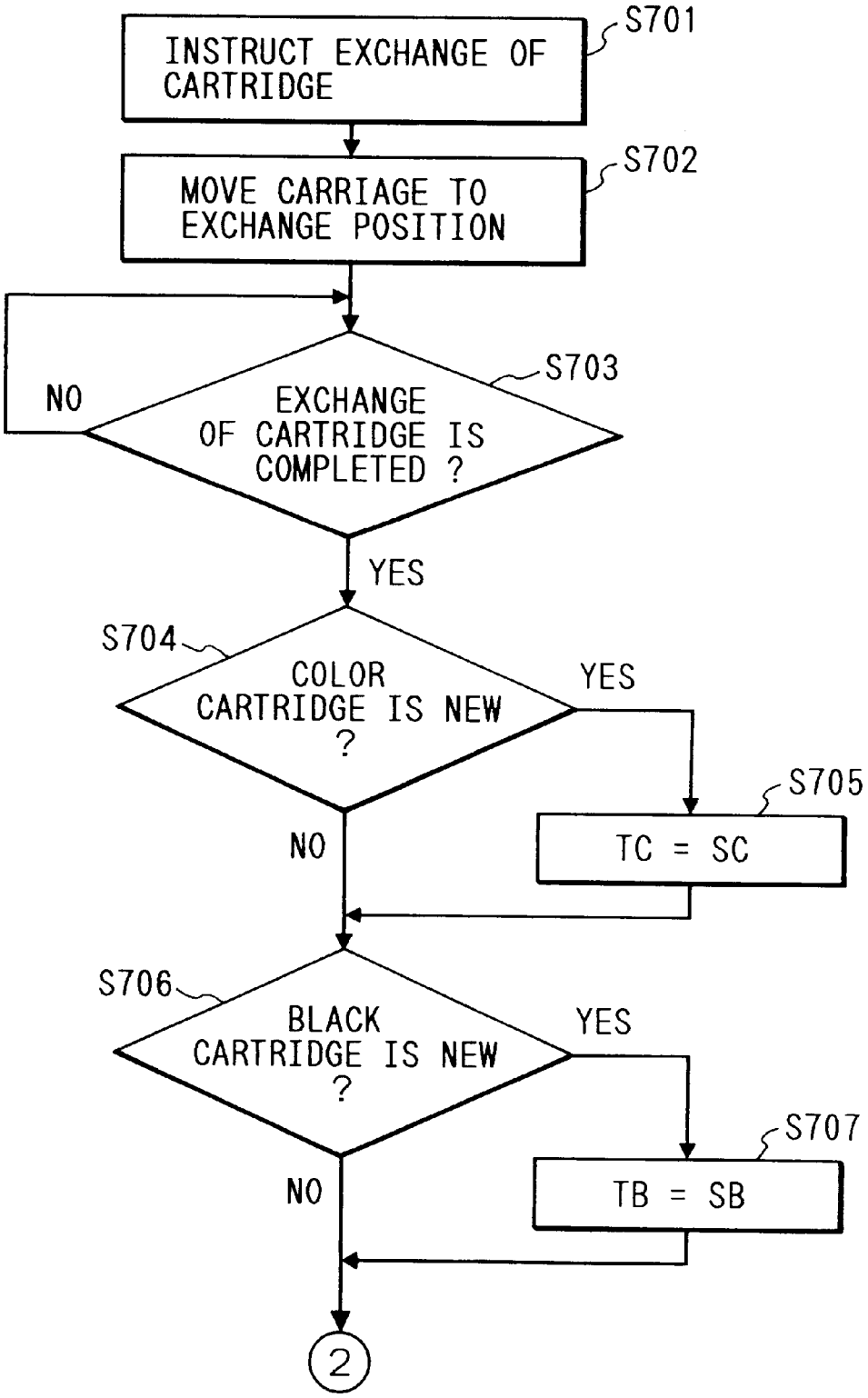

FIGS. 6A, 6B and 7 are flowcharts showing a processing procedure for the automatic recovery operation under the back-up timer control when the present invention is applied to such a twin cartridge recording apparatus.

First, a processing procedure when the power is turned on will be described below, based on FIGS. 6A and 6B.

The processing from step S601 to step S606 is the same as that from step S201 to step S206 as shown in FIG. 3A and previously described. The procedure proceeds from step S606 to step S607, where a comparison is made between a color cartridge timer count value TC within a non-volatile memory 107 and a color cartridge timer set value SC which is preset in a ROM 102. If TC≧SC, a determination is made at step S608 whether or not the color cartridge is present. If TC<SC at step S607 or if the color cartridge is not present at step S608, the procedure proceeds to step S611. If the color cartridge is present at step S608, the recovery operation C for the color cartridge is performed at step S609, the count value TC is reset (TC=0) at next step S610, and then the procedure proceeds to step S611.

At step S611, a comparison is made between a black cartridge timer count value TB within the non-volatile memory 107 and a black cartridge timer set value SB which is preset in the ROM 102. If TB≧SB, a determination is made at step S612 whether or not the black cartridge is present. If TC<SC at step S611 or if the black cartridge is not present at step S612, the procedure proceeds to step S615. If the black cartridge is present at step S612, the recovery operation B for the black cartridge is performed at step S613, the count value TB is reset (TB=0) at next step S614, and then the procedure proceeds to step S615.

The processing from step S615 to step S619 is the same as from step S212 to step S216 as shown in FIG. 3B and previously described. The procedure returns from step S619 to step S607.

With the above processing, the automatic recovery operation under the control of the back-up timer is performed for the color cartridge and the black cartridge mounted on the twin cartridge recording apparatus.

A processing procedure for exchanging the cartridge will be next described based on FIG. 7.

First, if there is an instruction for the exchange of a cartridge from the operation panel at step S701, the carriage is moved to a cartridge exchange position at step S702. Then, the procedure waits for an instruction that the exchange of a cartridge is completed at step S703. If the instruction that the exchange of the cartridge is completed is issued, the procedure proceeds to step S704, where a determination is made whether or not the color cartridge is new. If the color cartridge is new, the count value TC is set to the set value SC (TC=SC) at step S705, while if it is not new, then the procedure proceeds directly to step S706. A way of determining whether or not the cartridge is new may be effected automatically by the recording apparatus itself, based on the instruction from the operation panel or the information provided in the head, as in the first example as previously described.

At step S706, a determination is made whether or not the black cartridge is new. If the cartridge is new, the count value TB is set to the set value SB at a step S707 (TB=SB), while if it is not new, the procedure proceeds directly to step S607 in FIG. 6A.

By performing the above processing, the recovery operation is carried out when the cartridge is replaced with a new one, to assure the ink discharging stability, or for a plurality of cartridges in current use on the apparatus itself which may have been stored within the storage box, the proper automatic recovery operation occurs under the control of the back-up timer.

According to the above processing, even when using the color cartridge and the black cartridge together, the automatic recovery operation can be effected under the control of the back-up-timer for the respective cartridges, resulting in a recovery operation just enough, while preventing wasteful consumption of the ink.

In particular, when a plurality of cartridges for the recording are contained within the apparatus itself, like the twin cartridge recording apparatus, there is a more remarkable effect of reducing the ink consumption by the amount that the ink is considerably more consumed.

(Third example)

A third example of the present invention will be described below in detail with reference to the drawings.

In this example, an ink jet recording apparatus in which a recording head and an ink tank connected to the recording head for supplying the ink to the recording head are separable will be described below. The ink jet recording apparatus in this example has two kinds of heads, a color head for discharging the color ink to effect the color recording and a black head for discharging the black ink to effect the monochrome black recording, in the apparatus itself, wherein the ink tanks connected to respective heads can be independently exchanged. The ink jet recording apparatus using the ink tanks for supplying the ink to the heads exchangeably is hereinafter referred to as a "tank exchangeable recording apparatus".

Figure 8:
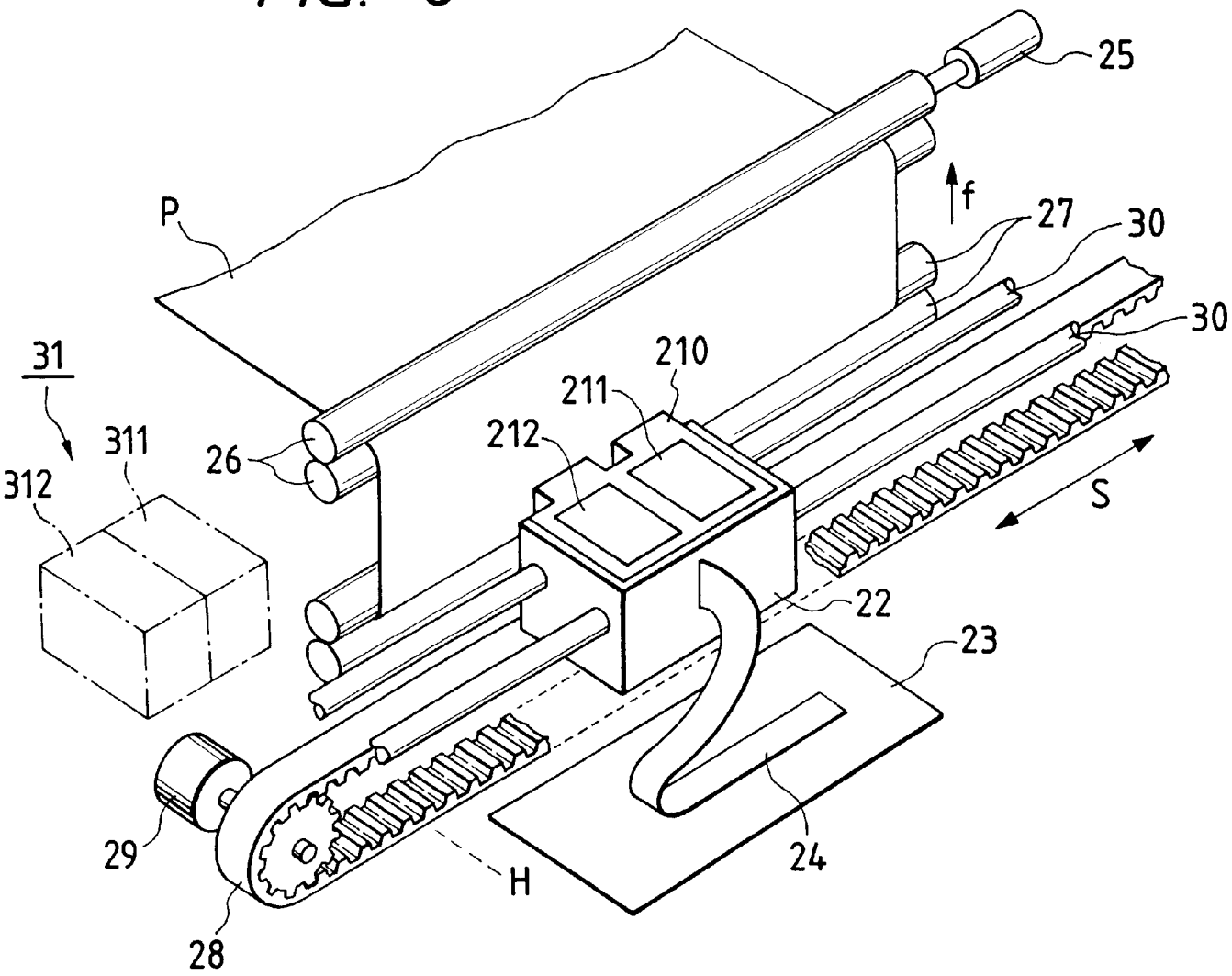

FIG. 8 is a perspective view showing the constitution of a main portion of the tank exchangeable recording apparatus. A recording head 210 has a color head as means for discharging the color recording ink and a black head as means for discharging the black recording ink, which are mounted on a carriage 22. A color ink tank 211 having color ink supply means and a black ink tank 212 having black ink supply means can be independently exchanged from the recording head 210. The constitution from 23 to 31 is the same as that of the twin carriage type recording apparatus as shown in FIG. 5 and previously described, and is no more described.

In such a tank exchangeable recording apparatus, the automatic recovery operation under the control of the back-up timer for the recording head within the cartridge as heretofore described is important, but in addition, care must be taken of the tank to be exchanged. This is due to the following reason. That is, a way of removing the unused ink tank, storing it within the storage box made for storing the ink tank, and remounting it to the head only for use is effective for suppressing the wasteful consumption of ink in the ink jet recording apparatus for which various automatic recovery operations are provided. However, for the ink tank removed from the head, it is apprehended that bubbles are produced and grown in the ink at the juncture to the head over time, resulting in an increased viscosity of the ink. Also, for the ink tank of the type containing a porous member such as a sponge to maintain a negative pressure within the ink tank, it is apprehended that the ink distribution within the ink tank may become coarse. When an ink tank, which has become in the above state with the elapse of a long time since it is removed from the ink jet recording apparatus and may have an adverse effect on the recording, is remounted on the head, the recovery operation may be requisite. However, if the recovery operation is made every time the ink tank is remounted, the ink may be wastefully consumed, and there is no meaning that the ink has been saved by removing the ink tank. Then, the automatic recovery operation under the control of the back-up timer is required also for the ink tank which is to be remounted.

A processing procedure of the automatic recovery operation under the control of the back-up timer only for the ink tank will be described below, but it is needless to say that the control regarding the head may be performed at the same time.

Figures 9, 9A:
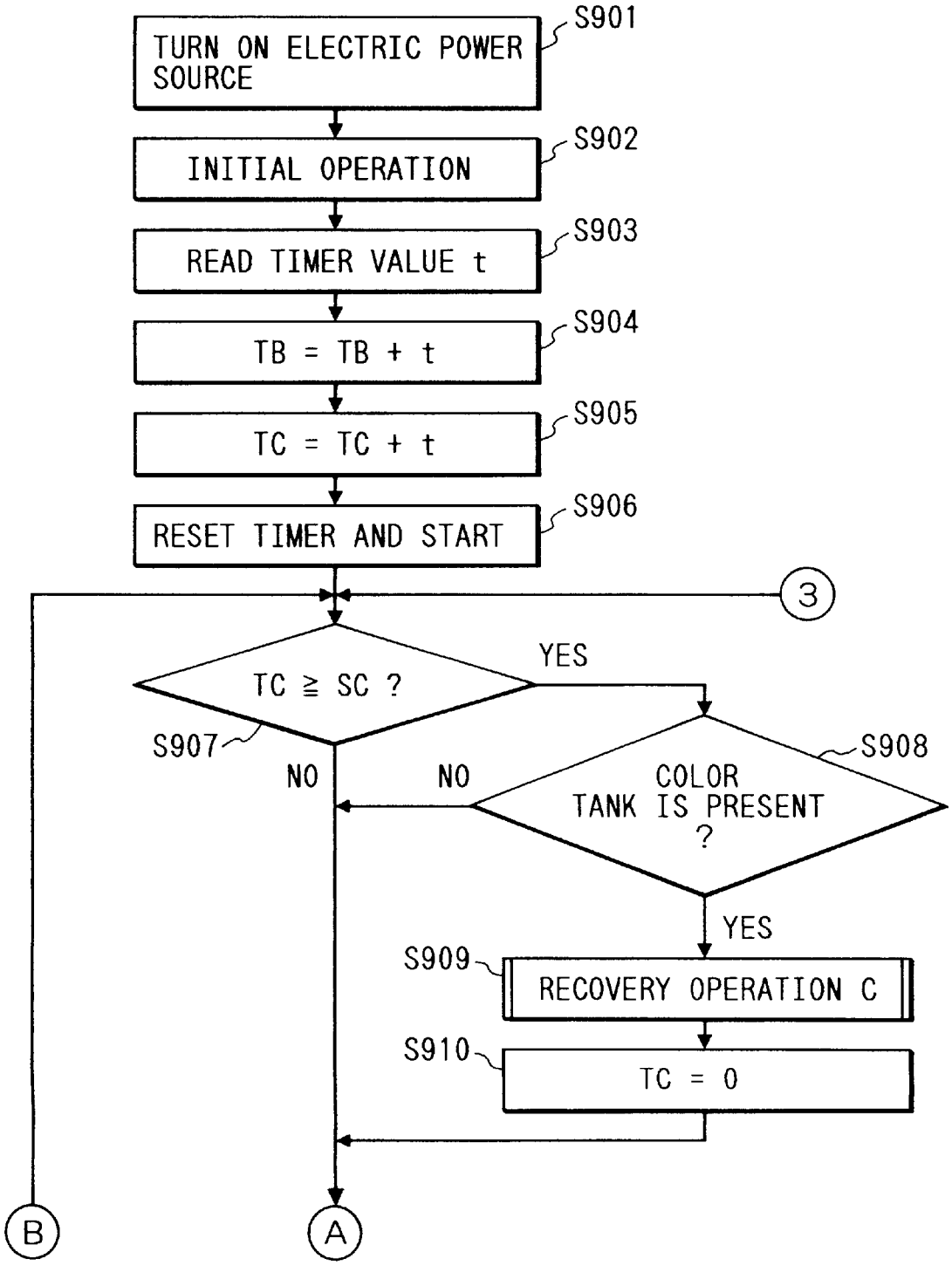
FIG. 9, which is comprised of FIGS. 9A and 9B, and FIG. 10 are flowcharts for explaining a process of a recovery operation in another example of this invention.
Figure 9B:
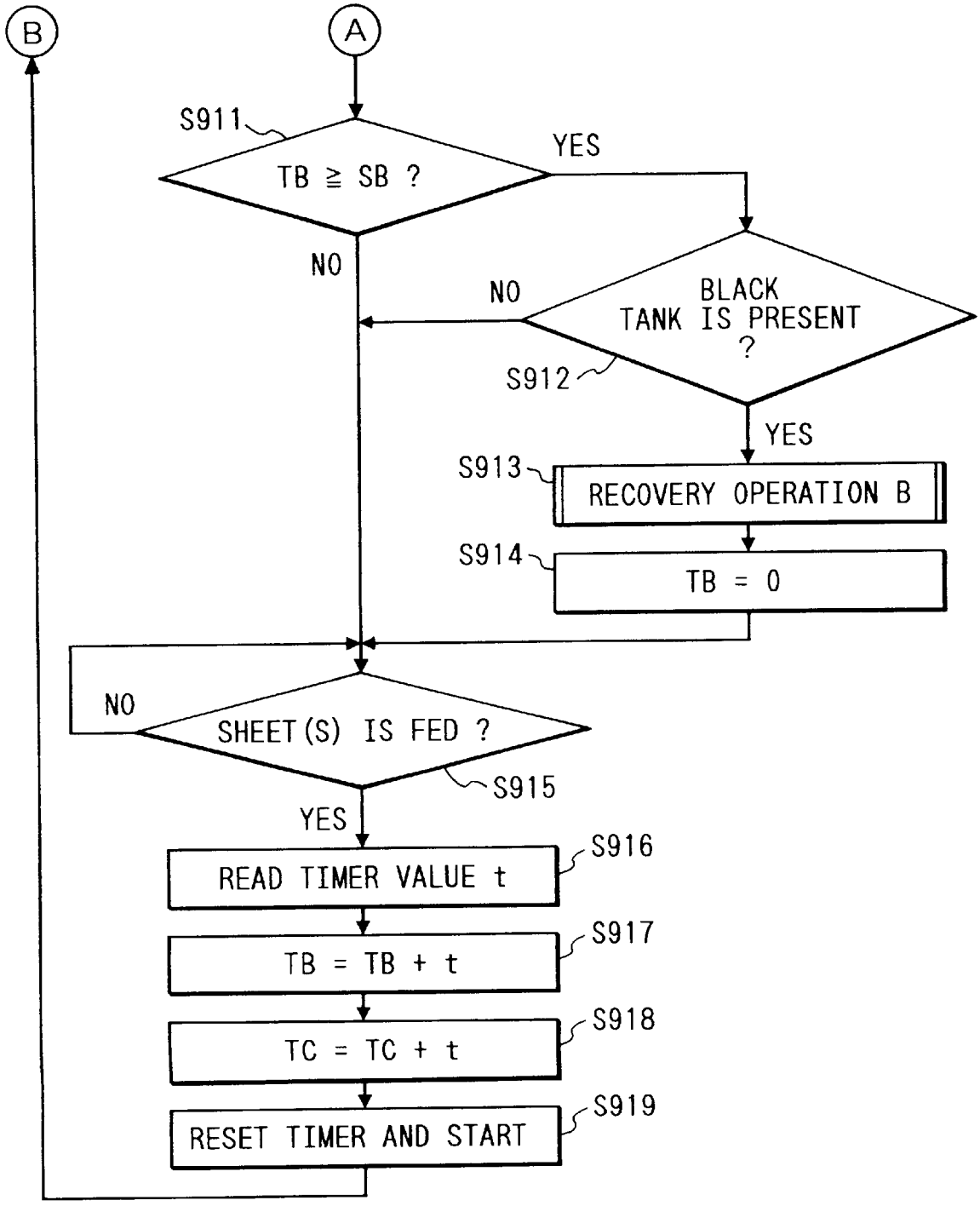
Figure 10:
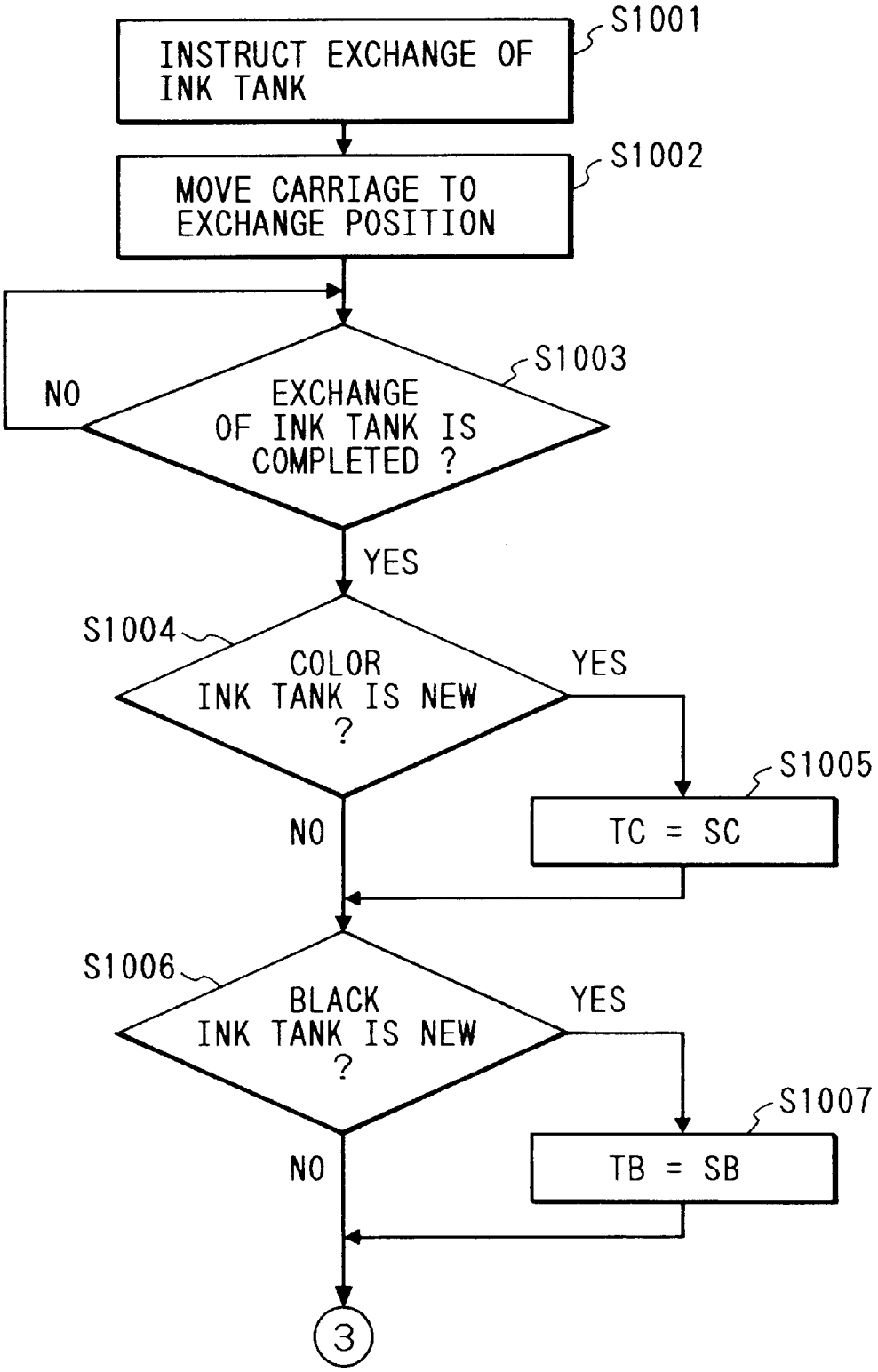

In FIGS. 9A, 9B and 10, the flowcharts for the processing procedure of the recovery operation are shown.

First, a processing procedure when the power is turned on will be described below, based on FIGS. 9A and 9B.

The processing from step S901 to step S906 is the same as that from step S201 to step S206 as shown in FIG. 3A and previously described. The procedure proceeds from step S906 to step S907, where a comparison is made between a color cartridge timer count value TC within a non-volatile memory 107 and a color cartridge timer set value SC which is preset in a ROM 102. If TC≧SC, a determination is made at step S908 whether or not the color ink tank is present. If TC<SC at step S907 or if the color ink tank is not present at step S908, the procedure proceeds to step S911. If the color ink tank is present at step S908, the recovery operation C for the color head is performed at step S909, the count value TC is reset (TC=0) at next step S910, and then the procedure proceeds to step S911.

At step S911, a comparison is made between a black cartridge timer count value TB within the non-volatile memory 107 and black cartridge timer set value SB which is preset in the ROM 102. If TB≧SB, a determination is made at step S912 whether or not the black ink tank is present. If TC<SC at step S911 or if the black ink tank is not present at step S912, the procedure proceeds to step S915. If the black ink tank is present at step S912, the recovery operation B for the black head is performed at step S913, the count value TB is reset (TB=0) at next step S914, and then the procedure proceeds to step S915.

The processing from step S915 to step S919 is the same as from step S212 to step S216 as shown in FIG. 3B and previously described. The procedure returns from step S919 to step S907.

With the above processing, the automatic recovery operation under the control of the back-up timer is performed for the color ink tank and the black ink tank which are mounted on the tank exchangeable recording apparatus.

A processing procedure in exchanging the ink tank will be now described based on FIG. 10.

First, if there is an instruction for the exchange of an ink tank from the operation panel at step S1001, the carriage is moved to an ink tank exchange position at step S1002. Then, the procedure waits for an instruction that the exchange of the ink tank is completed at step S1003. If the instruction that the exchange of the cartridge is completed is issued, the procedure proceeds to step S1004, where a determination is made whether or not the color ink tank is new. If the color ink tank is new, the count value TC is set to the set value SC (TC=SC) at step S1005, while if it is not new, then the procedure proceeds directly to step S1006. A way of determining whether or not the ink tank is new may be effected automatically by the recording apparatus itself, based on the instruction from the operation panel or the information provided in the ink tank, as in the first example as previously described.

At step S1006, a determination is made whether or not the black ink tank is new. If the ink tank is new, the count value TB is set to the set value SB at step S1007 (TB=SB), while if it is not new, the procedure proceeds directly to step S907 in FIG. 9A.

By performing the above processing, the recovery operation is performed when the ink tank is replaced with a new one, to assure the ink discharging stability, and for the ink tank which may have been stored within the storage box, the automatic recovery operation is performed under the control of the back-up timer.

According to the above processing, even when using the color ink tank and the black ink tank together, the automatic recovery operation can be carried out under the control of the back-up timer for the respective cartridges, resulting in a recovery operation just enough, while preventing wasteful consumption of the ink.

In particular, when a plurality of ink tanks for the recording are contained within the apparatus itself, like the tank exchangeable recording apparatus, there is a more remarkable effect of reducing the ink consumption by the amount that the ink is considerably more consumed.

While in the first to third examples two kinds of cartridges or ink tanks were provided, it should be understood that the present invention is also effective when only one kind or three or more kinds are used.

While in the above examples, the process of resetting and starting the timer was included, it should be understood that the timer count value may be determined by calculation, instead of by reset. In particular, a printer for an apparatus already having a timer such as a personal computer or a word processor can be fabricated at a lower cost and in a smaller size, because a new timer is unnecessary on the printer.

(Fourth example)

A fourth example of the present invention will be described below in detail with reference to the drawings.

Figure 11:
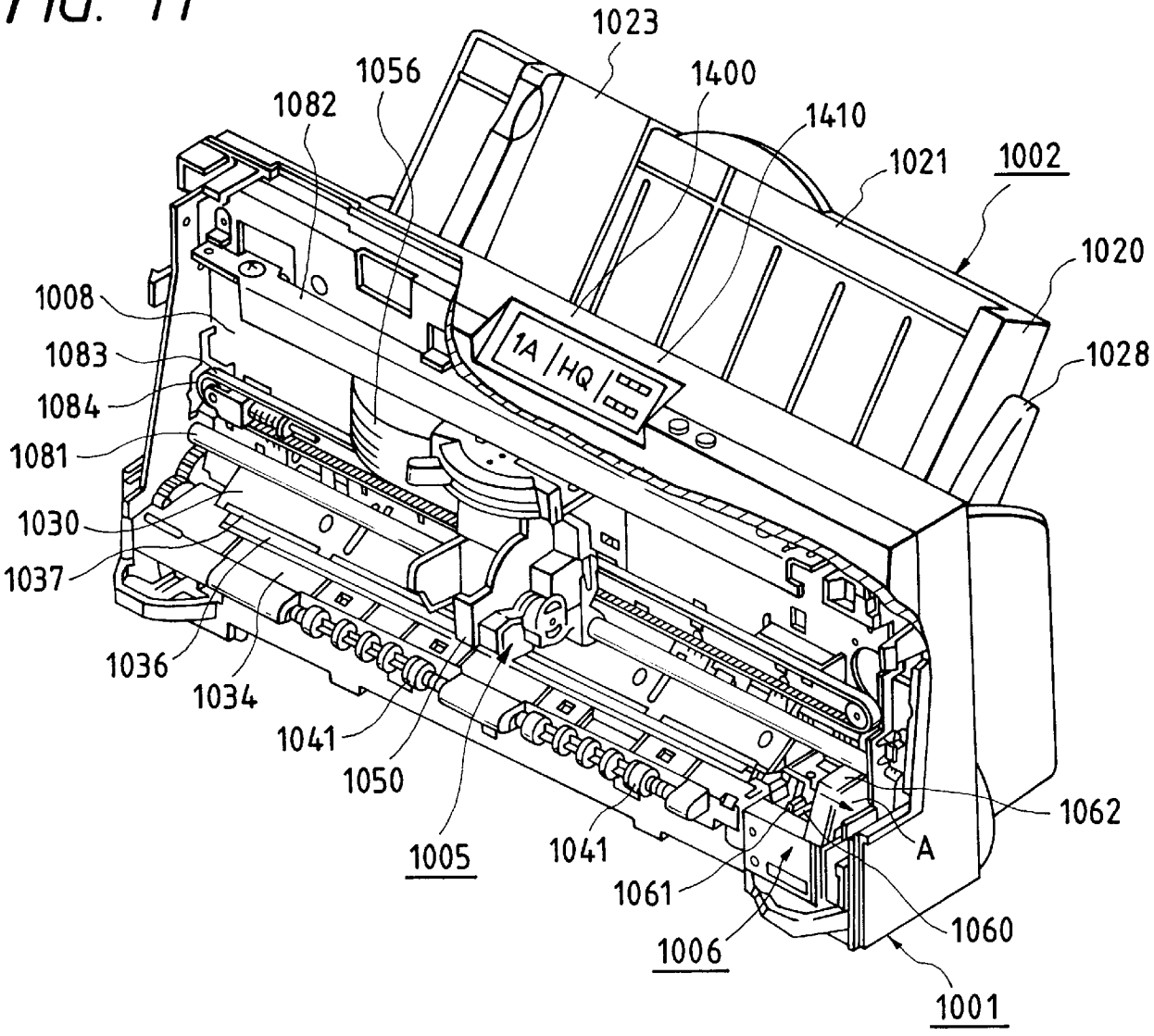
FIG. 11 is a perspective view showing an ink jet printer according to another example of the present invention.

FIG. 11 is a perspective view showing an ink jet printer according to the fourth example of the present invention, wherein for the clarity of the internal structure, an outer case is removed.

An ink jet printer 1001 is comprised of a paper supply portion 1002, paper feed portions (1030, 1034, 1036, 1037), a paper exhaust portion 1041, a cartridge portion 1005, and a cleaning portion 1006.

The paper supply portion 1002 is provided with a pressure plate 1021 movable with respect to a base 1020, whereby the sheets as the printing medium laid on the pressure plate 1021 can be pressed onto a paper supply roller, not shown, by a spring, not shown, to supply one sheet at a time. Herein, a guide 1023 is provided movable in accordance with the size of a sheet.

A sheet supplied from the paper supply portion 1002 is conveyed over the print area confronting an ink jet head attached to a cartridge 1005 with the rotation of the conveying roller 1036 caused by a driving force of a motor, not shown, while being pressed against a conveying roller 1036 with a pinch roller 1037 held by a pinch roller guide 1030. Also, the printed sheet is exhausted forwards out of the apparatus by a paper exhaust roller 1041.

A cartridge main body of the cartridge portion 1005 is provided with a contact portion for the electrical connection with the head when the ink jet cartridge is mounted. This electrical contact point is one end of a flexible cable 1056, the other end of cable 1056 being connected to an electrical substrate within a printer main body. The cartridge main body 1050 is engaged freely slidably with a guide shaft 1081, and can be moved by a driving force transmitted via a timing belt 1083. Thereby, the cartridge main body 1050 can be reciprocated along the guide shaft 1081 in the directions perpendicular to the sheet conveying direction (also referred to as a sub-scan direction). And during this movement, the ink is discharged from the head to print on the sheet.

The cleaning portion 1006 has a cap 1061 for covering the face where the discharge ports of the head attached to the cartridge main body 1050 are formed, and a pump 1062 for effecting the discharge recovery by sucking the ink from the discharge ports in the capping state with this cap 1061. Also, it is provided with a blade made of an elastic material for removing the dirt sticking to the discharge port face of the head or ink droplets. The material of blade 1060 is preferably urethane rubber or HNBR rubber which is not reactive with the ink and of non-hydrolysis to minimize damage on a facial plane of the head.

Figure 12A:
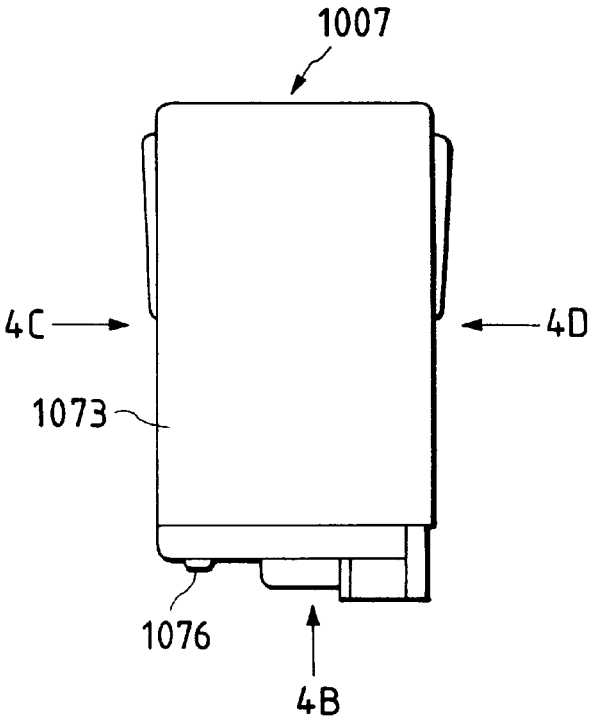
FIGS. 12A to 12D are an upper view, a front view and side views of a cartridge for the black ink to be used in the printer of an ink jet system.
Figure 12B:
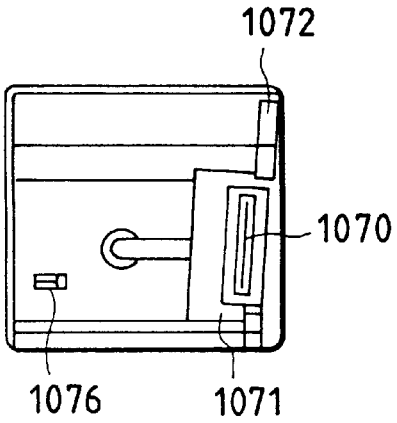
Figure 12C:
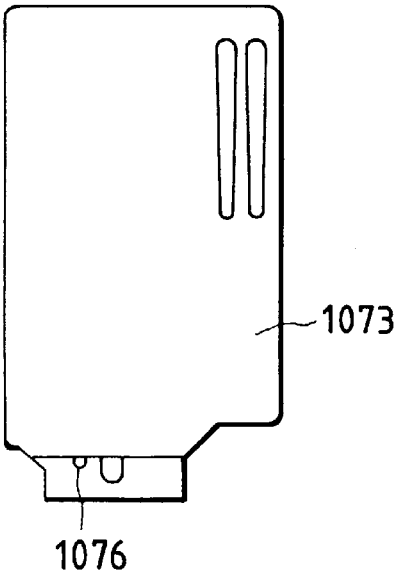
Figure 12D:
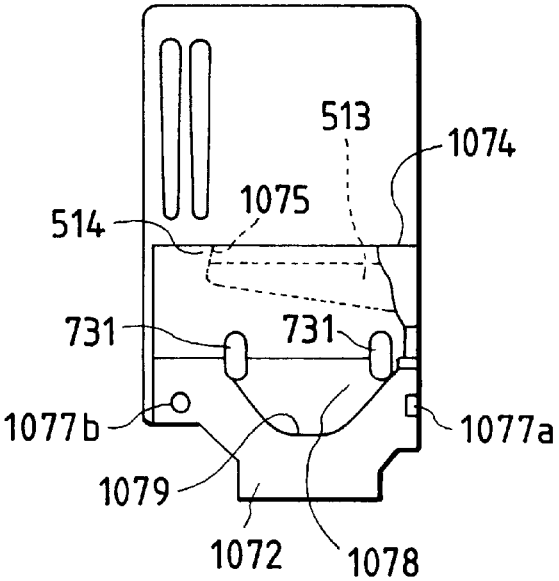

FIGS. 12A, 12B, 12C and 12D are views showing the appearance of an ink jet cartridge of black (Bk) ink (hereinafter simply referred to as a Bk cartridge) for use with the printer as shown in FIG. 11, wherein FIG. 12A is a rear view, FIG. 12B is a front view as viewed from a direction of the arrow 4B in FIG. 12A, and FIGS. 12C and 12D are side views as viewed from the directions of the arrow 4C and the arrow 4D in FIG. 12A, respectively.

The Bk cartridge 1007 has a head portion 1071 and an ink tank 1073 integrally formed, and is detachably mounted on the cartridge 1050. A heater is provided in each ink passageway of the head portion 1071, thereby heating the ink to produce a bubble in the ink, and discharge the ink from a discharge port 1070 which is an open end of the ink passageway owing to a pressure change caused by growth or shrinkage of this bubble.

The head portion 1071 has specifically 128 discharge parts, the ink discharge amount from each discharge port being about 90 ng (1 ng=$1\times10^{-9}$ g) per ink droplet. Also, the driving frequency for discharging is 6 kHz. The composition of the ink is listed in Table 1 below, from the viewpoint of effecting excellent printing on plain paper, but is not particularly limited thereto.

TABLE 1

| Composition example of Bk ink | |
|---|---|
| Bk dye | 3 parts |
| Glyceline | 5 parts |
| Ethylene glycol | 5 parts |
| Urea | 5 parts |
| Isopropyl alcohol | 3 parts |
| Water | remainder |
| pH regulator | slight amount |

Figure 13:
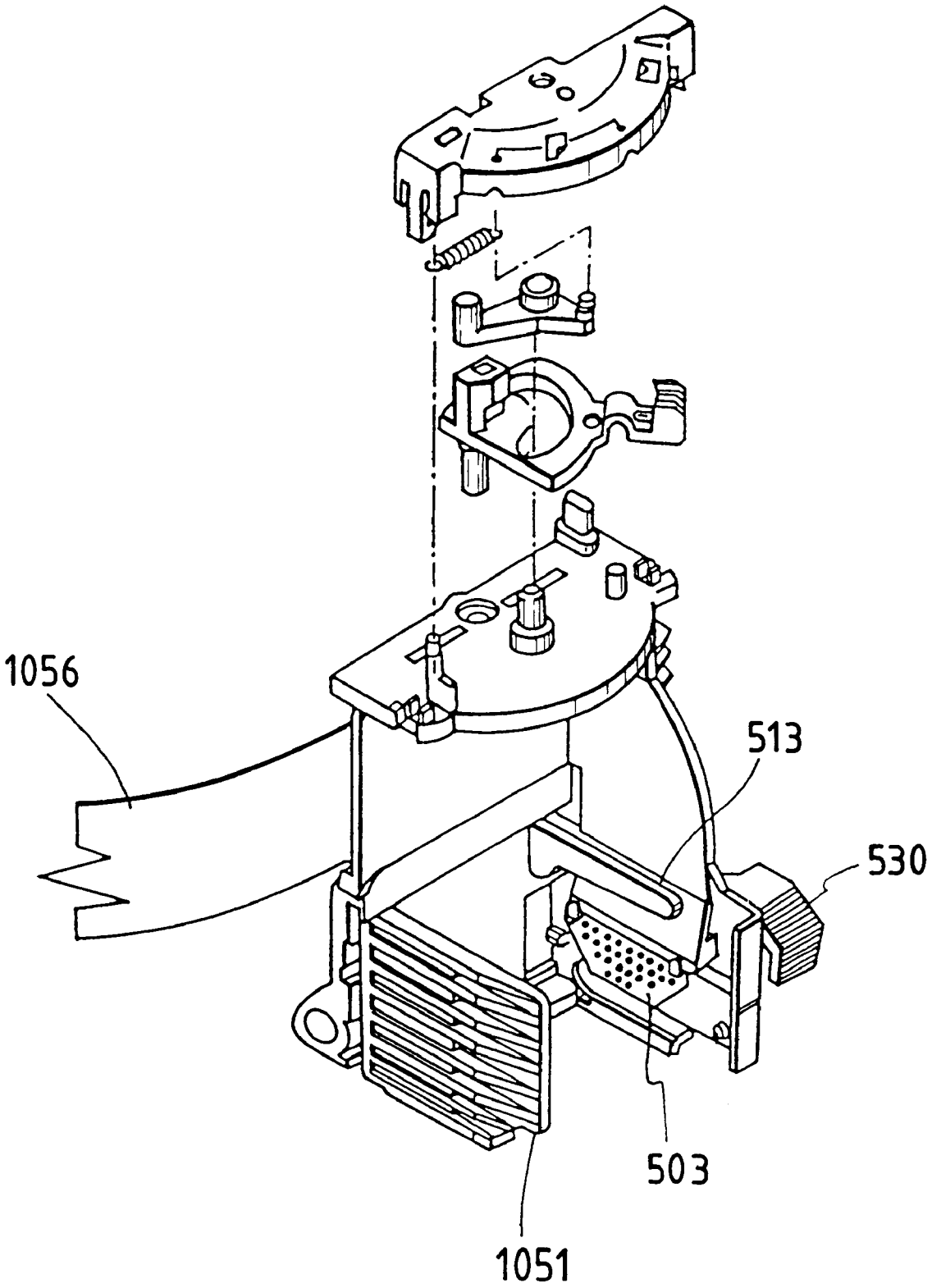
FIG. 13 is an exploded perspective view showing the constitution of a carriage portion of the above printer.
Figure 14:
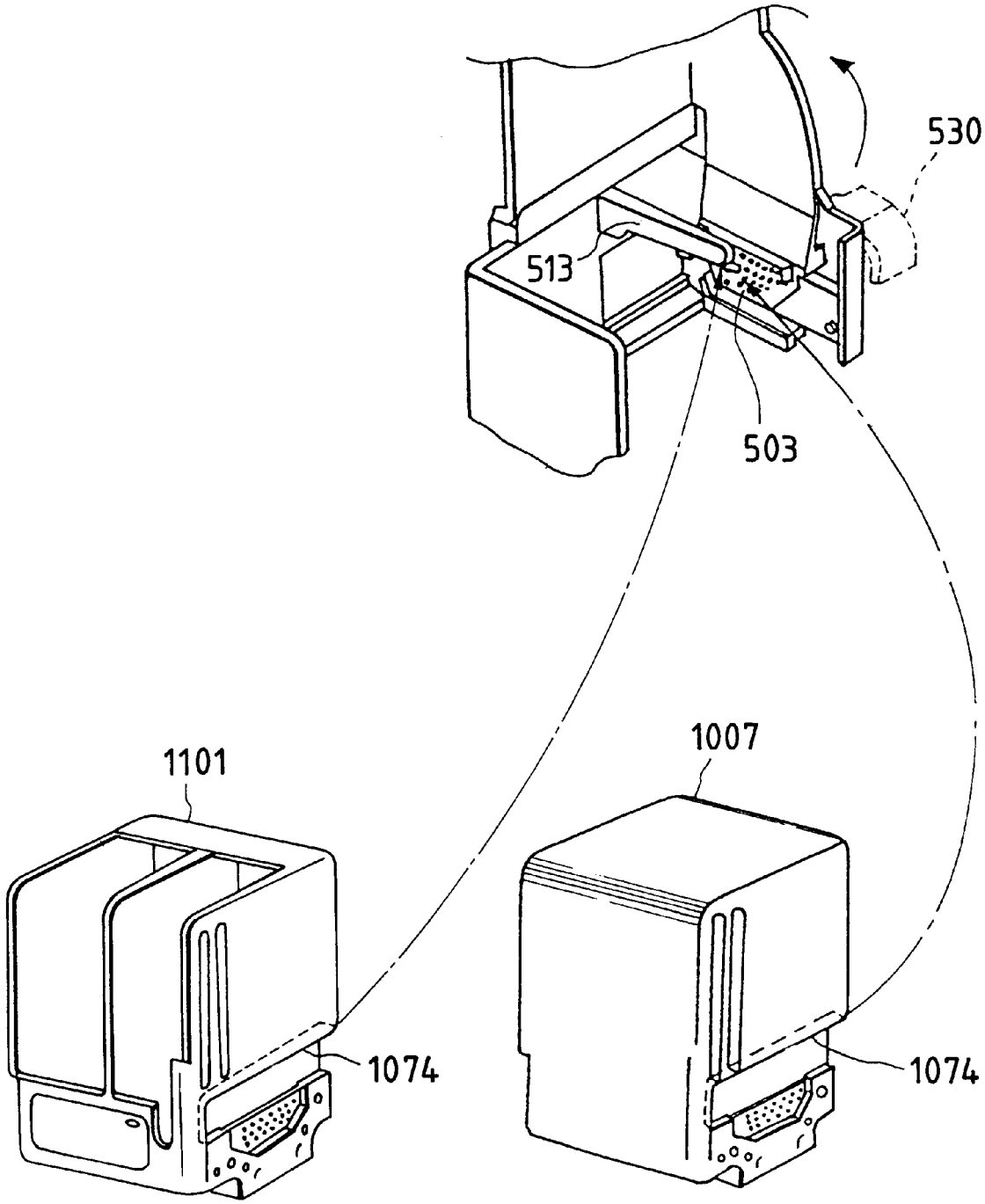
FIG. 14 is an explanatory view showing how to mount a Bk cartridge or a color cartridge on the above carriage.

FIG. 13 is an exploded perspective view particularly for explaining the constitution of cartridge portion 1005. FIG. 14 shows the mounting state of the Bk cartridge 1007 or the color cartridge 1101, as hereinafter described, to the carriage portion 1005.

When the Bk cartridge 1007 or the color cartridge 1101 is mounted on the carriage portion 1005, an electrical connector on the carriage side makes connection with an electrical contact portion 503 of the cartridge portion 1005, with a respective guide 1074 engaging a guide arm 513 of the cartridge portion 1005.

FIGS. 15A to 15E show schematically the color cartridge 1101 (hereinafter referred to as a color cartridge) which can be used like the Bk cartridge in the apparatus as shown in FIG. 11.

The cartridge 1101 comprises a discharge head portion having the discharge ports corresponding to respective inks of black (Bk), cyan (C), magenta (M) and yellow (Y), and an ink tank portion.

Figure 15C:
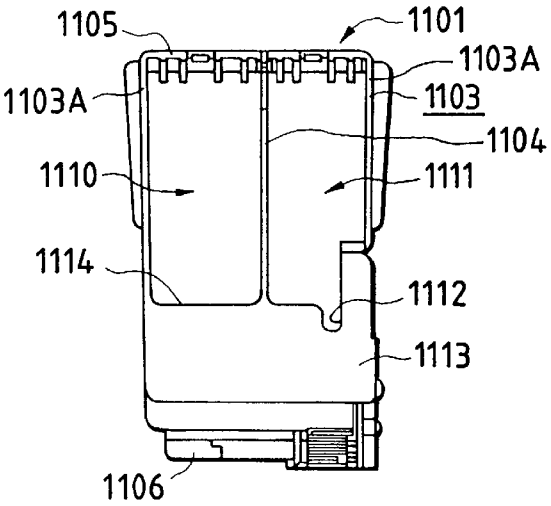
FIGS. 15A to 15E are a side view, a cross-sectional view, an upper view, a front view and a bottom view for the above color cartridge.

The cartridge 1101 is provided with the ink tank mounting portions 1110 and 1111. These mounting portions are formed of a housing 1103 consisting of a pair of side plates 1103A and a rear plate 1103 connecting the pair of side plates for the color head 1101, a front plate 1113, and an intermediate plate 1104 for dividing a space surrounded by them into two regions, the divided spaces being a color ink tank mounting portion 1110 comprised of three tank portions C, M, Y and a black ink tank mounting portion 1111, as shown in FIGS. 15A, 15B and 15C.

In this way, each ink tank is detachably mounted on each ink tank mounting portion 1110, 1111. The ink is supplied from each ink tank through an ink delivery tube 1107 to the head portion 1120. 1107C is an ink delivery tube corresponding to the ink of cyan, and 1117Y is an ink delivery tube corresponding to yellow ink. The ink delivery tubes 1107M, 1107B corresponding to the magenta and black inks are shown. Also, the head portion 1120 is provided with the arrays of discharge ports 1120Y, 1120M, 1120C, 1120Bk corresponding to the respective inks.

Figure 15E:
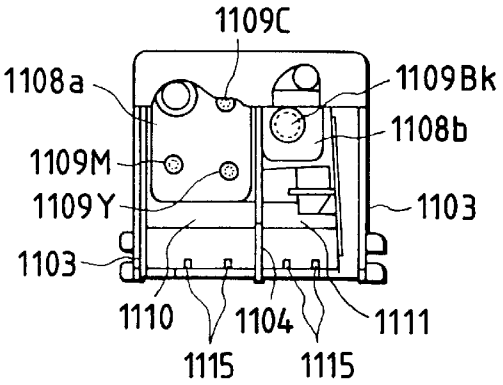
Figure 15B:
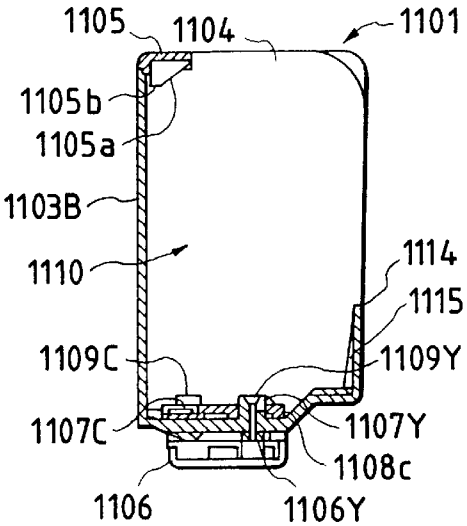
Figure 15D:
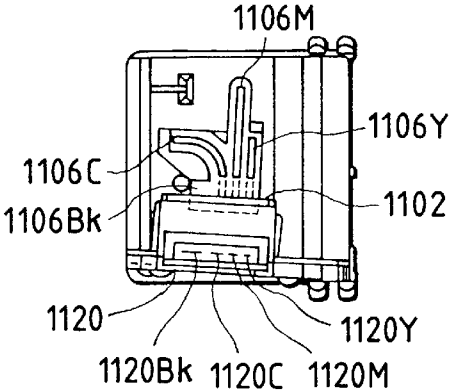
Figure 15A:
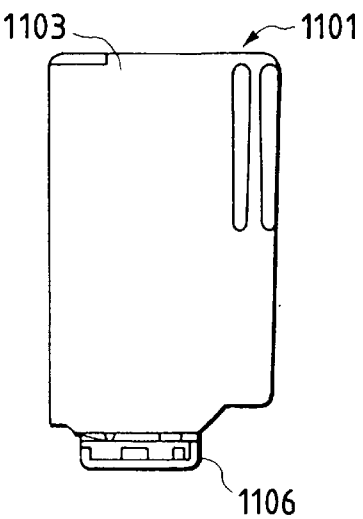

Downwards in FIGS. 11 and 15A to 15E, there are seen the discharge ports for discharging the ink from within each ink tank. Also, the ink delivery tubes 1107C, 1107Y (1107M, 1107Bk not shown) are provided for supplying the ink to the head portion 1120 having the discharge ports 1120Bk, 1120C, 1120M and 1120Y. The ink delivery tubes 1107 extend out a predetermined length from the bottom of the mounting portions 1110 and 1111 so that they can be inserted into the ink tank. In a tank side opening portion of each ink delivery tube 1107 is provided a filter 1109, as shown in FIG. 15B. 1109C, 1109Y are filters corresponding to cyan and yellow, respectively. Filters corresponding to magenta and black inks (1109M, 1109Bk) are not shown.

The ink is led through ink supply tubes 1106Y, 1106M, 1106C, 1106Bk provided on the bottom of the cartridge from the delivery tubes 1107 to the head portion 1120, as shown in FIG. 15D. Also, on the surface where the delivery tubes 1107 of the tank mounting portion are disposed, there are provided resilient plates 1108*a*, 1108*b* having a predetermined thickness around the delivery tubes 1107, as shown in FIGS. 15B and 15E. Each of the resilient plates 1108*a*, 1108*b* is pressed against a rib provided around an ink supply opening of each ink tank to prevent leakage of the ink into the inside of the head portion.

As shown in FIG. 15C, a cut-out portion 1112 is provided at a position facing the mounting portion 1111 of the front plate 1113. A rib provided in the black ink tank for storing the black ink can be inserted into this cut-out portion, whereby it is possible to avoid any false mounting by preventing insertion of the color ink tanks for storing the three color inks of yellow, magenta and cyan, as will described later.

Figure 16A:
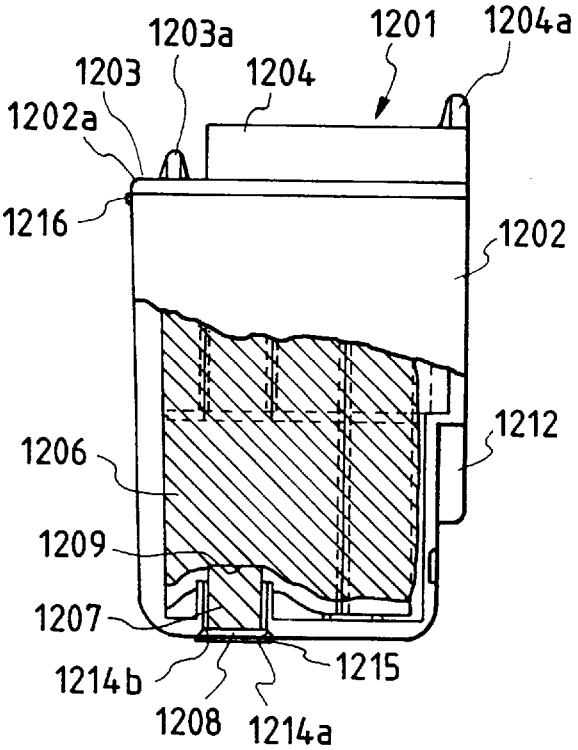
FIGS. 16A to 16D are an upper cross-sectional view, a side view, a bottom view and an upper cross-sectional view of a color ink tank for the color cartridge.
Figure 16B:
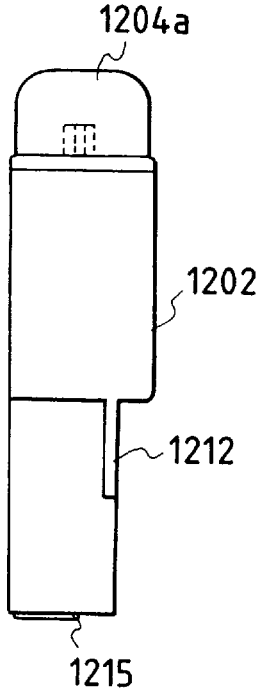
Figure 16C:
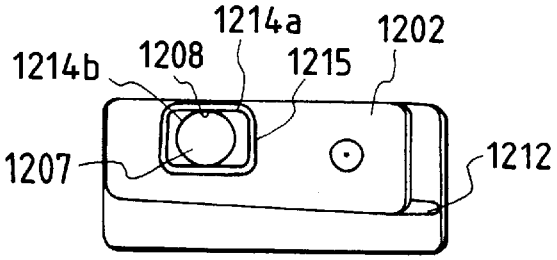
Figure 16D:
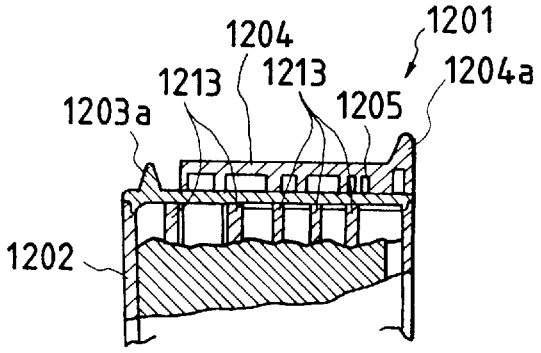

FIGS. 16A, 16B, 16C and 16D show the schematic constitution of a Bk ink tank 1201 for storing the black ink, wherein FIG. 16A is a side view, partially broken away, showing a part of the tank, FIG. 16B is a front view, FIG. 16C is a bottom view, and FIG. 16D is an upper side cross-sectional view.

In the figure, 1202 is a housing constituting a structural member of the ink tank, and 1203 is a lid member with an atmosphere communicating opening 1205. 1204 is an upper member having a gripper portion 1204*a* for use in mounting or dismounting the tank. And, on the bottom of the ink tank, there are provided an ink supply opening 1208 into which a delivery tube 1107 (for the Bk ink) is inserted, a rib 1215 extending outwardly therearound, and slant portions 1214*a* and 1214*b* for the connection between the ink supply opening 1208 and the rib 1215.

Also, in a part of the side surface where the gripper portion 1204*a* of the ink tank is provided, there is provided a rib 1212, this rib 1212 engaging a cut-out portion 1112 provided in the front plate 1113 of the cartridge 1101 in mounting the ink tank 1201, and serving as a guide for mounting the tank. Besides, this is used to prevent false mounting of the ink tank as above described. 1206 is an ink storing member, which is a porous material made of urethane. 1207 is an ink delivery member which is formed of a fiber bundle member. 1209 is a support member for supporting the ink delivery member 1207 within the tank.

FIGS. 17A, 17B, 17C and 17D are schematic constitutional views for explaining a color ink tank.

The color ink tank 1321 storing the inks of yellow (Y), magenta (M), and cyan (C) is comprised, as a piece, of individual ink tank portions for storing the inks. Its principal constitution is the same as that of the black ink tank 1201 as shown in FIGS. 16A to 16D and described.

The color ink tank 1321 is partitioned inside the ink storing housing 1322 by the partition members 1336 and 1337 of a T-character shape. In this way, the amount of storing the ink within each ink tank partitioned is designed to be substantially equal.

That is, the ink tank 1321 has the ink storing housing 1322, a lid member 1323 covering the housing 1322 and having the atmosphere communicating opening 1325Y (1325M, 1325C not shown), and a space which is a buffer chamber attached above the lid member 1323 and serving to prevent ink leakage through each atmosphere communicating opening 1325 outside, as well as having one atmosphere opening port at a different position from that of each atmosphere communicating opening 1325 and an upper member 1324 with a gripper portion 1324*a* for use in mounting or dismounting the color cartridge 1101 on or from the main body. Herein, 1325Y is an atmosphere communicating opening corresponding to the ink chamber for storing the yellow ink, the atmosphere communicating openings 1325M, 1325C corresponding to the ink chambers for storing the magenta and cyan inks being not shown in FIGS. 17A to 17D.

Figure 17A:
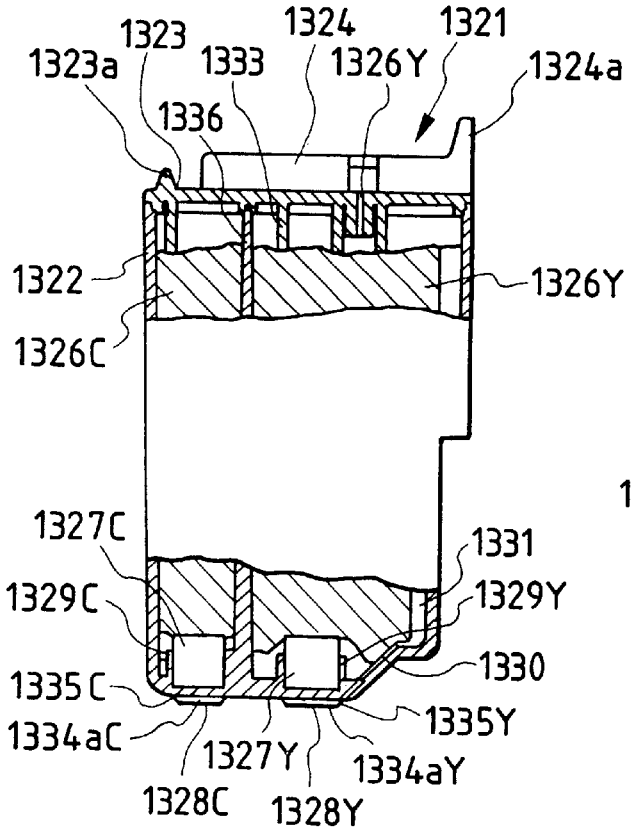
FIGS. 17A to 17D are an upper cross-sectional view, a side view, a bottom view and an upper view of a color ink tank for the color cartridge.
Figure 17B:
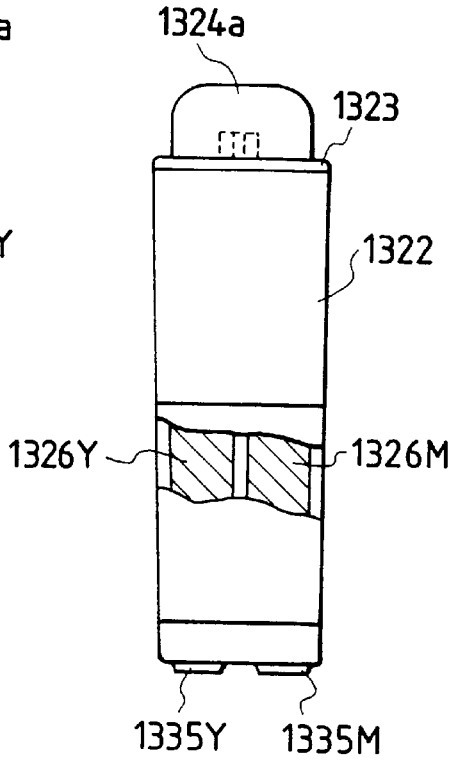
Figure 17C:
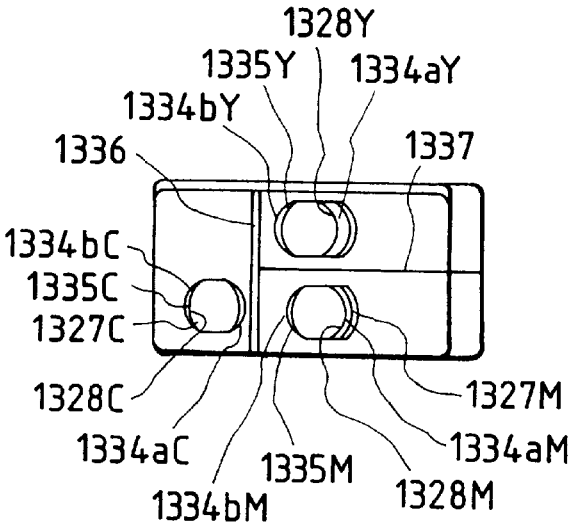
Figure 17D:
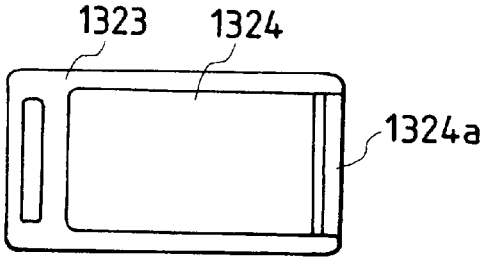

And on the bottom of the ink tank are provided the ink supply openings 1328Y, 1328M, 1328C into which the delivery tubes 1107Y, 1107M, 1107C for the color cartridge 1101 are inserted, respectively, the ribs 1335Y, 1335M, 1335C extending outwardly therearound, and the slant portions 1334*a*Y, 1334*a*M, 1334*a*C for the connection between the ink supply openings 1328Y, 1328M, 1328C and the ribs 1335Y, 1335M, 1335C, respectively, as shown in FIG. 17C.

The ink tank 1321 has the slant portions formed, inclined at a slight angle, so that the ink supply openings 1328Y, 1328M, 1328C may not abut against the top end of delivery tubes 1107 to obstruct smooth mounting, when mounting the ink tank on the color cartridge 1101 with the rotational motion.

The ink storing members 1326Y, 1326M, 1326C are accommodated within the ink tank 1321. Also, the ink delivery members 1327Y, 1327M, 1327C are provided between the ink storing members 1326Y, 1326M, 1326C and the ink supply openings 1328Y, 1328M, 1328C, respectively. And a slit for communication between the inside and the outside of the ink tank is provided on the inner surface of the support member 1329Y, 1329M, 1329C for supporting the ink delivery member 1327Y, 1327M, 1327C within the tank.

The composition of the ink is one in which, for the black ink, the print quality is superior on the so-called plain paper typically utilized, with the higher density of characters such as text and the good sense of distinction; also, for the color ink, the image at the interface between adjacent inks is less likely to blur.

The composition example of each color ink is listed below in Table 2.

TABLE 2

| | |
|---|---|
| <Yellow ink> | |
| Yellow dye | 2 parts |
| Thiodiglycol | 7 parts |
| Glyceline | 7 parts |
| Urea | 7 parts |
| Surface active agent | 1 part |
| pH regulator | slight amount |
| Water | remainder |
| <Cyan ink> | |
| Cyan dye | 4 parts |
| Thiodiglycol | 7 parts |
| Glyceline | 7 parts |
| Urea | 7 parts |
| Surface active agent | 1 part |
| pH regulator | slight amount |
| Water | remainder |
| <Magenta ink> | |
| Magenta dye | 3 parts |

TABLE 2-continued

| | |
|---|---|
| Thiodiglycol | 7 parts |
| Glyceline | 7 parts |
| Urea | 7 parts |
| Surface active agent | 1 part |
| pH regulator | slight amount |
| Water | remainder |

The head portion of the color cartridge 101 has black ink discharge ports 1120Bk and color ink discharge ports 1120C, 1120M, 1120Y arranged linearly, as shown in FIG. 15D. Specifically, 64 discharge ports are provided corresponding to the black ink, and form a discharge port group, the discharge amount of the ink droplet being about 70 ng/dot. Also, the color head portion has a discharge port group, which consists of 24 discharge ports for each of yellow, magenta and cyan, the discharge amount being about 40 ng/dot. Also, the spacing between each discharge port group for the color ink is equal to a distance as long as a pitch of about 8 discharge ports. The head drive frequency for the discharge is 6 kHz, as with the head portion of the Bk head cartridge 1007.

Figure 18:
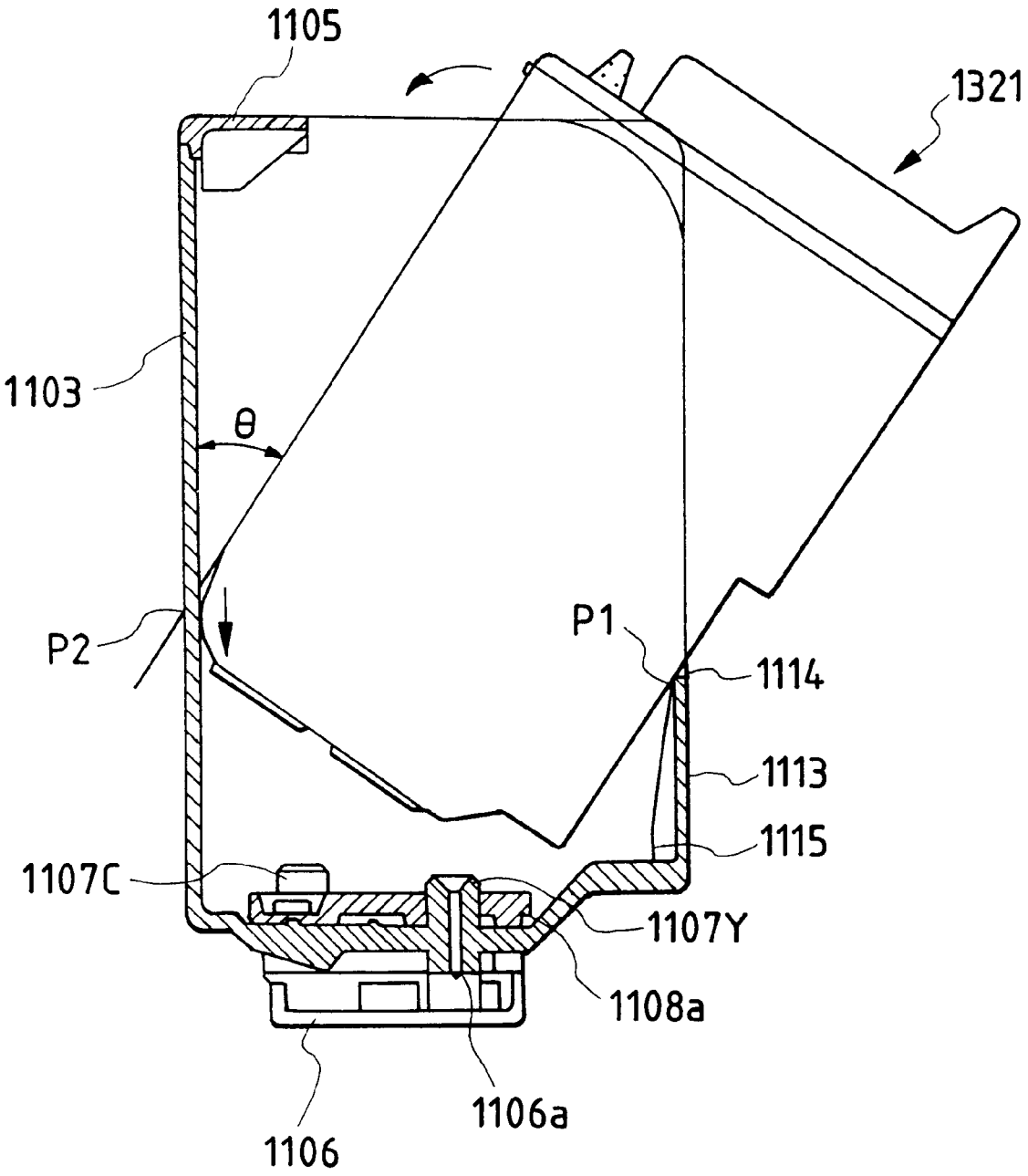
FIG. 18 is a view for explaining how to mount an ink tank on the color cartridge itself.

FIG. 18 is a view showing how the color ink tank 1321 is rotatably mounted on the upper portion 1114 of the front plate 1113 for the ink jet unit 1101, using a part of the housing as the guide. Also, FIGS. 19A1, 19A2 and 19B1, 19B2 show how the tank exchange operation is performed on the printer main body. Further, FIGS. 20A1, 20A2 and 20B are schematic views showing the exchange operation of the entirety of each cartridge containing the head portion. In this way, the printer of this example permits an exchange of the Bk cartridge 1007 and the color cartridge 1101.

As above described, in this example, the black cartridge 1007 and the color cartridge 1101 can be exchanged on the main body at will, whereas the type of the head to be mounted on each head cartridge 1007, 1101 is detected on the side of the printer, and the proper detection of the ink remaining and the remaining indication are made based on this detection, as explained below.

Figures 21, 21A:
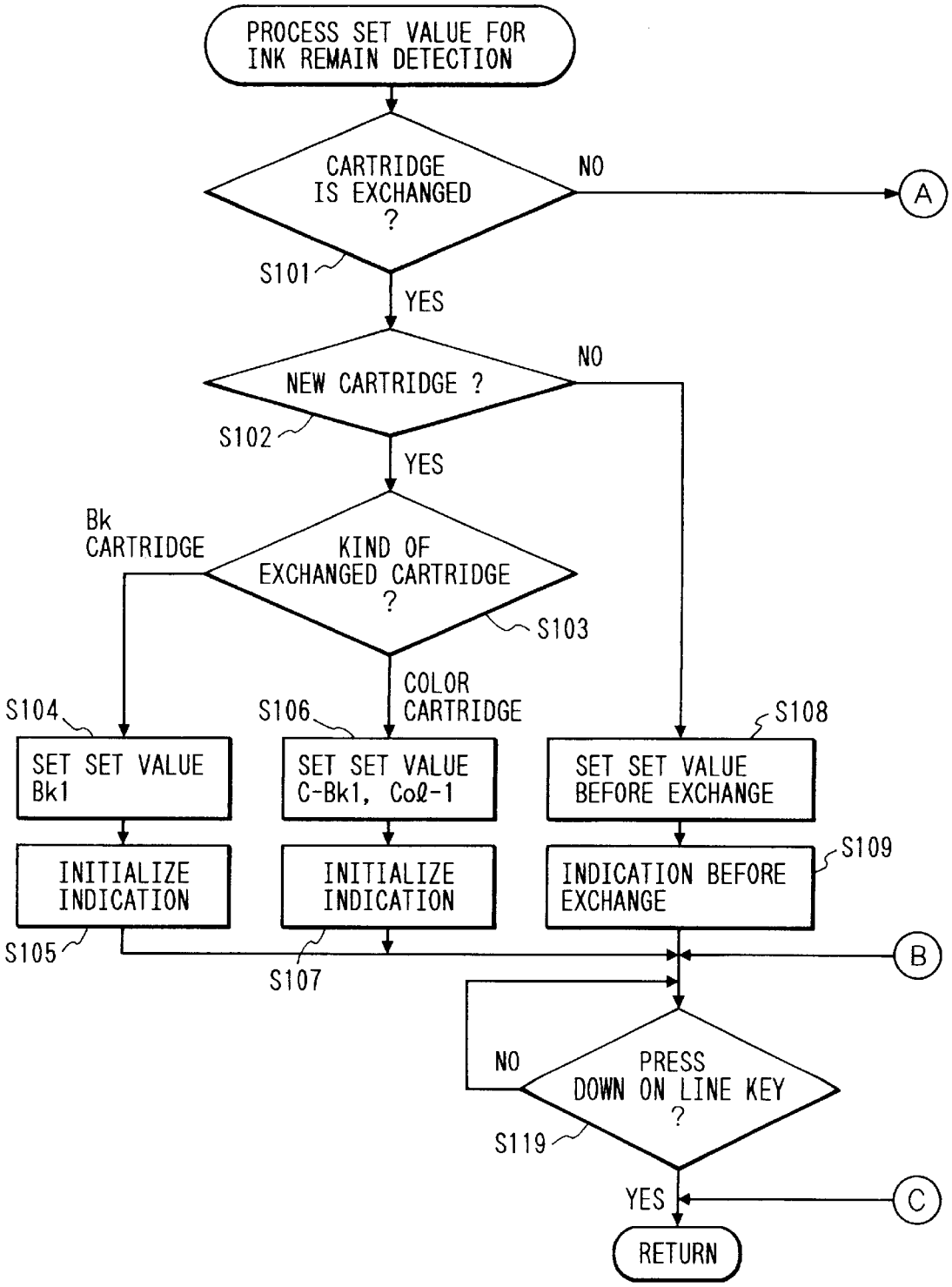
FIG. 21, which is comprised of FIGS. 21A and 21B, is a flowchart showing a procedure for ink remaining detection setting value processing according to this example of the present invention.
Figure 21B:
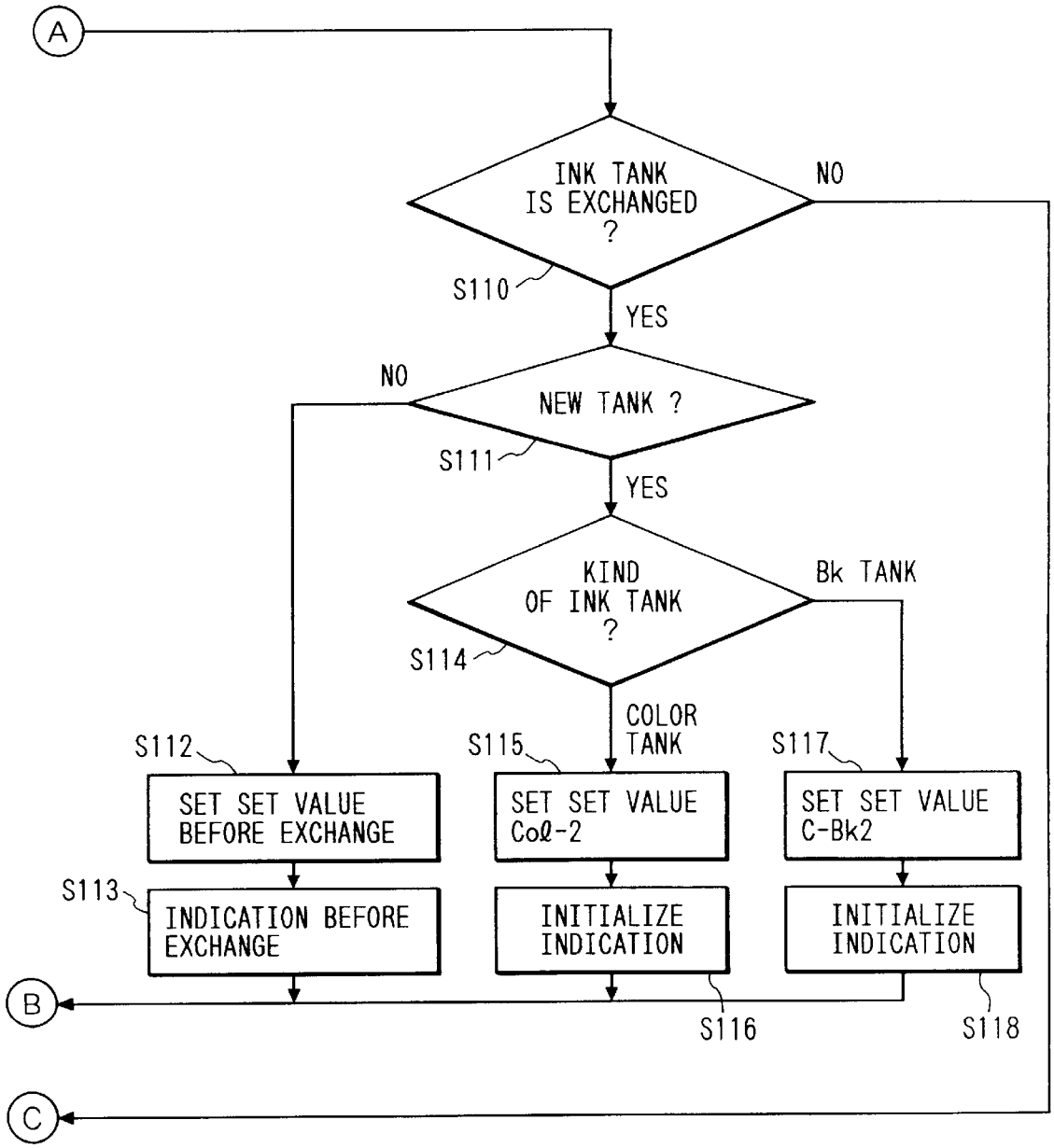

FIGS. 21A and 21B are flowcharts showing a procedure for setting the set value which is an initial value for the ink remaining detection for each head or an ink tank to be mounted for the proper ink remaining detection.

This processing procedure is initiated when an operation of moving the cartridge 1005 to the central portion of the apparatus by operating a predefined key for the exchange of the cartridge in the printer and then moving the cartridge 1005 to the home position is performed, as shown in FIG. 11.

If the processing is initiated, a determination is made whether or not the Bk cartridge 1007 (see FIGS. 12A to 12D) or the color cartridge 1101 (see FIGS. 15A to 15E) having a head and tank integrally formed is exchanged at step S101. This determination can be effected by providing a circuit of detecting the current value at that time, for example, when the cartridge is removed from the cartridge 1005.

If it is determined that the cartridge is exchanged at step S101, a determination is made at step S102 whether or not the cartridge is a new cartridge. If it is new, the kind of the new cartridge is subsequently determined at step S103. These determinations at steps S102 and S103 can be made based on the information read from an ID circuit indicating the intrinsic information for each cartridge provided at the electrical connection of each cartridge. This ID circuit may be any known circuit, for example, a combination of a plurality of resistors. Also, a way of determining the kind of cartridge is not limited to the ID circuit indicating the intrinsic information for each cartridge, but may be made by varying the position or number of signal lines electrically connected to the main apparatus, depending on the kind of cartridge, and sending a signal from the main apparatus side.

If the moving cartridge is determined to be a Bk cartridge at step S103, the set value of the memory is updated to Bk1 at step S104. The content of this set value will be described later. Then, the initial indication regarding the remaining indication of the ink tank appears at step S105, and after the above set value is confirmed by the user depressing an on-line key at step S119, this processing procedure is ended.

At step S103, if the color cartridge 101 is replaced with a new one, the set values C-Bk1, Col-1 are set as in the above manner, and the remaining indication is initialized at steps S106 and S107.

Also, if the cartridge is not new at step S102, the set value regarding the cartridge before an exchange is not updated at step S108, and the ink remaining data is read from the memory and indicated at step S109.

If it is determined that the ink tank is only exchanged and the exchanged ink tank is new at steps S110 and S111, the kind of exchanged tank is determined at step S114. If the exchanged tank is a color tank with this determination, the set value Col-2 is set at step S112, and the remaining indication is initialized at step S116. If the Bk tank is exchanged for a new one, the procedure proceeds to step S117, where the set value C-Bk2 is set.

It should be noted that the determination of only the ink tank at step S110 can be effected by guessing that only the tank has been exchanged if the cartridge is not exchanged at step S101 although this processing procedure has been initiated, or can be made by the user performing the key input operation. Also, the determination of whether or not the ink tank is new at step S111 can be effected, based on whether or not the user has depressed the reset key.

If the detection for the exchange of the tank is made based on whether or not the user depresses the reset key, the mechanism for detecting the exchange of the tank can be simplified, resulting in a lower cost.

Figure 23:
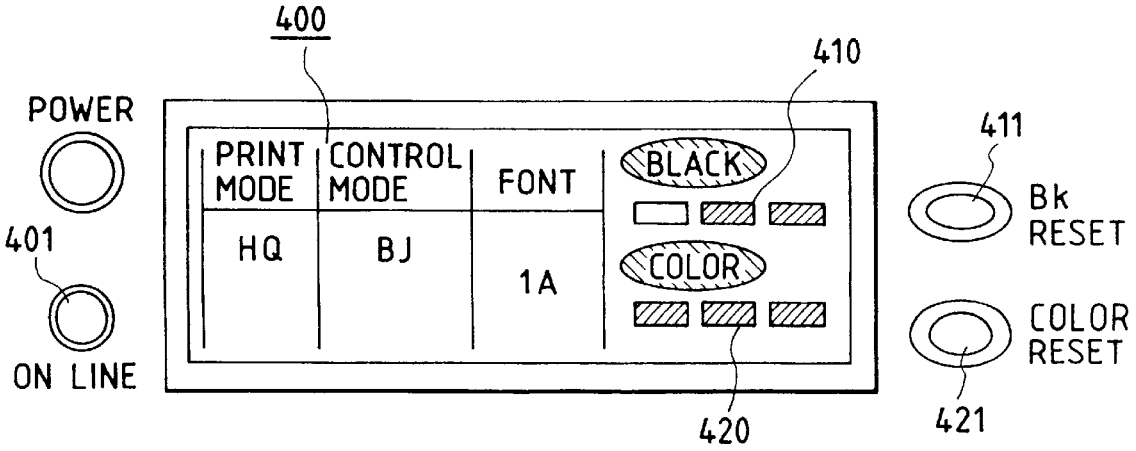
FIG. 23 is a typical view illustrating the ink remaining indication for the black ink tank and the color ink tank when the color cartridge is mounted.

In the color cartridge 1101, the color tank 1321 and the Bk ink tank 1201 can be independently exchanged. Therefore, by providing the reset keys 411, 421 corresponding to respective cartridges for the color ink tank 1321 and the Bk ink tank 1201, as shown in FIG. 23, the main apparatus can determine which tank has been exchanged. Herein, if the Bk cartridge 1007 is mounted, it is possible to detect that the cartridge has been exchanged for a new Bk cartridge 1007 by depressing a Bk reset key 411.

That is, the number of reset keys can be decreased by properly using the Bk reset key, based on a result of determining which of the Bk cartridge 1007 and the color cartridge 1101 is mounted.

The remaining indication or the set value in the above processing will be described below.

Figure 22:
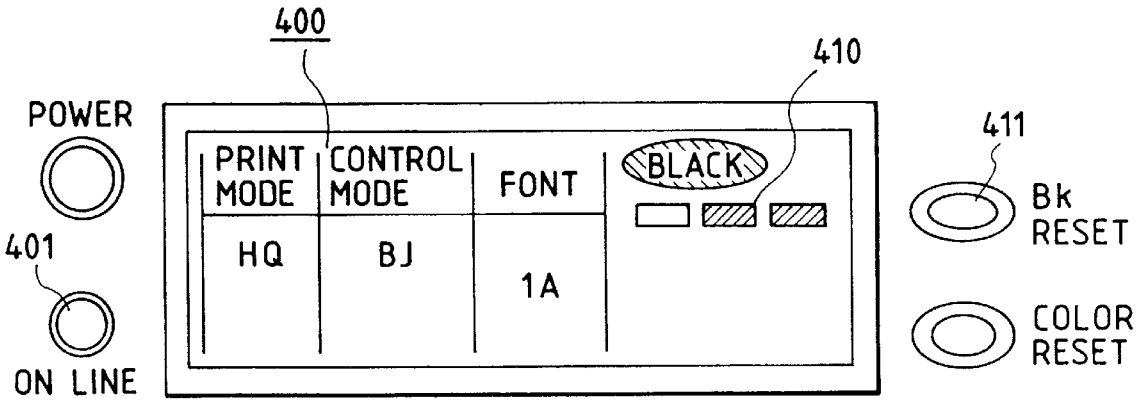
FIG. 22 is a typical view illustrating the ink remaining indication when the monochrome cartridge is mounted.

FIG. 22 is a view showing the ink remaining indication on an LCD 400 as shown in FIG. 11.

In the figure, 401 is a switch key between the on-line and off-line, and 410 is a bar graph representing the remaining Bk ink. Also, a reset key for the user to perform the reset operation after the exchange of the tank is provided adjacent to the LCD 400. If the Bk cartridge 7 is mounted, the first indication as described below is only made (step S105 in FIG. 21A), and the indication of color is not made. Also, by depressing the reset key 411, the bar graph 410 becomes an initial set state, and by depressing the on-line key 401, the setting can be confirmed.

<Display regarding the set value Bk1 of Bk cartridge>

The apparatus of this example can display the following four states with respect to the set value Bk1 of the Bk cartridge by controlling the display of bar graph 410 for the LCD 400.

First indication: Lights three bar graphs at the time of detecting a new article (step S102 as shown in FIG. 21A) or reset operation.

Second indication: Lights two bar graphs when the set value A1 is reached.

Third indication: Lights one bar graph when the set value A2 is reached.

Fourth indication: Flashes one bar graph when the set value A3 is reached.

It should be noted that the count value concerning the dot count remaining is written and managed in a non-volatile memory provided in the printer. The update of the count value in this memory occurs at every predetermined time during the printing, at every predetermined print line, at every page, when the recovery operation is performed, or when the power is turned off, but is not limited thereto. Or the count value may be temporarily stored in a RAM within the printer main body, and written in the non-volatile memory at every page or at a predetermined timing when the power is turned off.

When the color cartridge 1101 is replaced with a new cartridge (step S102 as shown in FIG. 21A), the set values are set individually for the Bk and the color, because the color cartridge is of an exchangeable structure in which the head portion for discharging the ink and the ink tank can be mounted or dismounted separately, as previously described, that is, the head portion and the ink tank integrated can be individually mounted or dismounted, with the ink tank separable into the Bk ink tank 1201 and the color ink tank 1321 consisting of three color inks Y, M, C, as previously described.

That is, when a new cartridge 1101 is mounted on the printer, C-Bk1 is set for the Bk and Col-1 is set for the color as the ink remaining detection set value (step S106). And the ink remaining information of "Bk" and "color" is displayed with separate three-stage bar graphs on the LCD 400 (step S107).

FIG. 23 shows this ink remaining display.

When the color head 1101 is detected to be mounted, the bar graphs for the Bk tank and the color tank are indicated. 410 on the LCD is an ink remaining indication of a Bk tank corresponding to the color head, and 420 is an ink remaining indication of the color tank. Adjacent to these bar graphs of indication, a reset key 411 for the Bk ink and a reset key 421 for the color ink are provided. By depressing a respective key, the initial setting is made, and by depressing an on-line key later, the setting is confirmed.

<Display regarding the Bk ink set value C-Bk1 of color head>

The apparatus of this example can display the following four states with respect to the set value CBk1 of Bk ink for the color head by controlling the display of bar graph 410 on the LCD 400.

First indication: Lights three bar graphs at the time of detecting a new head (cartridge) or reset operation.

Second indication: Lights two bar graphs when the set value C-A1 is reached.

Third indication: Lights one bar graph when the set value C-A2 is reached.

Fourth indication: Flashes one bar graph when the set value C-A3 is reached.

<Display regarding the color ink set value Col-1 of color cartridge>

The apparatus of this example can display the following four states with respect to the set value Col-1 of the color ink, when the color cartridge is mounted, by controlling the display of bar graph 410 on the LCD 400.

First indication: Lights three bar graphs at the time of detecting a new head (cartridge) or reset operation.

Second indication: Lights two bar graphs when the set value C-C1 is reached.

Third indication: Lights one bar graph when the set value C-C2 is reached.

Fourth indication: Flashes one bar graph when the set value C-C3 is reached.

As the set value in exchanging only the ink tank in the cartridge but not the head (cartridge), the Col-2 or C-Bk2 is set at step S115 or step S117.

<Display regarding the Bk ink set value C-Bk2 of color cartridge>

The apparatus of this example can display the following four states with respect to the set value C-Bk2 of black ink, when the color cartridge is mounted, by controlling the display of bar graph 410 on the LCD 400.

First indication: Lights three bar graphs at the time of detecting a new article tank or reset operation.

Second indication: Lights two bar graphs when the set value C-A4 is reached.

Third indication: Lights one bar graph when the set value C-A5 is reached.

Fourth indication: Flashes one bar graph when the set value C-A6 is reached.

<Display regarding the color ink set value Col-2 of color cartridge>

The apparatus of this example can display the following four states with respect to the set value Col-2 of the color ink, when the color cartridge is mounted, by controlling the display of bar graph 410 on the LCD 400.

First indication: Lights three bar graphs at the time of detecting a new article tank or reset operation.

Second indication: Lights two bar graphs when the set value C-C4 is reached.

Third indication: Lights one bar graph when the set value C-C5 is reached.

Fourth indication: Flashes one bar graph when the set value C-C6 is reached.

As above described, in the printer of this example, the amount of ink discharged during the printing and the amount of ink consumed by the recovery operation are counted, and for switching the remaining indication based on that count value, five set values of Bk1, C-Bk1, Col-1, C-Bk2, Col-2 are provided, based on the conditions such as the discharge amount, and the respective setting memories are provided.

As a result, even though the cartridge is mounted or dismounted, the Bk head (cartridge) and the color head (cartridge) can be individually recognized, and the respective ink remaining can be individually managed. Also, since the information of a cartridge mounted before the exchange can be memorized, the previous display information has been memorized as one of the above set values, when the cartridge mounted before the exchange is mounted again, so that information can be displayed on the LCD. Also, since the count value itself also has been memorized in the non-volatile memory, the ink remaining detection can be appropriately continued.

In this example, the ink discharge amount during the printing can be maintained constant by providing control for applying appropriate pulses, corresponding to the heat accumulated during the printing.

For this purpose, control means may be any means for directly reading the head temperature during the printing and reducing the input energy with that head temperature, means for controlling the driving with respect to the increase in the head temperature by estimating the head temperature, based on data to be printed before the printing, or means for managing the discharge amount during the printing by estimating the temperature elevation produced while measuring the number of ink droplets discharged within a predetermined unit time during the printing, but may not be particularly limited as long as the discharge amount can be maintained constant.

Then, the counter for the remaining detection will be described below by presenting a specific example in the following.

As the counter for the remaining detection, there are provided two types of counters, the first counting the ink consumption by the discharge, and the second counting the ink consumption amount by the recovery operation. The first counter manages the discharge amount in a unit of ng (1 ng=$1\times10^{-9}$ g) and measures the consumption amount based on the discharge signal. The second counter manages the consumption amount in a unit of mg (1 mg=$1\times10^{-3}$ g) and measures the ink consumption amount by counting the ink droplets discharged during the recording and the ink amount consumed by the recovery operation.

That is, when the measured value by the first counter reaches 1,000,000, the second counter is incremented, and the first counter is reset to prepare for the next measurement.

Also, by incrementing the second counter when the recovery operation is executed, the ink consumption amount by the recovery operation can be measured. In the printer of this example, the recovery operation consists of one sort of recovery operation for the Bk head and three sorts of recovery operation for the color head, the consumption amount being different for each operation. It should be noted that the second counter may be "mg" counters which are separately provided for the management of the discharge amount and the management of the recovery operation.

The switching of the LCD display, based on the ink remaining detection, is achieved by changing over any of the first to fourth indications as above mentioned to indicate the bar graph stepwise, when the second counter value reaches a predetermined set value.

The amount of ink droplets discharged is measured by directly adding the discharge amount. In this example, the ink discharge amount is set to 90 ng, and by counting (incrementing) by 90 the first counter for each discharge of an ink droplet, the ink consumption amount by discharge can be measured.

Specifically, by the ink discharge number is meant the total number of discharges which are used during the printing and the predischarge occurring during the printing irrespective of the printing or the predischarge involving the recovery operation to resolve the thickened ink or color mixture.

Next, a way of counting the ink consumption amount by the recovery operation will be described below.

For the recovery operation, the second counter is used to measure the ink consumption amount in a unit of "mg", as previously described. This counter measurement is made by the addition of the consumption amount determined as below. One type of recovery operation is set corresponding to the Bk head, this recovery operation being defined as a "recovery operation 1". The ink consumption amount per one operation for this "recovery operation 1" is set to about 0.1 g (100 mg) in this example. Namely, the number of operations for the "recovery operation 1" multiplied by 100 is equal to the ink consumption amount by the "recovery operation 1". Accordingly, for every operation of the "recovery operation 1", the second counter is incremented by 100.

It should be noted that the ink consumption amount in the recovery operation is the amount of ink consumed subject to the suction operation, the amount of ink involving the discharge such as predischarge being excluded.

Next, the relation between the above count value and switching of the display will be described.

The Bk cartridge used in this example has an ink tank and a head integrally formed, in which the ink amount usable in practice (hereinafter referred to as a net ink amount) is about 40 g. That is, since the net ink amount of 40 g is present for the Bk head, the relation with the switching of the display is set as below, based on the sum of the discharge amount of discharged ink (A) and the ink consumption amount by a recovery operation (B).

The switching of the display occurs based on the ink remaining, at four times when the tank is replaced with a new tank, when the ink remaining becomes 66.0%, when the ink remaining becomes 33.0%, and when the ink remaining becomes 1.3%.

The ink remaining can be calculated based on the second counter, and the quantity of the net ink amount subtracted by the count value (mg) of the second counter is the ink remaining. The ink remaining indicated by the above percentage is calculated based on the capacity of the ink tank in this example and can be expressed in the following manner.

<Setting value Bk-1>

First indication: Ink remaining 100% (reset operation)

Second indication (A1): When the ink remaining becomes 66.0% (=26.40 g=26,400 mg) of the full capacity.

Third indication: When the ink remaining becomes 33.0% (=13.20 g=13,200 mg) of the full capacity.

Fourth indication: When the ink remaining becomes 1.3% (=0.50 g=500 mg) of the full capacity.

According to the above four classifications, the indication of the bar graph on the LCD is switched. Note that the fourth indication flashes to give a warning, but the reference ink remaining is not limited to 0.5 g, and may be any value.

When the color head is mounted, the ink remaining is counted for each of the Bk ink tank and the color ink tank, and individually indicated, based on the count, because the Bk ink tank and the color ink tank can be separately dismounted, as previously described. Regarding the color cartridge, like the Bk cartridge, the ink consumption is counted by two kinds of counters, i.e., "ng counter" and "mg counter".

For the color head in which the Bk ink tank and the color ink tank can be separately exchanged, because the discharge amount of Bk ink is 70 ng per discharge and the discharge amount of color ink is 40 ng per discharge, as previously described, the ink consumption amount measured by counting is equal to (A)−2 Bk ink discharged consumption amount=discharge number×70(ng)

Color discharged ink consumption amount=discharge number×40(ng) Also, there are three kinds of recovery operation for the color head, as previously described. Supposing that the three kinds of recovery operation are "recovery operation 2", "recovery operation 3", and "recovery operation 4", the consumption amount per operation is as follows.

(B) Recovery operation 2: Bk head 0.1 g=100 mg Color head 0.04 g=40 mg (C) Recovery operation 3: Bk head 0.2 g=200 mg Color head 0.08 g=80 mg (D) Recovery operation 4: Bk head 0.3 g=300 mg Color head 0.12 g=120 mg The consumption amount can be calculated by multiplying the operation number and the ink consumption amount for each recovery operation, based on the ink consumption amount per recovery operation, as above described.

The ink consumption amount of the whole color cartridge can be measured by the sum of (A)–2, (B), (C) and (D), as above described.

Herein, the recovery operation 2 is a manual suction operation by the user, the recovery operation 3 is an automatic suction operation when the head is exchanged, and the recovery operation 4 is a suction operation when the tank is exchanged. However, of course, the application of the present invention is not limited thereto.

Herein, the net ink amount of the ink tank to be used with the color head is 20 g for the Bk tank, and 10 g for the color tank of each color C, M, Y.

In this example, when the reset operation is performed by exchanging the black tank for a new tank, the remaining indication is switched if the black ink remaining becomes 66.0%, 33.0%, and 2.5% of the total capacity. Also, for the color tank, when the reset operation is performed by exchanging the tank for a new tank, the remaining indication is switched if the ink remaining becomes 66.0%, 33.0%, and 4.0%. Supposing that the black tank setting value is C-Bk1, and the color tank setting value is Col-1, the ink remaining (mg) for a respective indication is as follows.

<Setting value C-Bk1>

First indication: Ink remaining 100% (reset operation)

Second indication (C-A): Ink remaining 66.0%=13.2 g=13,200 mg

Third indication (C-A2): Ink remaining 33.0%=6.6 g=6,600 mg

Fourth indication (C-A3): Ink remaining 2.5%=0.5 g=500 mg

<Setting value Col-1>

First indication: Ink remaining 100% (reset operation)

Second indication (Col-A): Ink remaining 66.0%=6.60 g=6,600 mg

Third indication (Col-A2): Ink remaining 33.0%=3.30 g=3,300 mg

Fourth indication (Col-A3 ): Ink remaining 4.0%=0.40 g=400 mg

The indication with the bar graph on the LCD is changed corresponding to the Bk cartridge and the color cartridge, based on the above setting values. Regarding the switching of the indication, for the color cartridge having fixed three colors, since three color inks are stored within the tanks formed integrally, and there is provided only one indication for the color, the ink remaining is indicated for the ink having the least amount of ink remaining among the colors of Y, M and C.

Herein, an ink tank originally mounted on a new cartridge has a different net ink amount than the ink tank to be individually exchanged later. The reason is that the ink tank originally mounted on the cartridge, which has undergone an inspection process such as a test print with a predetermined quantity for the shipment, has a decreased net value by the amount of the ink consumed.

Next, the exchange of only the ink tank will be described below.

In the printer, the ink remaining detection setting value is changed to the second setting value, upon detecting the ink tank exchange operation.

An ink tank newly exchanged has a net ink amount of which no ink is consumed by the test print. Therefore, the ink amount is greater than the setting value as above mentioned, and if yet not used, the Bk tank has an ink remaining of 23 g, and the color tanks C, M, Y each have an ink remaining of 11 g. Accordingly, the setting values for switching the display of the ink remaining detected are as follows.

<Setting value C-Bk2>

First indication: Ink remaining 100% (reset operation)

Second indication (Col-A4): Ink remaining 66.0%=15.18 g=15,180 mg

Third indication (Col-A5): Ink remaining 33.0%=7.59 g=7,590 mg

Fourth indication (Col-A6): Ink remaining 2.2%=0.50 g=500 mg

<Setting value Col-2>

First indication: Ink remaining 100% (reset operation)

Second indication (Col-A7): Ink remaining 66.0%=7.26 g=7,260 mg

Third indication (Col-A8): Ink remaining 33.0%=3.63 g=3,630 mg

Fourth indication (Col-A9): Ink remaining 3.6%=0.40 g=400 mg

The indication with the bar graph on the LCD is changed corresponding to the Bk cartridge and the color cartridge, based on the above setting value. The setting of a last warning operation is the same as the first condition above described, but may be any value.

It should be noted that the detection in exchanging only the ink tank may be achieved by individually attaching information of a new article to the ink tank itself, or without individual information, the user may perform the reset operation in accordance with a method other than that as explained in FIGS. 21A and 21B. The user reset is effected by depressing the panel keys provided for the Bk and color tanks as shown in FIG. 22, and confirmed by the head exchange operation termination or depressing the on-line key.

<Fifth example>

A fifth example of the present invention will be described below in which the ink remaining is corrected by detecting the head temperature elevation during the printing, i.e., the so-called accumulated heat, and based on this value.

In an ink jet head using electrothermal conversion elements, the heat energy is generated by applying a discharge signal to a heater, causing film boiling in the ink on the heater, and discharging the ink owing to pressure of a bubble. In this way, when the electrothermal conversion elements are driven, the head temperature (and the ink temperature) will rise during the printing, typically giving rise to an increase in the volume of an ink droplet to be discharged. For such an increased ink droplet, various proposals have been made to regulate the discharge amount of the ink. However, the present inventors have noted that without regulation, or if the regulation is virtually difficult, the detection accuracy may decrease, unless the correction for the increase or decrease in the ink consumption amount is carried out for detecting the ink remaining.

The head temperature can be determined in various ways, including directly detecting the head temperature during the printing, estimating the head temperature from the print duty, or estimating the current elevated temperature of the head by measuring the number of discharged dots used for printing at every predetermined unit time during the printing.

In this example, the number of discharged dots is measured which has been subjected to printing for a predetermined unit time during the printing, the amount of heat generation is calculated in consideration of the heat amount generated by discharging and the released heat, and the current head temperature is estimated, whereby the ink droplet volume consumed can be corrected based on the discharge amount corresponding to that temperature.

In this example, the number of ink droplets discharged for a unit time during the printing is measured, and the amount of heat generation is estimated, whereby the consumed ink amount is corrected based on that temperature. More specifically, the number of ink droplets discharged at every 10 ms is multiplied by the corrected ink consumption amount, and that data is written in a RAM within the printer. This operation is repeatedly performed. And the data of the current sum is written in an NVRAM which is a non-volatile memory in a unit of a page or at a predetermined timing when the power is turned off.

Note that the head predicted temperature during the printing and the actual head can be more precisely effected, for example, when the sheet is fed after the printing of one line, the actual head temperature and the predicted temperature are compared to modify the temperature error.

Note that the head for use in this example is designed such that the head temperature is maintained at about 20° C. during the printing by driving a sub-heater disposed, apart from the discharge, in which state the printing is performed, and accordingly, the basic discharge amount is fixed. Therefore, the correction for the ink consumption amount is effected at 20° C. or higher. Also, if the head temperature exceeds about 80° C., the discharge becomes unstable, so that the correction value is not set at 80° C. or greater.

Figure 24:
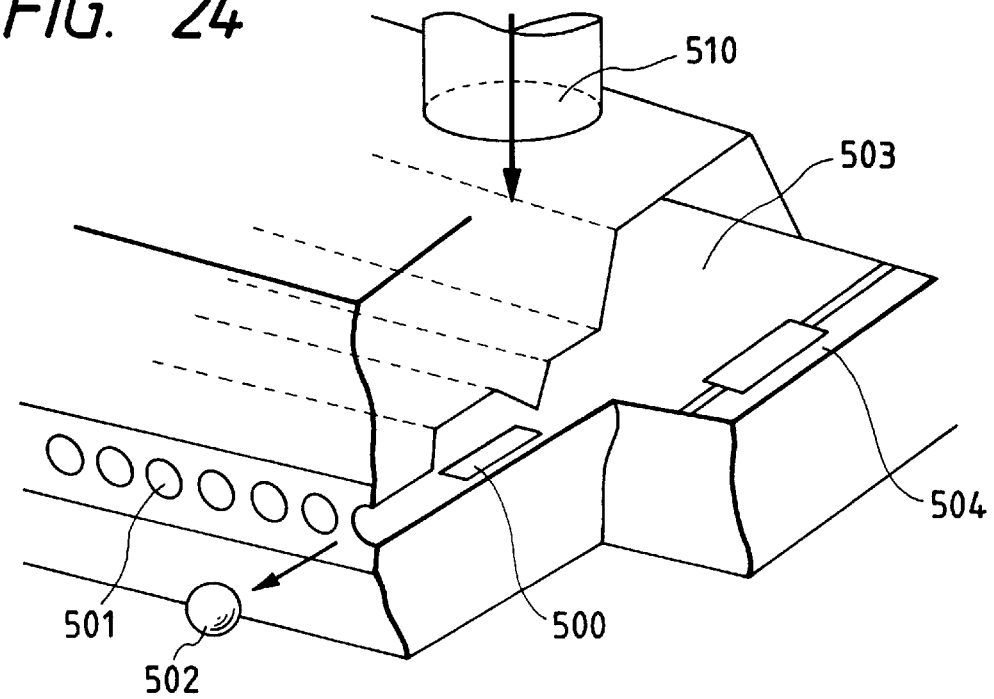
FIG. 24 is a perspective view, partially broken away, showing the details of a head portion of the monochrome cartridge.

FIG. 24 is a typical perspective view, partially broken away, showing the head for use with this invention.

In FIG. 24, 500 is a heater for use in discharging the ink, 501 is a discharge port, and 502 is an ink droplet which is flying. Apart from the heater 500, a sub-heater 504 for maintaining the warm tone of the head is provided on the same substrate. 503 is an ink liquid chamber, and 510 is an ink supply passageway, through which the ink is supplied from an ink tank, not shown.

Calculating the relation between the head temperature and the ink discharge amount, it has been found that the head temperature elevation ΔT relative to the basic ink volume which is discharged at a predetermined temperature on the design is correlative in (deg). Accordingly, the head temperature is directly detected, the amount of heat generated by the head is predicted based on the print duty, and the current head temperature is obtained, whereby the variation in the discharge amount can be estimated. The relation between the head temperature and the discharge amount is shown in FIG. 25.

Figure 25:
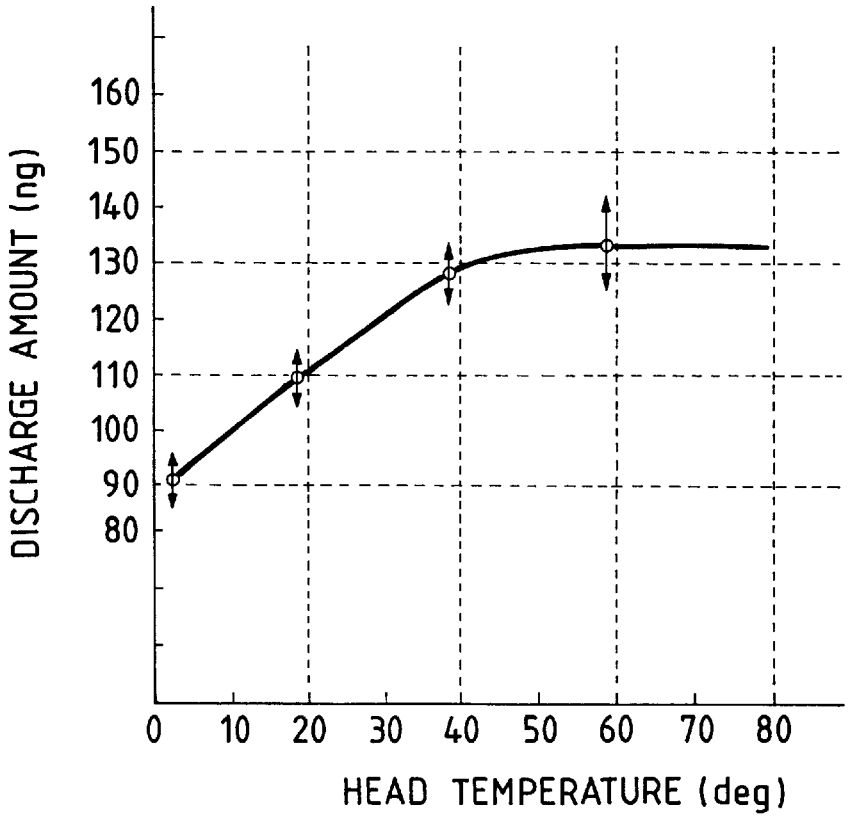
FIG. 25 is a graph showing the relation between the temperature of the head portion and the discharge amount for the monochrome cartridge.

FIG. 25 is a graph showing the relation of the discharge amount (ng) to the head temperature (deg) of Bk head cartridge 7.

From this graph, it can be seen that the discharge amount will increase substantially linearly up to the head temperature near 40 deg.

First, the correction for ink consumption amount when the Bk head is used will be described.

The relation between the head temperature and the discharged ink droplet volume is such that for the head having a basic discharge amount of 90 ng to be discharged from the Bk head at a warm environmental temperature (20° C.), the ink droplet volume will increase about 1ng for every rise of 1 deg in the head temperature, as shown in FIG. 25. Accordingly, the ink consumption amount by the discharge can be set, as listed in Table 3 below. Based on this, the correction for the ink consumption amount is carried out depending on the head temperature, to allow the correct amount to be reflected for the ink remaining detection.

TABLE 3

Head temperature and correction for ink consumption amount (Δ 1 deg = 1 ng)

| Head temperature | Correction amount | Set discharge amount |
|---|---|---|
| 20 (° C.) | 0 (ng) | 90 (ng) |
| 25 | 5 | 95 |
| 30 | 10 | 100 |
| 35 | 15 | 105 |
| 40 | 20 | 110 |
| 45 | 25 | 115 |
| 50 | 30 | 120 |
| 55 | 35 | 125 |
| 60 | 40 | 130 |
| 65 | 40 | 130 |
| 70 | 40 | 130 |
| 75 | 40 | 130 |
| 80 | 40 | 130 |

As listed in Table 3, the reason why the same discharge amount is set at head temperatures of 60° C. or greater is that the discharge volume becomes substantially horizontal at head temperatures of 60° C. or greater as the ink viscosity change and the ink supply are restricted by the cross section of flow passageways, etc., and in practice, the control by stopping the printing, for example, is provided.

Owing to the above correction, the indication of ink remaining detection can be switched based on a more correct consumption amount by calculating the discharge amount consumed as described in the example 1.

Next, the correction with the color cartridge will be described.

As previously described, the ink discharge amount for the color cartridge has a basic discharge amount of 70 ng for the Bk head and 40 ng for the color head. Also, in the case of the color cartridge, it has been found that the discharge amount will increase or decrease with the head temperature , like the Bk cartridge.

The discharge amount of the Bk head will increase about 0.8 ng for every 1 deg of the head temperature elevation (ΔT). Also, for the color head, it will increase about 0. 5 ng for every 1 deg of the head temperature elevation (ΔT). Therefore, the correction for the discharge amount consumed is carried out, based on Table 4 for the Bk head and Table 5 for the color head, as shown below, so that the ink remaining detection can be effected accurately.

TABLE 4

| Head temperature and Bk ink consumption amount for color head (Δ 1 deg = 0.8 ng) | | |
|---|---|---|
| Head temperature | Correction amount | Set discharge amount |
| 20 (° C.) | 0 (ng) | 70 (ng) |
| 25 | 4 | 74 |
| 30 | 8 | 78 |
| 35 | 12 | 82 |
| 40 | 16 | 86 |
| 45 | 20 | 90 |
| 50 | 24 | 94 |
| 55 | 28 | 98 |
| 60 | 32 | 102 |
| 65 | 32 | 102 |
| 70 | 32 | 102 |
| 75 | 32 | 102 |
| 80 | 32 | 102 |

TABLE 5

| Head temperature and C, M, Y set ink consumption amount for color head (Δ 1 deg = 0.5 ng) | | |
|---|---|---|
| Head temperature | Correction amount | Set discharge amount |
| 20 (° C.) | 0 (ng) | 40 (ng) |
| 25 | 2.5 | 42.5 |
| 30 | 5.0 | 45.0 |
| 35 | 7.5 | 47.5 |
| 40 | 10.0 | 50.0 |
| 45 | 12.5 | 52.5 |
| 50 | 15.0 | 55.0 |
| 55 | 17.5 | 57.5 |
| 60 | 20.0 | 60.0 |
| 65 | 20.0 | 60.0 |
| 70 | 20.0 | 60.0 |
| 75 | 20.0 | 60.0 |
| 80 | 20.0 | 60.0 |

(Sixth example)

A sixth example of the present invention will be described below.

This example, unlike the above examples, is one in which by providing a control of varying the driving condition of the head, i.e., the applied pulse, in accordance with the head temperature during the printing, the driving is effected by proper pulses corresponding to the head temperature, with the discharge amount of the ink droplet maintained constant, irrespective of the head temperature.

This is one of various driving methods which have been conventionally proposed, but there will be described means of correcting the amount of discharging of the ink droplet in a variety of print modes when such a discharge control is performed.

In recent years, the data processing mainly for the image has increased. Moreover, using various application software on the system of Windows-OS (trade name), for example, the image has been allowed to output onto various sorts of printing media in a variety of print modes. In such a case, one way for obtaining the high quality image onto various sorts of printing media involves varying the ink discharge amount.

In such a printer, if the ink remaining is detected, a greater error may occur only by the conventional simple dot count method.

The print modes may include, for example, a "fine print mode" of scanning the same pixel multiple times, an "OHP mode" of recording on a transparent film for OHP (overhead projector), and a "draft mode" of recording the draft at a higher speed, in which case the head temperature is controlled in accordance with the mode to vary the discharge amount in printing. Therefore, in the ink remaining detection, the correction and measurement for the discharge amount in accordance with the print mode is necessary.

For example, when printing on the OHP sheet subjected to ink absorption treatment and less liable to blur with the ink, the discharge amount is increased to make the dot size larger to raise the recording image density so that the projected image for the OHP is seen more vividly, or for the image thinned out for recording in, e.g. the draft mode (e.g., 50% thinning), the discharge amount is increased to make the dot size larger to raise the print density. On the other hand, in an economy mode with the ink consumption amount suppressed, the discharge amount is decreased, even though the print density is low.

The correction for the ink consumption amount is made in accordance with the control for the discharge amount. The set temperature and the ink droplet volume in each print mode are set as listed in Table 6 (for Bk cartridge), Table 7 (for Bk head of color cartridge) and Table 8 (for color head of color cartridge), and when printing in a selected print mode, the consumed discharge amount is corrected according to Table 6 to Table 8, and multiplied by the number of discharged ink droplets and added.

TABLE 6

| Correction for ink consumption amount of Bk cartridge | | |
|---|---|---|
| Print mode | Head temperature | Correction amount |
| 1 | 20(°C.) | 0(ng) |
| 2 | 30 | 10 |
| 3 | 40 | 20 |
| 4 | 50 | 30 |
| 5 | 60 | 40 |
| 6 | 70 | 50 |
| 7 | 80 | 60 |

TABLE 7

| Correction for ink consumption amount of color cartridge (0.8ng/deg) | | |
|---|---|---|
| Print mode | Head temperature | Correction amount |
| 1 | 20(°C.) | 0(ng) |
| 2 | 30 | 8 |
| 3 | 40 | 16 |
| 4 | 50 | 24 |
| 5 | 60 | 30 |
| 6 | 70 | 30 |
| 7 | 80 | 30 |

TABLE 8

| Correction for ink consumption amount of color head in color cartridge (0.5ng/deg) | | |
|---|---|---|
| Print mode | Head temperature | Correction amount |
| 1 | 20(°C.) | 0(ng) |
| 2 | 30 | 5 |
| 3 | 40 | 10 |
| 4 | 50 | 15 |
| 5 | 60 | 20 |
| 6 | 70 | 20 |
| 7 | 80 | 20 |

In the above tables, for example, the "fine mode" corresponds to the print mode 2, and the "OHP mode" corresponds to the print mode 5. Also, the "draft mode" corresponds to the print mode 4. Further, when the economy mode is selected in the draft mode, it corresponds to the print mode 1 because the discharge amount is decreased even though the print density is light.

In this way, the consumed ink amount can be accurately measured to correct the ink consumption amount in each print mode, whereby the indication of the ink remaining can be more correctly effected.

(Others)

The present invention brings about excellent particularly in a recording head or a recording device of the system of causing a state change in the ink using heat energy, with means for generating the heat energy as the energy for use to effect the ink discharge (e.g., electrothermal converter or laser beam) among various ink jet recording systems. With such a system, the higher density and resolution of recording can be achieved.

As to its representative constitution and principle, for example, one practiced by use of the basic principle disclosed in, for example, U.S. Pat. Nos. 4,723,129 and 4,740,796 is preferred. This system is applicable to either of the so-called on-demand type and the continuous type. Particularly, the on-demand type is effective because, by applying at least one driving signal which gives rapid temperature elevation exceeding nucleus boiling corresponding to recording information on the electrothermal converters arranged corresponding to the sheets or liquid channels holding the liquid (ink), heat energy is generated at the electrothermal converters to effect film boiling at the heat acting surface of the recording head, and consequently the bubbles within the liquid (ink) can be formed corresponding one-to-one to the driving signals. By discharging the liquid (ink) through an opening for discharging by growth and shrinkage of this bubble, at least one droplet is formed. By making the driving signals into the pulse shapes, growth and shrinkage of the bubbles can be effected instantly and adequately to accomplish more preferable discharging of the liquid (ink) particularly excellent in response characteristic. As the driving signals of such a pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination of the discharging portion, liquid channel, and electrothermal converter (linear liquid channel or right-angled liquid channel) as disclosed in the above-mentioned respective specifications, the constitution by use of U.S. Pat. Nos. 4,558,333 or 4,459,600 disclosing the constitution having the heat acting portion arranged in the flexed region is also included in the present invention. In addition, the present invention also can be effectively made by the constitution as disclosed in Japanese Patent Laid-Open Application No. 59-123670 which discloses the constitution using a slit common to a plurality of electrothermal converters as the discharging portion of the electrothermal converter or Japanese Patent Laid-Open Application No. 59-138461 which discloses the constitution having the opening for absorbing a pressure wave of heat energy correspondent to the discharging portion. That is, the present invention makes it possible to realize the accurate and efficient recording in whatever form of the recording head.

Furthermore, the present invention also can be effectively applied to the recording head of the full line type having a length corresponding to the maximum width of a recording medium which can be recorded by the recording device. As such a recording head, either the constitution which satisfies its length by a combination of a plurality of recording heads or the constitution as one recording head integrally formed may be used.

In addition, among the serial-type recording heads as above described, the present invention is effective for a recording head fixed to the main device, a recording head of the freely exchangeable chip type which enables electrical connection to the main device or supply of ink from the main device by being mounted on the main device, or a recording head of the cartridge type having an ink tank integrally provided on the recording head itself.

Also, the addition of a restoration means for the recording head, a preliminary auxiliary means, etc., provided as the constitution of the recording device of the present invention is preferable, because the effect of the present invention can be further stabilized. Specific examples of these may include, for the recording head, capping means, cleaning means, pressurization or suction means, electrothermal converters or other types of heating elements, or preliminary heating means according to a combination of these, and it is also effective for performing stable recording to perform a preliminary mode which performs discharging separate from recording.

As for the type or number of recording heads to be mounted, the present invention is effective to a single recording head provided corresponding to the monocolor ink or a plurality of recording heads corresponding to a plurality of inks having different recording colors or densities, for example. That is, as the recording mode of the recording device, the present invention is extremely effective for not only the recording mode only of a primary color such as black, etc., but also a device equipped with at least one of plural different colors or full color by color mixing, whether the recording head may be constructed integrally or by a combination of plural heads.

In addition, though the ink is considered as the liquid in the embodiments as above described, other inks may also be usable which are solid at or below room temperature and will soften or liquefy above room temperature, or liquefy when a recording enable signal is issued as is common with the ink jet device to control the viscosity of ink to be maintained within a certain range of the stable discharge by adjusting the temperature of the ink in a range from 30 to 70° C. In addition, in order to surely avoid the temperature elevation due to heat energy by utilizing the heat energy as the energy for the change of state from solid to liquid, or to prevent the evaporation of ink, the ink which will stiffen in the shelf state and liquefy by heating may be used. In either case, the use of the ink having a property of liquefying only with the application of heat energy, such as the ink that will liquefy with the application of heat energy in accordance with a recording signal so that liquid ink is discharged, or may have already solidified when arriving at the recording medium, is also applicable in the present invention.

In such a case, the ink may be held as a liquid or solid in recesses or through holes of a porous sheet, which is placed opposed to electrothermal converters, as described in Japanese Patent Laid-Open Application No. 54-56847 or No. 60-71260. The most effective method for the ink as above described in the present invention is based on the film boiling.

Furthermore, an ink jet recording apparatus of the present invention may be used as an image output terminal of information processing equipment such as a computer, or in the form of a copying machine combined with a reader or a facsimile terminal equipment having transmission and reception features.

As will be apparent from the above description, according to the present invention, the calculation of ink consumption amount and the informing of the amount of ink remaining based on this can be varied, depending on the type of head used in printing, so that it is possible to inform the ink remaining within an ink storing vessel correctly even when the discharge amount is different with the head used.

Also, since the ink consumption amount is corrected in accordance with the discharge amount of a head, the detection of the ink remaining based on this consumption amount can be effected more accurately.

Consequently, an ink jet printing apparatus with a high reliability can be provided.

What is claimed is:

1. An ink jet printing apparatus capable of exchangeably mounting a plurality of kinds of recording means provided with discharging means for discharging ink, said apparatus performing printing on a printing medium by discharging the ink with the recording means, said apparatus comprising:

recovery operation means for effecting a recovery operation for recovering a discharge condition of a recording head to be mounted to said apparatus;

timer means for clocking an elapsed time from a predetermined operation;

discriminating means for discriminating recording means to be mounted to said apparatus;

memory means for memorizing data regarding an elapsed time from a previous recovery operation for each of the plurality of kinds of recording means;

calculating means for calculating an elapsed time of the recording means to be mounted to said apparatus from a previous recovery operation by said recovery operation means, based on an elapsed time clocked by said timer means and data memorized in said memory means;

switch means for switching between an operation state and a non-operation state of said apparatus;

back-up means for backing up the clocking operation of said timer means and a memorizing operation of said memory means, even when said apparatus is not in operation as set by said switch means, said back-up means also backing up a clocking operation of said timer means and a memorizing operation of said memory means for a recording means, of the plurality of kinds of recording means, not mounted to said apparatus; and recovery control means for controlling the recovery operation by said recovery operation means by comparing the elapsed time from the previous recovery operation with a predetermined reference time for the recording means to be mounted to said apparatus.

2. An ink jet printing apparatus according to claim 1, wherein the plurality of kinds of recording means are exchangeable, and said apparatus is able to mount one of the plurality of kinds of recording means.

3. An ink jet printing apparatus according to claim 1, wherein said apparatus is able to mount two or more of the plurality of kinds of recording means, said recovery operation means are provided in a plural number corresponding to the plurality of recording means to be mounted, and said recovery control means controls the recovery operation with said recovery operation means for each of the plurality of recording means to be mounted by comparing the elapsed time with the predetermined reference time for each of the plurality of recording means.

4. An ink jet printing apparatus according to claim 1, wherein said memorizing means is a non-volatile memory which is writable and erasable.

5. An ink jet printing apparatus according to claim 1, wherein said recording means is an ink jet cartridge which has a discharge unit with said discharge means for discharging the ink and an ink storing unit for storing the ink integrally formed, and is exchangeable.

6. An ink jet printing apparatus according to claim 5, wherein said recovery control means causes said recovery operation means to perform the recovery operation when said discriminating means discriminates that an ink jet cartridge mounted to said apparatus is new.

7. An ink jet printing apparatus according to claim 1, wherein the plurality of kinds of recording means comprises recording means for recording black by discharging black ink and recording means for color recording, being capable of discharging inks of multiple different colors.

8. An ink jet printing apparatus according to claim 7, wherein said recording means is an ink jet cartridge which has a discharge unit with said discharge means for discharging the ink and an ink storing unit for storing the ink integrally formed, and is exchangeable.

9. An ink jet printing apparatus according to claim 7, wherein said recording means for the color recording has a discharge unit with said discharging means for discharging the ink and an ink storing unit for storing the ink which are separable and exchangeable individually.

10. An ink jet printing apparatus according to claim 1, wherein said recording means has a discharge unit with said discharging means and an ink storing unit for storing the ink which are separable and exchangeable individually, and said recovery control means causes said recovery operation means to perform the recovery operation when said ink storing unit is replaced with a new one.

11. An ink jet printing apparatus according to claim 1, wherein said recording means has a discrimination unit for discriminating with said discriminating means.

12. An ink jet printing apparatus according to claim 1, wherein the predetermined reference time is different with the kind of recording means to be mounted.

13. An ink jet printing apparatus according to claim 1, wherein said back-up means has a power source capable of assuring operation of said timer means and said memory means when said apparatus is not in operation.

14. An ink jet printing apparatus according to claim 1, wherein said discharging means is an electrothermal converter for applying heat energy to the ink, and said recording means discharges the ink by applying the heat energy to the ink.

15. A recovery control method for an ink jet printing apparatus capable of exchangeably mounting a plurality of kinds of recording means provided with discharging means for discharging the ink, the apparatus performing printing on a printing medium by discharging the ink with the recording means, said method comprising:

a memorizing step of memorizing data regarding an elapsed time from a previous recovery operation for each of the plurality of kinds of recording means;

a clocking step of clocking an elapsed time from a predetermined operation;

a back-up step of (i) backing up data memorized in said memorizing step and by the clocking operation in said clocking step, while the ink jet printing apparatus is switched into a non-operation state, and (ii) backing up a clocking operation of said clocking step and data memorized in said memorizing step for a recording means, not mounted to the apparatus;

a measuring step of measuring an elapsed time from a previous recovery operation of the recording means to be mounted to the apparatus, when the ink jet printing apparatus is switched from the non-operation state to an operation state; and a recovery control step of controlling a recovery operation for recovering an ink discharge condition of the recording means by comparing an elapsed time from a previous recovery operation with a predetermined reference time for the recording head to be mounted.

16. A recovery control method according to claim 15, wherein the apparatus is able to mount two or more of the plurality of kinds of recording means, said recovery control step controlling the recovery operation for each of the plurality of recording means by comparing the elapsed time with the reference time for each of the plurality of recording means.

17. A recovery control method according to claim 15, further comprising a discriminating step of discriminating the kind of recording means to be mounted, wherein said recovery control step causes the recovery operation to be performed when the recording means is replaced with a new one.

18. A recovery control method according to claim 15, wherein the discharging means is an electrothermal converter for applying heat energy to the ink, and the recording means discharges the ink by applying the heat energy to the ink.

19. A head recovery method for controlling a recovery operation of an ink jet head of an ink jet printing apparatus which performs printing on a printing medium using an ink jet head mounted to a mounting portion, the mounting portion being capable of selectively mounting one of at least two kinds of ink jet heads, said head recovery method comprising:

a measuring step of measuring an elapsed time from a previous recovery operation for at least the two kinds of ink jet heads by measuring means having a power source backed up, said measuring step performing a measuring operation of an elapsed time for an ink jet head, of the at least two kinds of ink jet heads, not mounted to the mounting portion; and a recovery step of performing a recovery operation for the ink jet head to be mounted to the mounting portion, by recovery means, when an elapsed time from a previous recovery operation exceeds a predetermined reference time.

20. An ink jet printing apparatus capable of mounting recording means having a discharging unit for discharging ink and an ink storing unit for storing ink to be supplied to the discharging unit, said apparatus performing printing on a printing medium by discharging the ink, using a plurality of kinds of exchangeable recording means, said apparatus comprising:

kind detecting means for detecting the kind of recording means to be used for printing among the plurality of kinds of recording means;

calculation means for calculating an amount of ink consumed by the recording means used for the printing, in accordance with the kind of recording means detected by said kind detecting means detects; and informing means for informing with different indications the amount of ink remaining in the ink storing unit based on the amount of ink consumed calculated by said calculation means, depending on the kind of recording means detected by said kind detecting means.

21. An ink jet printing apparatus according to claim 20, further comprising a display unit for displaying predetermined information, wherein said informing means informs the amount of ink remaining by providing an indication on said display unit.

22. An ink jet printing apparatus according to claim 20, wherein one of the plurality of kinds of recording means is an ink jet cartridge which is exchangeable with the discharge unit and is integrally formed with the ink storing unit.

23. An ink jet printing apparatus according to claim 20, wherein one of the plurality of recording means is an ink jet cartridge having the discharge unit and the ink storing unit which are separable and individually exchangeable.

24. An ink jet printing apparatus according to claim 23, further comprising exchange detecting means for detecting the exchange of an ink storing unit, wherein said informing means informs the amount of ink remaining with the different indications, depending on the ink storing unit detected by said exchange detecting means.

25. An ink jet printing apparatus according to claim 20, wherein the plurality of recording means is one of an integral type ink jet cartridge having the discharge unit and the ink storing unit integrally formed, which is exchangeable, and a separation type ink jet cartridge having the discharge unit and the ink storing unit, which are separable and individually exchangeable.

26. An ink jet printing apparatus according to claim 20, wherein said informing means informs the amount of ink remaining with the different indications, depending on the recording means to be mounted.

27. An ink jet printing apparatus according to claim 20, wherein the storing unit can be used exchangeably corresponding to the recording means for use in the printing, said apparatus further comprises exchange detecting means for detecting an exchange of the ink storing unit, and said informing means further informs the amount of ink remaining with the different indications, depending on the ink storing unit detected by said exchange detecting means.

28. An ink jet printing apparatus according to claim 27, further comprising a plurality of operation means corresponding to the ink storing unit mountable, wherein said exchange detecting means detects that a corresponding ink storing unit is exchanged in accordance with the operation of said operation means.

29. An ink jet printing apparatus according to claim 27, wherein said apparatus further comprises detection means for detecting one of the mounting and dismounting of the recording means, and wherein said informing means informs the amount of ink remaining with the different indications, depending on the detection of said kind detecting means, when a predetermined operation with said operation means is performed after said detection means detects the mounting or dismounting of the recording means.

30. An ink jet printing apparatus according to claim 20, further comprising recovery means for recovering the discharge condition of the ink with the recording means by discharging the ink from the discharge unit, wherein said calculation means calculates the amount of ink consumption, based on the amount of ink discharged from the discharge unit and the amount of ink exhausted by said recovery means.

31. An ink jet printing apparatus according to claim 30, wherein said calculation means comprises count means for counting at every predetermined increment, the amount of consumption of the ink.

32. An ink jet printing apparatus according to claim 20, wherein said calculation means comprises first count means for counting, corresponding to a relatively small amount of consumption of the ink, and second count means for counting, corresponding to a relatively large amount of consumption of the ink.

33. An ink jet printing apparatus according to claim 32, wherein when the ink consumption amount corresponding to the value counted by said first count means reaches a consumption amount corresponding to a predetermined count value of said second count means, said second count means counts up by a predetermined count value, and said first count means is reset.

34. An ink jet printing apparatus according to claim 32, wherein said first count means counts, in accordance with the amount of ink discharged from the discharge unit of the recording means to be mounted, when the ink is discharged by the recording means, and said second count means counts in accordance with the amount of ink exhausted by recovery means.

35. An ink jet printing apparatus according to claim 30, wherein said recovery means causes a different amount of ink to be exhausted, depending on the recording means to be mounted.

36. An ink jet printing apparatus according to claim 30, further comprising suction means for sucking the ink from the discharge unit, wherein said recovery means exhausts the ink out of the discharge unit by sucking the ink through the discharge unit with said suction means.

37. An ink jet printing apparatus according to claim 30, wherein said recovery means exhausts the ink out of the discharge unit by performing a pressurizing operation.

38. An ink jet printing apparatus according to claim 30, wherein said recovery means exhausts the ink by discharging the ink from the discharge unit.

39. An ink jet printing apparatus according to claim 20, wherein the discharge unit comprises discharge means for discharging the ink, and the discharge means are electrothermal converters for applying heat energy to the ink to discharge the ink by applying the heat energy to the ink.

40. An ink jet printing apparatus capable of mounting recording means having a discharging unit for discharging ink and an ink storing unit for storing ink to be supplied to the discharging unit, said apparatus performing printing on a printing medium by discharging the ink, using a plurality of kinds of exchangeable recording means, said apparatus comprising:

calculation means for calculating an amount of ink consumed by the discharging unit;

discharge amount detecting means for detecting an amount of ink to be discharged from the discharging unit; and ink remaining detecting means for detecting an amount of ink remaining in the ink storing unit based on the consumed ink amount calculated by said calculation means, and for correcting the consumed ink amount calculated by said calculation means, based on the ink discharge amount detected by said discharge amount detecting means.

41. An ink jet printing apparatus according to claim 40, wherein said discharge amount detecting means detects the ink discharge amount, based on information regarding the temperature of the recording means.

42. An ink jet printing apparatus according to claim 40, wherein the recording means perform different recording operations in a plurality of print modes, and said discharge amount detecting means detects the ink discharge amount, based on the print mode of the recording means.

43. An ink jet printing apparatus according to claim 40, wherein said calculation means calculates the amount of ink consumption, based on the number of times of discharging the ink in the recording means and the number of discharge recovery operations of the recording means.

44. An ink jet printing apparatus according to claim 40, wherein the discharge unit discharges the ink by producing a bubble in the ink, using heat energy, and based on the creation of the bubble.

45. An ink jet printing apparatus having a mounting portion for mounting ink jet means provided with discharge means for discharging ink, said apparatus performing printing on a printing medium by discharging ink from ink jet means mounted to a mounting portion, the mounting portion being capable of mounting one of at least two kinds of ink jet means, said apparatus comprising:

recovery means for performing a recovery operation for recovering a discharge state of the ink jet means to be mounted to the mounting portion;

timer means for measuring an elapsed time from a predetermined operation;

discriminating means for discriminating a type of the ink jet means to be mounted to the mounting portion; and recovery control means for maintaining an elapsed time of each of the at least two kinds of ink jet means from a previous recovery operation by said recovery means, and for causing a recovery operation for the ink jet means to be mounted to the mounting portion by said recovery means when the elapsed time from the previous recovery operation exceeds a predetermined reference time.

46. An ink jet printing apparatus according to claim 45, wherein the at least two kinds of ink jet means are exchangeable, and said apparatus is able to mount the at least two kinds of ink jet means.

47. An ink jet printing apparatus according to claim 45, wherein said apparatus is able to mount two or more of the at least two kinds of ink jet means, said recovery control means is provided in a plural number corresponding to the plurality of ink jet means to be mounted, and said recovery control means controls the recovery operation with said recovery means for each of the plurality of ink jet means to be mounted by comparing an elapsed time with a predetermined reference time for each of the ink jet means.

48. An ink jet printing apparatus according to claim 45, further comprising memorizing means, which is a non-volatile memory that is writable and erasable.

49. An ink jet printing apparatus according to claim 45, further comprising recording means, which is an ink jet cartridge that has a discharge unit with discharge means for discharging the ink and an ink storing unit for storing the ink integrally formed, and is exchangeable.

50. An ink jet printing apparatus according to claim 49, wherein said recovery control means causes said recovery means to perform the recovery operation when said discriminating means discriminates that an ink jet cartridge mounted to said apparatus is new.

51. An ink jet printing apparatus according to claim 45, wherein the at least two kinds of ink jet means comprises recording means for recording black by discharging black ink and recording means for color recording, being capable of discharging inks of multiple different colors.

52. An ink jet printing apparatus according to claim 51, further comprising recording means, which is an ink jet cartridge that has a discharge unit with discharge means for discharging the ink and an ink storing unit for storing the ink integrally formed, and is exchangeable.

53. An ink jet printing apparatus according to claim 51, wherein said recording means for the color recording has a discharge unit with discharging means for discharging the ink and an ink storing unit for storing the ink which are separable and exchangeable individually.

54. An ink jet printing apparatus according to claim 45, further comprising recording means, which has a discharge unit with discharging means and an ink storing unit for storing the ink which are separable and exchangeable individually, and said recovery control means causes said recovery means to perform the recovery operation when an ink storing unit is replaced with a new one.

55. An ink jet printing apparatus according to claim 45, further comprising recording means, which has a discrimination unit for discriminating with said discriminating means.

56. An ink jet printing apparatus according to claim 45, wherein a predetermined reference time is different with the kind of ink jet means to be mounted.

57. An ink jet printing apparatus according to claim 45, further comprising back-up means, which has a power source capable of assuring operation of said timer means and memory means when said apparatus is not in operation.

58. An ink jet printing apparatus according to claim 45, further comprising discharging means, which is an electrothermal converter for applying heat energy to the ink, and recording means, which discharges the ink by applying the heat energy to the ink.

59. An ink jet printing apparatus according to claim 20, further comprising memory means for memorizing an amount, corresponding to each of a plurality of kinds of recording means, of ink remaining in the ink storing unit.

60. An ink jet printing apparatus according to claim 59, wherein said memory means comprises a nonvolatile memory.

61. An ink jet printing apparatus having a mounting portion for mounting recording means provided with discharge means for discharging ink, said apparatus performing printing on a printing medium by discharging ink from recording means mounted to a mounting portion, the mounting portion being capable of mounting one of at least two kinds of recording means, said apparatus comprising:

discriminating means for discriminating recording means to be mounted to the mounting portion;

memory means for memorizing data regarding each of the at least two kinds of recording means, the data being data to be utilized for controlling said apparatus; and control means for controlling said apparatus by utilizing data corresponding to recording means to be mounted to the mounting portion, wherein said memory means maintains a state that data corresponding to recording means not to be mounted to the mounting portion among the at least two kinds of recording means are also memorized.

62. An ink jet printing apparatus according to claim 61, wherein said discriminating means discriminates recording means to be mounted to the mounting portion when the recording means to be mounted to the mounting portion is replaced, and said control means controls said apparatus by utilizing data corresponding to the mounted recording means among data to be memorized in said memory means.

63. An ink jet printing apparatus according to claim 61, further comprising:

recovery operation means for effecting a recovery operation for recovering a discharge condition of recording means to be mounted to the mounting portion; and timer means for counting an elapsed time from a predetermined operation, wherein data memorized in said memory means comprises data regarding an elapsed time from a previous recovery operation for each of the at least two kinds of recording means and said control means controls the recovery operation by said recovery operation means based on the data to be memorized.

64. An ink jet printing apparatus according to claim 63, further comprising:

calculating means for calculating an elapsed time of the recording means to be mounted to the mounting portion from a previous recovery operation by said recovery operation means, based on an elapsed time counted by said timer means and data memorized in said memory means.

65. An ink jet printing apparatus according to claim 63, further comprising:

switch means for switching between an operation state and a non-operation state of said apparatus; and back-up means for backing up the counting operation of said timer means and a memorizing operation of said memory means even when said apparatus is not in the operation state as set by said switch means.

66. An ink jet printing apparatus according to claim 65, wherein said back-up means backs up a counting operation of said timer means and a memorizing operation of said memory means for recording means, of the plurality of kinds of recording means, not mounted to the mounting portion.

67. An ink jet printing apparatus according to claim 61, wherein said recording means comprises an ink storing unit.

68. An ink jet printing apparatus according to claim 67, further comprising:

calculation means for calculating an amount of ink consumed by the recording means discriminated by said discriminating means, wherein data to be memorized in said memory means comprises data corresponding to each of the at least two kinds of recording means, the data being amounts of ink remaining in the ink storing unit based on the amount of ink consumed calculated by said calculation means.

69. An ink jet printing apparatus according to claim 68, wherein an amount of ink consumed by the recording means to be mounted to the ink mounting portion is calculated by said calculation means and said control means updates data corresponding to the recording means to be mounted among data to be memorized in said memory means.

70. An ink jet printing apparatus according to claim 68, further comprising:

a display unit for displaying information regarding an amount of ink remaining in the ink storing unit, wherein said control means controls display of information of the amount of ink remaining in the ink storing unit on said display unit, with respect to the recording means to be mounted to the mounting portion.

71. An ink jet printing apparatus according to claim 70, wherein when the recording means to be mounted is replaced, said control means reads out from the memory means and displays on said display unit data corresponding to the recording means to be mounted based on a result discriminated by said discriminating means.

72. An ink jet printing method for use in an ink jet printing apparatus having a mounting portion for mounting recording means provided with discharge means for discharging ink, said method performing printing on a printing medium by discharging ink from recording means mounted to a mounting portion, the mounting portion being capable of mounting one of at least two kinds of recording means, said method comprising the steps of:

discriminating recording means to be mounted to the mounting portion;

memorizing data regarding each of the at least two kinds of recording means in memory means, the data being data to be utilized for controlling the apparatus; and controlling the apparatus by utilizing data corresponding to recording means to be mounted to the mounting portion, wherein the memory means maintains a state that data corresponding to recording means not to be mounted to the mounting portion among the at least two kinds of recording means are also memorized.

73. An ink jet printing method according to claim 72, wherein said discriminating step discriminates recording means to be mounted to the mounting portion when the recording means to be mounted to the mounting portion is replaced, and said controlling step controls the apparatus by utilizing data corresponding to the mounted recording means among data to be memorized in said memorizing step.

74. An ink jet printing method according to claim 72, further comprising the steps of:

effecting a recovery operation for recovering a discharge condition of recording means to be mounted to the mounting portion; and counting an elapsed time from a predetermined operation, wherein data memorized in the memory means comprises data regarding an elapsed time from a previous recovery operation for each of the at least two kinds of recording means and said controlling step controls the recovery operation in said recovery operation effecting step based on the data to be memorized.

75. An ink jet printing method according to claim 74, further comprising the step of:

calculating an elapsed time of the recording means to be mounted to the mounting portion from a previous recovery operation, based on an elapsed time counted by said counting step and data memorized in said memorizing step.

76. An ink jet printing method according to claim 74, further comprising the steps of:

switching between an operation state and a non-operation state of the apparatus; and backing up the counting operation of said counting step and a memorizing operation of said memorizing step even when the apparatus is not in the operation state as set in said switching step.

77. An ink jet printing method according to claim 76, wherein said backing up step backs up a counting operation of said counting step and a memorizing operation of said memorizing step for recording means, of the plurality of kinds of recording means, not mounted to the mounting portion.

78. An ink jet printing method according to claim 72, wherein the recording means comprises an ink storing unit.

79. An ink jet printing method according to claim 78, further comprising the step of:

calculating an amount of ink consumed by the recording means discriminated in said discriminating step, wherein data to be memorized in said memorizing step are data corresponding to each of the at least two kinds of recording means, the data being amounts of ink remaining in the ink storing unit based on the amount of ink consumed calculated in said calculating step.

80. An ink jet printing method according to claim 79, wherein an amount of ink consumed in the recording means to be mounted to the ink mounting portion is calculated in said calculating step and said controlling step updates data corresponding to the recording means to be mounted among data to be memorized in said memorizing step.

81. An ink jet printing method according to claim 79, further comprising the step of:

displaying information regarding an amount of ink remaining in the ink storing unit, wherein said controlling step controls display of information of the amount of ink remaining in the ink storing unit in said displaying step, with respect to the recording means to be mounted to the mounting portion.

82. An ink jet printing method according to claim 81, wherein when the recording means to be mounted is replaced, said controlling step reads out data stored in said memorizing step and displays in said displaying step data corresponding to the recording means to be mounted based on a result discriminated in said discriminating step.

* * * * *

UNITED STATES PATENT AND TRADEMARK OFFICE

CERTIFICATE OF CORRECTION

PATENT NO. : 5,949,447

DATED : September 7, 1999.

INVENTOR(S) : ATSUSHI ARAI ET AL.

It is certified that error appears in the above-identified patent and that said Letters Patent is hereby corrected as shown below:

ON THE TITLE PAGE:

[56] References Cited:

U.S. PATENT DOCUMENTS, "Harrignton, III et al." should read --Harrington, III et al.--.

FOREIGN PATENT DOCUMENTS, "03159750" should read --3-159750--.

"04232068" should read --4-232068--.

"06031921" should read --6-031921--.

COLUMN 6:

Line 40, "recovery" should read --the recovery--.

COLUMN 8:

Line 55, "bubble" should read --bubbles--.

COLUMN 15:

Line 10, "cartridge" should read --carriage--.

Line 21, "cartridge" should read --carriage--.

Line 27, "cartridge" (both occurrences) should read --carriage--.

Line 32, "cartridge" should read --carriage--.

Line 35, "cartridge" should read --carriage--.

Line 43, "cartridge" should read --carriage--.

Line 62, "cartridge" should read --carriage--.

UNITED STATES PATENT AND TRADEMARK OFFICE

CERTIFICATE OF CORRECTION

PATENT NO. : 5,949,447

DATED : September 7, 1999.

INVENTOR(S) : ATSUSHI ARAI ET AL.

It is certified that error appears in the above-identified patent and that said Letters Patent is hereby corrected as shown below:

COLUMN 16:

Line 20, "cartridge" should read --carriage--.
Line 26, "connection" should read --a connection--.
Line 27, "cartridge" should read --carriage--.
Line 29, "cartridge" should read --carriage--.

COLUMN 17:

Line 23, "described" should read --be described--.

COLUMN 18:

Line 36, "member" should read --members--.

COLUMN 19:

Line 47, "cartridge" should read --carriage--.
Line 49, "cartridge" should read --carriage--.
Line 57, "cartridge" should read --carriage--.

COLUMN 24:

Line 67, "amount=discharge number x 70(ng)" should read --amount=discharge number x 70(ng).--.

COLUMN 25:

Line 2, "number x 40(ng)" should read --number x 40(ng).-- and "Also," should begin a new paragraph.

UNITED STATES PATENT AND TRADEMARK OFFICE

CERTIFICATE OF CORRECTION

PATENT NO. : 5,949,447

DATED : September 7, 1999.

INVENTOR(S) : ATSUSHI ARAI ET AL.

It is certified that error appears in the above-identified patent and that said Letters Patent is hereby corrected as shown below:

COLUMN 31:

Line 11, "excellent" should read --excellent effects--.

COLUMN 35:

Line 67, "means detects;" should read --means;--.

Signed and Sealed this

Nineteenth Day of September, 2000

*Attest:*

Q. TODD DICKINSON

*Attesting Officer*

*Director of Patents and Trademarks*